US009324333B2

(12) United States Patent
Rajendran et al.

(10) Patent No.: US 9,324,333 B2
(45) **Date of Patent: *Apr. 26, 2016**

(54) SYSTEMS, METHODS, AND APPARATUS FOR WIDEBAND ENCODING AND DECODING OF INACTIVE FRAMES

(75) Inventors: Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 13/565,074

(22) Filed: Aug. 2, 2012

(65) Prior Publication Data

US 2012/0296641 A1 Nov. 22, 2012

Related U.S. Application Data

(63) Continuation of application No. 11/830,812, filed on Jul. 30, 2007, now Pat. No. 8,260,609.

(60) Provisional application No. 60/834,688, filed on Jul. 31, 2006.

(51) Int. Cl.
*G10L 19/24* (2013.01)
*G10L 21/038* (2013.01)

(52) U.S. Cl.
CPC ..... *G10L 19/24* (2013.01); *G10L 21/038* (2013.01)

(58) Field of Classification Search
CPC ..... G10L 19/24; G10L 21/038
See application file for complete search history.

(56) References Cited

U.S. PATENT DOCUMENTS 5,504,773 A 4/1996 Padovani et al.
5,581,652 A 12/1996 Abe et al.
5,704,003 A 12/1997 Kleijn et al.

(Continued)

FOREIGN PATENT DOCUMENTS

CA 2603255 A1 10/2006
CN 1282952 A 2/2001

(Continued)

OTHER PUBLICATIONS

3rd Generation Partnership Project 2 ("3GPP2"), Enhanced Variable Rate Codec, Speech Service Option 3, 68 and 70 for Wideband Spread Spectrum Digital Systems, 3GPP2 C.S0014-C, ver. 1.0, Jan. 2007, § 4.11.5 to 4.11.5.3, pp. 4-91 to 4-94.

3rd Generation Partnership Project 2 (3GPP2), "Enhanced Variable Rate Codec, Speech Service Option 3 and 68 for Wideband Spread Spectrum Digital Systems," 3GPP2 C.S0014-B, Version 1.0, May 2006, Ch. 4.1 to 4.5, pp. 4-1 to 4-45.

(Continued)

*Primary Examiner* — Angela A Armstrong
(74) *Attorney, Agent, or Firm* — Heejong Yoo

(57) ABSTRACT

Speech encoders and methods of speech encoding are disclosed that encode inactive frames at different rates. Apparatus and methods for processing an encoded speech signal are disclosed that calculate a decoded frame based on a description of a spectral envelope over a first frequency band and the description of a spectral envelope over a second frequency band, in which the description for the first frequency band is based on information from a corresponding encoded frame and the description for the second frequency band is based on information from at least one preceding encoded frame. Calculation of the decoded frame may also be based on a description of temporal information for the second frequency band that is based on information from at least one preceding encoded frame.

20 Claims, 37 Drawing Sheets

(56) References Cited

U.S. PATENT DOCUMENTS

| | | | | |
|---|---|---|---|---|
| 6,049,537 | A | 4/2000 | Proctor et al. | |
| 6,295,009 | B1 * | 9/2001 | Goto | 341/50 |
| 6,330,532 | B1 | 12/2001 | Manjunath et al. | |
| 6,393,000 | B1 | 5/2002 | Feldman | |
| 6,654,718 | B1 | 11/2003 | Maeda et al. | |
| 6,691,084 | B2 | 2/2004 | Manjunath et al. | |
| 6,738,391 | B1 | 5/2004 | Kim et al. | |
| 6,807,525 | B1 | 10/2004 | Li et al. | |
| 6,879,955 | B2 | 4/2005 | Rao | |
| 7,246,065 | B2 | 7/2007 | Tanaka et al. | |
| 8,140,324 | B2 | 3/2012 | Vos et al. | |
| 8,260,609 | B2 * | 9/2012 | Rajendran et al. | 704/210 |
| 8,532,984 | B2 * | 9/2013 | Rajendran et al. | 704/205 |
| 2001/0048709 | A1 | 12/2001 | Hoffmann et al. | |
| 2004/0098255 | A1 | 5/2004 | Kovesi et al. | |
| 2005/0004803 | A1 * | 1/2005 | Smeets et al. | 704/500 |
| 2005/0071153 | A1 * | 3/2005 | Tammi et al. | 704/219 |
| 2005/0143985 | A1 * | 6/2005 | Sung et al. | 704/219 |
| 2006/0171419 | A1 | 8/2006 | Spindola et al. | |
| 2006/0271356 | A1 | 11/2006 | Vos | |
| 2006/0277038 | A1 | 12/2006 | Vos et al. | |
| 2006/0277042 | A1 | 12/2006 | Vos et al. | |
| 2006/0282262 | A1 | 12/2006 | Vos et al. | |
| 2006/0282263 | A1 | 12/2006 | Vos et al. | |
| 2007/0088541 | A1 * | 4/2007 | Vos et al. | 704/219 |
| 2007/0088542 | A1 * | 4/2007 | Vos et al. | 704/219 |
| 2007/0088558 | A1 | 4/2007 | Vos et al. | |
| 2007/0171931 | A1 | 7/2007 | Manjunath et al. | |
| 2009/0292537 | A1 | 11/2009 | Ehara et al. | |

FOREIGN PATENT DOCUMENTS

| | | | |
|---|---|---|---|
| CN | 1510661 | A | 7/2004 |
| EP | 1061506 | A2 | 12/2000 |
| EP | 1229520 | A2 | 8/2002 |
| EP | 1441330 | | 7/2004 |
| EP | 1 061 506 | B1 * | 5/2006 |
| JP | 6118995 | A | 4/1994 |
| JP | 2001005474 | A | 1/2001 |
| JP | 2002237785 | A | 8/2002 |
| JP | 2003534578 | A | 11/2003 |
| JP | 2004004530 | A | 1/2004 |
| JP | 2004206129 | A | 7/2004 |
| JP | 2007240902 | A | 9/2007 |
| JP | 4824167 | | 9/2011 |
| KR | 20010007416 | | 1/2001 |
| RU | 2005113876 | A | 10/2005 |
| TW | I246256 | | 12/2005 |
| TW | I257604 | | 7/2006 |
| WO | 0186635 | A1 | 11/2001 |
| WO | 0191113 | A1 | 11/2001 |
| WO | 03065353 | A1 | 8/2003 |
| WO | 2004006226 | A1 | 1/2004 |
| WO | 2004034376 | | 4/2004 |
| WO | 2005101372 | A1 | 10/2005 |
| WO | 2006028009 | | 3/2006 |
| WO | 2006049205 | A1 | 5/2006 |
| WO | 2006062202 | A1 | 6/2006 |

OTHER PUBLICATIONS

Co-pending U.S. Appl. No. 07/713,661, filed Jun. 11, 1991.

Co-pending U.S. Appl. No. 09/191,643, filed Nov. 13, 1998.

ETSI TS 126 192, Digital Cellular telecommunications system (Phase 2+); Universal Mobile Telecommunications System (UMTS); AMR speech Codec (3GPP TS 26.192, version 6.0.0, Release 6), Dec. 2004, Ch. 1-7, pp. 1-14.

European Telecommunications Standards Institute (ETSI) 3rd Generation partnership Project (3GPP), Digital cellular telecommunications system (Phase 2+), Enhanced Full Rate (EFR) speech transcoding, GSM 06.60, ver. 8.0.1, Release 1999. Nov. 2000.

European Telecommunications Standards Institute (ETSI) 3rd Generation Partnership Project (3GPP). Digital cellular telecommunications system (Phase 2+), Full rate speech, Transcoding, GSM 06.10, ver. 8.1.1, Release 1999, Nov. 2000.

European Telecommunications Standards Institute (ETSI), Digital cellular telecommunications system (Phase 2+); Universal Mobile Telecommunications System (UMTS); Mandatory speech Codec Speech processing functions AMR Wideband Speech Codec, comfort noise Aspects. (3GPP TS 26.192 version 6.0.0 Release 6), ETSI TS 126 192 V6.0.0 (Dec. 2004), pp. 1-14.

G. 722.2 Annex A: Comfort noise aspects, ITU-T Series G: Transmission Systems and Media, Digital Systems and Networks, Digital Terminal equipments Coding of analogue signals by methods other than PCM, Wideband coding of speech at around 16 kbit/s using Adaptive Multi-Rate Wideband (AMR-WB) pp. 1-8, Jan. 31, 2002.

International Search Report, PCT/US07/074886, International Search Authority, European Patent Office, Apr. 17, 2008.

International Telecommunication Union, ITU-T, Telecommunication Standardization Sector of ITU; G.722.2; Wideband Coding of speech at around 16 kbit/s using Adaptive Multi-Rate Wideband (AMR-WB), Jul. 2003, Ch. 5, pp. 14-37.

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using Conjugate-Structure Algebraic-Code-Excited Linear-Prediction (CS-ACELP), Annex E: 11.8 kbit/s CS-ACELP speech coding algorithm ("G.729 Annex E"), Sep. 1998.

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using conjugate structure algebraic-code-excited linear-prediction (CS-ACELP), Annex B: A silence compression scheme for G.729 optimized for terminals conforming to Recommendation V.70 ("G.729 Annex B"), Nov. 1996 .

ITU-T G.729.1 (May 2006), Series G: Transmission Systems and Media, Digital Systems and Networks, Digital terminal equipments—Coding of analogue signals by methods other than PCM, G.729-based embedded variable bit-rate coder: An 8-32 kbits/ scalable wideband coder bitstream interoperable with G.729, 100pp.

McCree, Alan, et al., An Embedded Adaptive Multi-Rate Wideband Speech Coder, IEEE International Conference on Acoustics, Speech, and Signal Processing, May 7-11, 2001, pp. 761-764, vol. 1 of6.

Taiwan Search Report—TW096128127—TIPO—Apr. 16, 2011.

Telecommunications Industry Association, TIA Standard, Enhanced Variable Rate Codec Speech Service Option and YY for Wideband Spread Spectrum Digital Systems, TIA-127-A (Revision of TIA-127), Telecommunications Industry Association, May 2004.

Telecommunications Industry Association, TIA Standard, Enhanced Variable Rate Codec Speech Service Option and YY for Wideband Spread Spectrum Digital Systems, TIA-127-B (Revision of TIA-127-A), Telecommunications Industry Association, Dec. 2006.

Telecommunications Industry Association, Tia/Eia Interim Standard, Enhanced Variable Rate Code, Speech Service Option 3 for Wideband Spread Spectrum Digital Systems, Tia-Eia-Is-127, Telecommunications Industry Association and Electronic Industries Association, Jan. 1997.

Telecommunications Industry Association, Tia/Eia Interim Standard, Tdma Cellular/Pcs—Radio Interface—Enhanced Full-Rate Speech Codec, Tia/Eia/Is-641, Telecommunications Industry Association, May 1996.

Telecommunications Industry Association, TR45, TIA/EIA IS-641-A, TDMA CelluladPCS—Radio Interface, Enhanced Full-Rate Voice Codec, Revision A, Telecommunications Industry Association, Sep. 1997.

Written Opinion—PCT/US2007/074886, International Search Authority, European Patent Office, Apr. 17, 2008.

* cited by examiner

| | narrowband | high band | available for other use | speech type |
|---|---|---|---|---|
| coding scheme 1: full-rate CELP (171 bits) | 153 bits (28 for spectral, 125 for excitation) | 16 bits (8 for spectral, 8 for temporal) | 2 bits | voiced |
| coding scheme 2: half-rate NELP (80 bits) | 47 bits (28 for spectral, 19 for temporal) | 27 bits (12 for spectral, 15 for temporal) | 6 bits | unvoiced |
| coding scheme 3: eighth-rate NELP (16 bits) | 15 bits (10 for spectral, 5 for temporal) | (no bits) | 1 bit | inactive |

FIG. 18A

SYSTEMS, METHODS, AND APPARATUS FOR WIDEBAND ENCODING AND DECODING OF INACTIVE FRAMES

CLAIM OF PRIORITY UNDER 35 U.S.C. §120

The present application for patent is a Continuation of patent application Ser. No. 11/830,812, filed Jul. 30, 2007, which claims priority to U.S. Provisional Patent Application No. 60/834,688, filed Jul. 31, 2006, and assigned to the assignee hereof and hereby expressly incorporated by reference herein.

FIELD

This disclosure relates to processing of speech signals.

BACKGROUND

Transmission of voice by digital techniques has become widespread, particularly in long distance telephony, packet-switched telephony such as Voice over IP (also called VoIP, where IP denotes Internet Protocol), and digital radio telephony such as cellular telephony. Such proliferation has created interest in reducing the amount of information used to transfer a voice communication over a transmission channel while maintaining the perceived quality of the reconstructed speech.

Devices that are configured to compress speech by extracting parameters that relate to a model of human speech generation are called "speech coders." A speech coder generally includes an encoder and a decoder. The encoder typically divides the incoming speech signal (a digital signal representing audio information) into segments of time called "frames," analyzes each frame to extract certain relevant parameters, and quantizes the parameters into an encoded frame. The encoded frames are transmitted over a transmission channel (i.e., a wired or wireless network connection) to a receiver that includes a decoder. The decoder receives and processes encoded frames, dequantizes them to produce the parameters, and recreates speech frames using the dequantized parameters.

In a typical conversation, each speaker is silent for about sixty percent of the time. Speech encoders are usually configured to distinguish frames of the speech signal that contain speech ("active frames") from frames of the speech signal that contain only silence or background noise ("inactive frames"). Such an encoder may be configured to use different coding modes and/or rates to encode active and inactive frames. For example, speech encoders are typically configured to use fewer bits to encode an inactive frame than to encode an active frame. A speech coder may use a lower bit rate for inactive frames to support transfer of the speech signal at a lower average bit rate with little to no perceived loss of quality.

FIG. 1 illustrates a result of encoding a region of a speech signal that includes transitions between active frames and inactive frames. Each bar in the figure indicates a corresponding frame, with the height of the bar indicating the bit rate at which the frame is encoded, and the horizontal axis indicates time. In this case, the active frames are encoded at a higher bit rate rH and the inactive frames are encoded at a lower bit rate rL.

Examples of bit rate rH include 171 bits per frame, eighty bits per frame, and forty bits per frame; and examples of bit rate rL include sixteen bits per frame. In the context of cellular telephony systems (especially systems that are compliant with Interim Standard (IS)-95 as promulgated by the Telecommunications Industry Association, Arlington, Va., or a similar industry standard), these four bit rates are also referred to as "full rate," "half rate," "quarter rate," and "eighth rate," respectively. In one particular example of the result shown in FIG. 1, rate rH is full rate and rate rL is eighth rate.

Voice communications over the public switched telephone network (PSTN) have traditionally been limited in bandwidth to the frequency range of 300-3400 kilohertz (kHz). More recent networks for voice communications, such as networks that use cellular telephony and/or VoIP, may not have the same bandwidth limits, and it may be desirable for apparatus using such networks to have the ability to transmit and receive voice communications that include a wideband frequency range. For example, it may be desirable for such apparatus to support an audio frequency range that extends down to 50 Hz and/or up to 7 or 8 kHz. It may also be desirable for such apparatus to support other applications, such as high-quality audio or audio/video conferencing, delivery of multimedia services such as music and/or television, etc., that may have audio speech content in ranges outside the traditional PSTN limits.

Extension of the range supported by a speech coder into higher frequencies may improve intelligibility. For example, the information in a speech signal that differentiates fricatives such as 's' and 'f' is largely in the high frequencies. Highband extension may also improve other qualities of the decoded speech signal, such as presence. For example, even a voiced vowel may have spectral energy far above the PSTN frequency range.

While it may be desirable for a speech coder to support a wideband frequency range, it is also desirable to limit the amount of information used to transfer a voice communication over the transmission channel. A speech coder may be configured to perform discontinuous transmission (DTX), for example, such that descriptions are transmitted for fewer than all of the inactive frames of a speech signal.

SUMMARY

A method of encoding frames of a speech signal according to a configuration includes producing a first encoded frame that is based on a first frame of the speech signal and has a length of p bits, p being a nonzero positive integer; producing a second encoded frame that is based on a second frame of the speech signal and has a length of q bits, q being a nonzero positive integer different than p; and producing a third encoded frame that is based on a third frame of the speech signal and has a length of r bits, r being a nonzero positive integer less than q. In this method, the second frame is an inactive frame that follows the first frame in the speech signal, the third frame is an inactive frame that follows the second frame in the speech signal, and all of the frames of the speech signal between the first and third frames are inactive.

A method of encoding frames of a speech signal according to another configuration includes producing a first encoded frame that is based on a first frame of the speech signal and has a length of q bits, q being a nonzero positive integer. This method also includes producing a second encoded frame that is based on a second frame of the speech signal and has a length of r bits, r being a nonzero positive integer less than q. In this method, the first and second frames are inactive frames. In this method, the first encoded frame includes (A) a description of a spectral envelope, over a first frequency band, of a portion of the speech signal that includes the first frame and (B) a description of a spectral envelope, over a second frequency band different than the first frequency band, of a portion of the speech signal that includes the first frame, and the second encoded frame (A) includes a description of a spectral envelope, over the first frequency band, of a portion of the speech signal that includes the second frame and (B) does not include a description of a spectral envelope over the second frequency band. Means for performing such operations are also expressly contemplated and disclosed herein. A computer program product including a computer-readable medium, in which the medium includes code for causing at least one computer to perform such operations, is also expressly contemplated and disclosed herein. An apparatus including a speech activity detector, a coding scheme selector, and a speech encoder that are configured to perform such operations is also expressly contemplated and disclosed herein.

An apparatus for encoding frames of a speech signal according to another configuration includes means for producing, based on a first frame of the speech signal, a first encoded frame that has a length of p bits, p being a nonzero positive integer; means for producing, based on a second frame of the speech signal, a second encoded frame that has a length of q bits, q being a nonzero positive integer different than p; and means for producing, based on a third frame of the speech signal, a third encoded frame that has a length of r bits, r being a nonzero positive integer less than q. In this apparatus, the second frame is an inactive frame that follows the first frame in the speech signal, the third frame is an inactive frame that follows the second frame in the speech signal, and all of the frames of the speech signal between the first and third frames are inactive.

A computer program product according to another configuration includes a computer-readable medium. The medium includes code for causing at least one computer to produce a first encoded frame that is based on a first frame of the speech signal and has a length of p bits, p being a nonzero positive integer; code for causing at least one computer to produce a second encoded frame that is based on a second frame of the speech signal and has a length of q bits, q being a nonzero positive integer different than p; and code for causing at least one computer to produce a third encoded frame that is based on a third frame of the speech signal and has a length of r bits, r being a nonzero positive integer less than q. In this product, the second frame is an inactive frame that follows the first frame in the speech signal, the third frame is an inactive frame that follows the second frame in the speech signal, and all of the frames of the speech signal between the first and third frames are inactive.

An apparatus for encoding frames of a speech signal according to another configuration includes a speech activity detector configured to indicate, for each of a plurality of frames of the speech signal, whether the frame is active or inactive; a coding scheme selector; and a speech encoder. The coding scheme selector is configured to select (A) in response to an indication of the speech activity detector for a first frame of the speech signal, a first coding scheme; (B) for a second frame that is one of a consecutive series of inactive frames that follows the first frame in the speech signal, and in response to an indication of the speech activity detector that the second frame is inactive, a second coding scheme; and (C) for a third frame that follows the second frame in the speech signal and is another one of the consecutive series of inactive frames that follows the first frame in the speech signal, and in response to an indication of the speech activity detector that the third frame is inactive, a third coding scheme. The speech encoder is configured to produce (D) according to the first coding scheme, a first encoded frame that is based on the first frame and has a length of p bits, p being a nonzero positive integer; (E) according to the second coding scheme, a second encoded frame that is based on the second frame and has a length of q bits, q being a nonzero positive integer different than p; and (F) according to the third coding scheme, a third encoded frame that is based on the third frame and has a length of r bits, r being a nonzero positive integer less than q.

A method of processing an encoded speech signal according to a configuration includes, based on information from a first encoded frame of the encoded speech signal, obtaining a description of a spectral envelope of a first frame of a speech signal over (A) a first frequency band and (B) a second frequency band different than the first frequency band. This method also includes, based on information from a second frame of the encoded speech signal, obtaining a description of a spectral envelope of a second frame of the speech signal over the first frequency band. This method also includes, based on information from the first encoded frame, obtaining a description of a spectral envelope of the second frame over the second frequency band.

An apparatus for processing an encoded speech signal according to another configuration includes means for obtaining, based on information from a first encoded frame of the encoded speech signal, a description of a spectral envelope of a first frame of a speech signal over (A) a first frequency band and (B) a second frequency band different than the first frequency band. This apparatus also includes means for obtaining, based on information from a second encoded frame of the encoded speech signal, a description of a spectral envelope of a second frame of the speech signal over the first frequency band. This apparatus also includes means for obtaining, based on information from the first encoded frame, a description of a spectral envelope of the second frame over the second frequency band.

A computer program product according to another configuration includes a computer-readable medium. The medium includes code for causing at least one computer to obtain, based on information from a first encoded frame of the encoded speech signal, a description of a spectral envelope of a first frame of a speech signal over (A) a first frequency band and (B) a second frequency band different than the first frequency band. This medium also includes code for causing at least one computer to obtain, based on information from a second encoded frame of the encoded speech signal, a description of a spectral envelope of a second frame of the speech signal over the first frequency band. This medium also includes code for causing at least one computer to obtain, based on information from the first encoded frame, a description of a spectral envelope of the second frame over the second frequency band.

An apparatus for processing an encoded speech signal according to another configuration includes control logic configured to generate a control signal comprising a sequence of values that is based on coding indices of encoded frames of the encoded speech signal, each value of the sequence corresponding to an encoded frame of the encoded speech signal. This apparatus also includes a speech decoder configured to calculate, in response to a value of the control signal having a first state, a decoded frame based on a description of a spectral envelope over the first and second frequency bands, the description being based on information from the corresponding encoded frame. The speech decoder is also configured to calculate, in response to a value of the control signal having a second state different than the first state, a decoded frame based on (1) a description of a spectral envelope over the first frequency band, the description being based on information from the corresponding encoded frame, and (2) a description of a spectral envelope over the second frequency band, the description being based on information from at least one encoded frame that occurs in the encoded speech signal before the corresponding encoded frame.

BRIEF DESCRIPTION OF THE DRAWINGS

FIG. 18A is a table that shows one set of three different coding schemes that a speech encoder may use to produce a result as shown in FIG. 17B.

Figure 1:
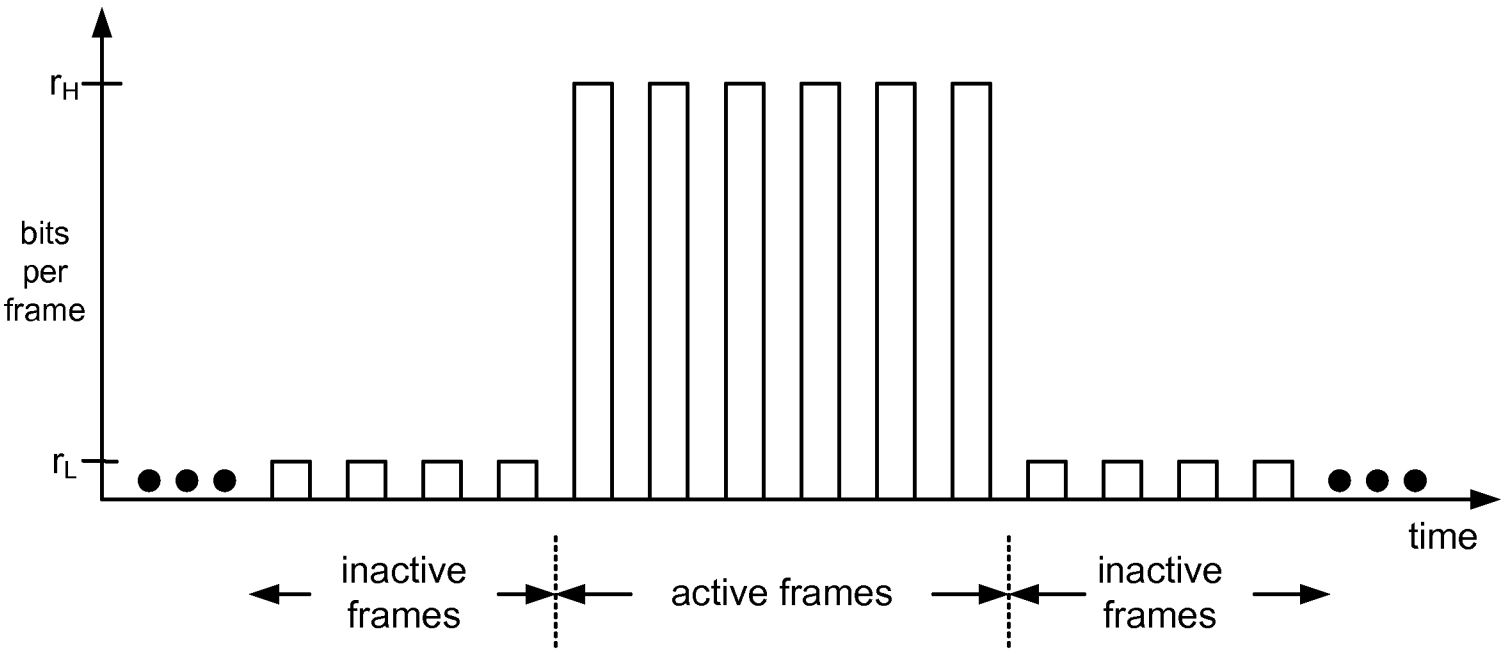
FIG. 1 illustrates a result of encoding a region of a speech signal that includes transitions between active frames and inactive frames.

In the figures and accompanying description, the same reference labels refer to the same or analogous elements or signals.

DETAILED DESCRIPTION

Configurations described herein may be applied in a wideband speech coding system to support use of a lower bit rate for inactive frames than for active frames and/or to improve a perceptual quality of a transferred speech signal. It is expressly contemplated and hereby disclosed that such configurations may be adapted for use in networks that are packet-switched (for example, wired and/or wireless networks arranged to carry voice transmissions according to protocols such as VoIP) and/or circuit-switched.

Unless expressly limited by its context, the term "calculating" is used herein to indicate any of its ordinary meanings, such as computing, evaluating, generating, and/or selecting from a set of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "A is based on B" is used to indicate any of its ordinary meanings, including the cases (i) "A is based on at least B" and (ii) "A is equal to B" (if appropriate in the particular context).

Unless indicated otherwise, any disclosure of a speech encoder having a particular feature is also expressly intended to disclose a method of speech encoding having an analogous feature (and vice versa), and any disclosure of a speech encoder according to a particular configuration is also expressly intended to disclose a method of speech encoding according to an analogous configuration (and vice versa). Unless indicated otherwise, any disclosure of a speech decoder having a particular feature is also expressly intended to disclose a method of speech decoding having an analogous feature (and vice versa), and any disclosure of a speech decoder according to a particular configuration is also expressly intended to disclose a method of speech decoding according to an analogous configuration (and vice versa).

The frames of a speech signal are typically short enough that the spectral envelope of the signal may be expected to remain relatively stationary over the frame. One typical frame length is twenty milliseconds, although any frame length deemed suitable for the particular application may be used. A frame length of twenty milliseconds corresponds to 140 samples at a sampling rate of seven kilohertz (kHz), 160 samples at a sampling rate of eight kHz, and 320 samples at a sampling rate of 16 kHz, although any sampling rate deemed suitable for the particular application may be used. Another example of a sampling rate that may be used for speech coding is 12.8 kHz, and further examples include other rates in the range of from 12.8 kHz to 38.4 kHz.

Typically all frames have the same length, and a uniform frame length is assumed in the particular examples described herein. However, it is also expressly contemplated and hereby disclosed that nonuniform frame lengths may be used. For example, implementations of methods M100 and M200 may also be used in applications that employ different frame lengths for active and inactive frames and/or for voiced and unvoiced frames.

In some applications, the frames are nonoverlapping, while in other applications, an overlapping frame scheme is used. For example, it is common for a speech coder to use an overlapping frame scheme at the encoder and a nonoverlapping frame scheme at the decoder. It is also possible for an encoder to use different frame schemes for different tasks. For example, a speech encoder or method of speech encoding may use one overlapping frame scheme for encoding a description of a spectral envelope of a frame and a different overlapping frame scheme for encoding a description of temporal information of the frame.

As noted above, it may be desirable to configure a speech encoder to use different coding modes and/or rates to encode active frames and inactive frames. In order to distinguish active frames from inactive frames, a speech encoder typically includes a speech activity detector or otherwise performs a method of detecting speech activity. Such a detector or method may be configured to classify a frame as active or inactive based on one or more factors such as frame energy, signal-to-noise ratio, periodicity, and zero-crossing rate. Such classification may include comparing a value or magnitude of such a factor to a threshold value and/or comparing the magnitude of a change in such a factor to a threshold value.

A speech activity detector or method of detecting speech activity may also be configured to classify an active frame as one of two or more different types, such as voiced (e.g., representing a vowel sound), unvoiced (e.g., representing a fricative sound), or transitional (e.g., representing the beginning or end of a word). It may be desirable for a speech encoder to use different bit rates to encode different types of active frames. Although the particular example of FIG. 1 shows a series of active frames all encoded at the same bit rate, one of skill in the art will appreciate that the methods and apparatus described herein may also be used in speech encoders and methods of speech encoding that are configured to encode active frames at different bit rates.

Figure 2:
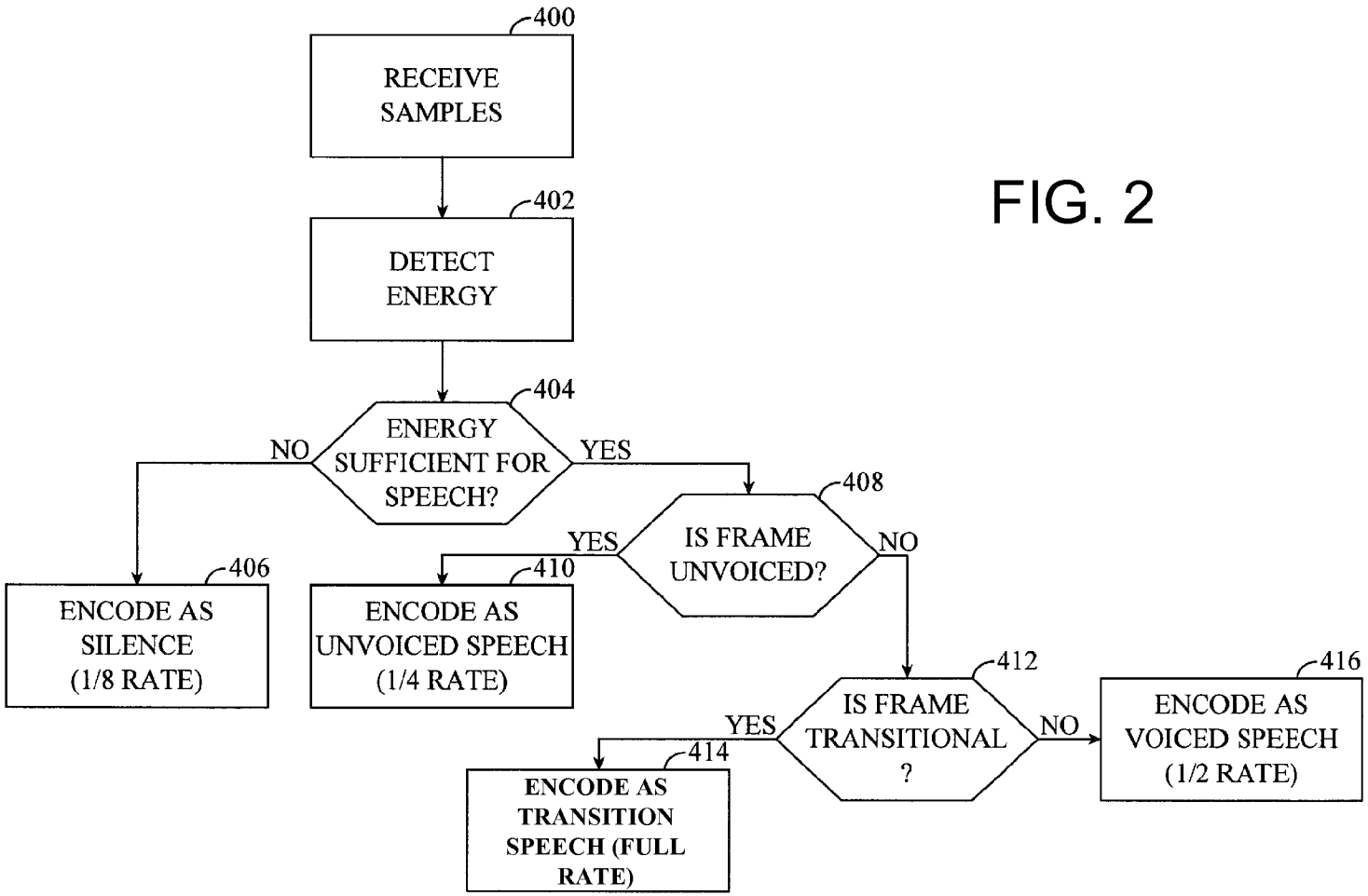
FIG. 2 shows one example of a decision tree that a speech encoder or method of speech encoding may use to select a bit rate.

FIG. 2 shows one example of a decision tree that a speech encoder or method of speech encoding may use to select a bit rate at which to encode a particular frame according to the type of speech the frame contains. In other cases, the bit rate selected for a particular frame may also depend on such criteria as a desired average bit rate, a desired pattern of bit rates over a series of frames (which may be used to support a desired average bit rate), and/or the bit rate selected for a previous frame.

It may be desirable to use different coding modes to encode different types of speech frames. Frames of voiced speech tend to have a periodic structure that is long-term (i.e., that continues for more than one frame period) and is related to pitch, and it is typically more efficient to encode a voiced frame (or a sequence of voiced frames) using a coding mode that encodes a description of this long-term spectral feature. Examples of such coding modes include code-excited linear prediction (CELP) and prototype pitch period (PPP). Unvoiced frames and inactive frames, on the other hand, usually lack any significant long-term spectral feature, and a speech encoder may be configured to encode these frames using a coding mode that does not attempt to describe such a feature. Noise-excited linear prediction (NELP) is one example of such a coding mode.

A speech encoder or method of speech encoding may be configured to select among different combinations of bit rates and coding modes (also called "coding schemes"). For example, a speech encoder configured to perform an implementation of method M100 may use a full-rate CELP scheme for frames containing voiced speech and transitional frames, a half-rate NELP scheme for frames containing unvoiced speech, and an eighth-rate NELP scheme for inactive frames. Other examples of such a speech encoder support multiple coding rates for one or more coding schemes, such as full-rate and half-rate CELP schemes and/or full-rate and quarter-rate PPP schemes.

A transition from active speech to inactive speech typically occurs over a period of several frames. As a consequence, the first several frames of a speech signal after a transition from active frames to inactive frames may include remnants of active speech, such as voicing remnants. If a speech encoder encodes a frame having such remnants using a coding scheme that is intended for inactive frames, the encoded result may not accurately represent the original frame. Thus it may be desirable to continue a higher bit rate and/or an active coding mode for one or more of the frames that follow a transition from active frames to inactive frames.

Figure 3:
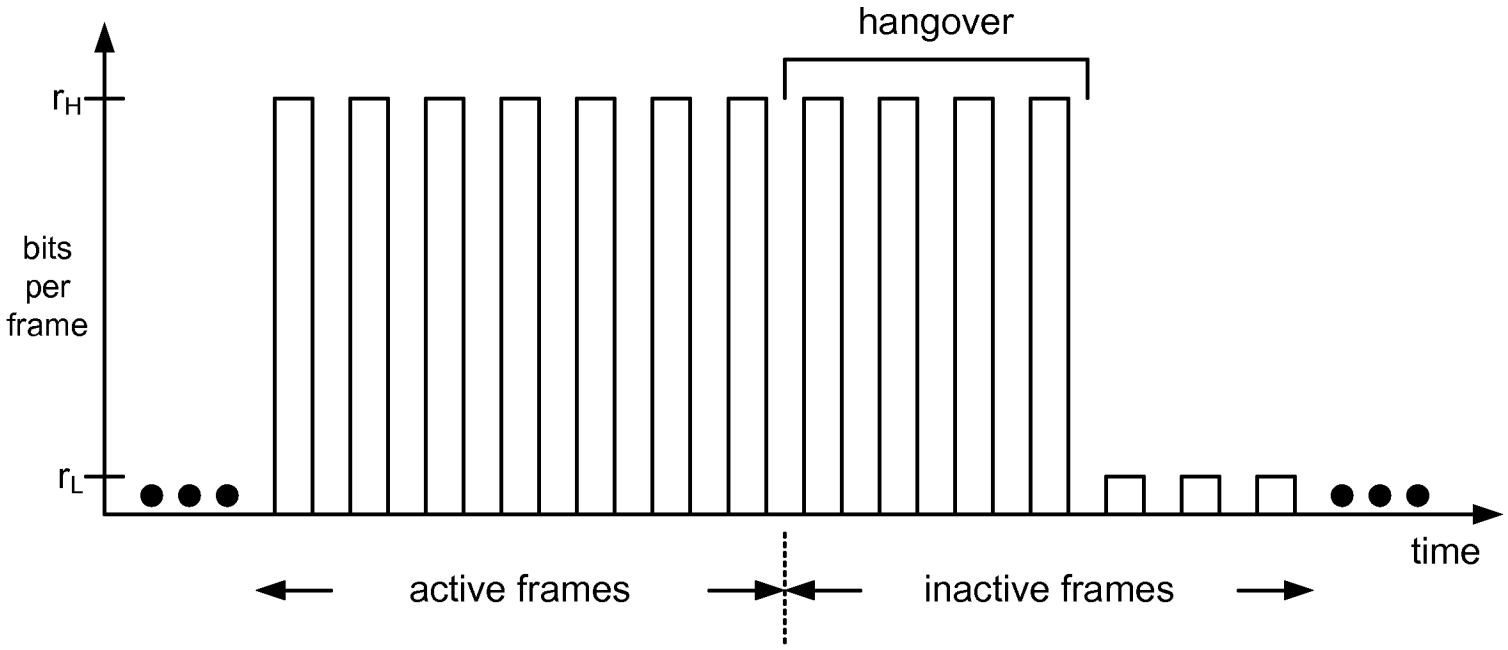
FIG. 3 illustrates a result of encoding a region of a speech signal that includes a hangover of four frames.

FIG. 3 illustrates a result of encoding a region of a speech signal in which the higher bit rate rH is continued for several frames after a transition from active frames to inactive frames. The length of this continuation (also called a "hangover") may be selected according to an expected length of the transition and may be fixed or variable. For example, the length of the hangover may be based on one or more characteristics, such as signal-to-noise ratio, of one or more of the active frames preceding the transition. FIG. 3 illustrates a hangover of four frames.

An encoded frame typically contains a set of speech parameters from which a corresponding frame of the speech signal may be reconstructed. This set of speech parameters typically includes spectral information, such as a description of the distribution of energy within the frame over a frequency spectrum. Such a distribution of energy is also called a "frequency envelope" or "spectral envelope" of the frame. A speech encoder is typically configured to calculate a description of a spectral envelope of a frame as an ordered sequence of values. In some cases, the speech encoder is configured to calculate the ordered sequence such that each value indicates an amplitude or magnitude of the signal at a corresponding frequency or over a corresponding spectral region. One example of such a description is an ordered sequence of Fourier transform coefficients.

In other cases, the speech encoder is configured to calculate the description of a spectral envelope as an ordered sequence of values of parameters of a coding model, such as a set of values of coefficients of a linear prediction coding (LPC) analysis. An ordered sequence of LPC coefficient values is typically arranged as one or more vectors, and the speech encoder may be implemented to calculate these values as filter coefficients or as reflection coefficients. The number of coefficient values in the set is also called the "order" of the LPC analysis, and examples of a typical order of an LPC analysis as performed by a speech encoder of a communications device (such as a cellular telephone) include four, six, eight, ten, 12, 16, 20, 24, 28, and 32.

A speech coder is typically configured to transmit the description of a spectral envelope across a transmission channel in quantized form (e.g., as one or more indices into corresponding lookup tables or "codebooks"). Accordingly, it may be desirable for a speech encoder to calculate a set of LPC coefficient values in a form that may be quantized efficiently, such as a set of values of line spectral pairs (LSPs), line spectral frequencies (LSFs), immittance spectral pairs (ISPs), immittance spectral frequencies (ISFs), cepstral coefficients, or log area ratios. A speech encoder may also be configured to perform other operations, such as perceptual weighting, on the ordered sequence of values before conversion and/or quantization.

In some cases, a description of a spectral envelope of a frame also includes a description of temporal information of the frame (e.g., as in an ordered sequence of Fourier transform coefficients). In other cases, the set of speech parameters of an encoded frame may also include a description of temporal information of the frame. The form of the description of temporal information may depend on the particular coding mode used to encode the frame. For some coding modes (e.g., for a CELP coding mode), the description of temporal information may include a description of an excitation signal to be used by a speech decoder to excite an LPC model (e.g., as defined by the description of the spectral envelope). A description of an excitation signal typically appears in an encoded frame in quantized form (e.g., as one or more indices into corresponding codebooks). The description of temporal information may also include information relating to a pitch component of the excitation signal. For a PPP coding mode, for example, the encoded temporal information may include a description of a prototype to be used by a speech decoder to reproduce a pitch component of the excitation signal. A description of information relating to a pitch component typically appears in an encoded frame in quantized form (e.g., as one or more indices into corresponding codebooks).

For other coding modes (e.g., for a NELP coding mode), the description of temporal information may include a description of a temporal envelope of the frame (also called an "energy envelope" or "gain envelope" of the frame). A description of a temporal envelope may include a value that is based on an average energy of the frame. Such a value is typically presented as a gain value to be applied to the frame during decoding and is also called a "gain frame." In some cases, the gain frame is a normalization factor based on a ratio between (A) the energy of the original frame $E_{orig}$ and (B) the energy of a frame synthesized from other parameters of the encoded frame (e.g., including the description of a spectral envelope) $E_{synth}$. For example, a gain frame may be expressed as $E_{orig}/E_{synth}$ or as the square root of $E_{orig}/E_{synth}$. Gain frames and other aspects of temporal envelopes are described in more detail in, for example, U.S. Pat. Appl. Pub. 2006/0282262 (Vos et al.), "SYSTEMS, METHODS, AND APPARATUS FOR GAIN FACTOR ATTENUATION," published Dec. 14, 2006.

Alternatively or additionally, a description of a temporal envelope may include relative energy values for each of a number of subframes of the frame. Such values are typically presented as gain values to be applied to the respective subframes during decoding and are collectively called a "gain profile" or "gain shape." In some cases, the gain shape values are normalization factors, each based on a ratio between (A) the energy of the original subframe i $E_{orig.i}$ and (B) the energy of the corresponding subframe i of a frame synthesized from other parameters of the encoded frame (e.g., including the description of a spectral envelope) $E_{synth.i}$. In such cases, the energy $E_{synth.i}$ may be used to normalize the energy $E_{orig.i}$. For example, a gain shape value may be expressed as $E_{orig.i}/E_{synth.i}$ or as the square root of $E_{orig.i}/E_{synth.i}$. One example of a description of a temporal envelope includes a gain frame and a gain shape, where the gain shape includes a value for each of five four-millisecond subframes of a twenty-millisecond frame. Gain values may be expressed on a linear scale or on a logarithmic (e.g., decibel) scale. Such features are described in more detail in, for example, U.S. Pat. Appl. Pub. 2006/0282262 cited above.

Figure 4A:
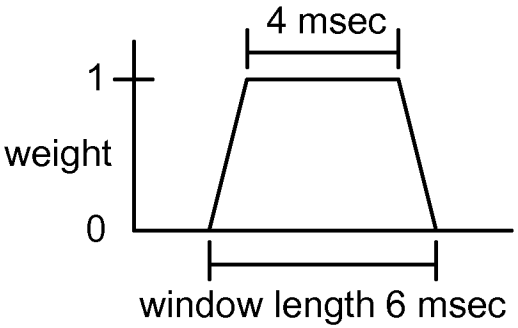
FIG. 4A shows a plot of a trapezoidal windowing function that may be used to calculate gain shape values.
Figure 4B:
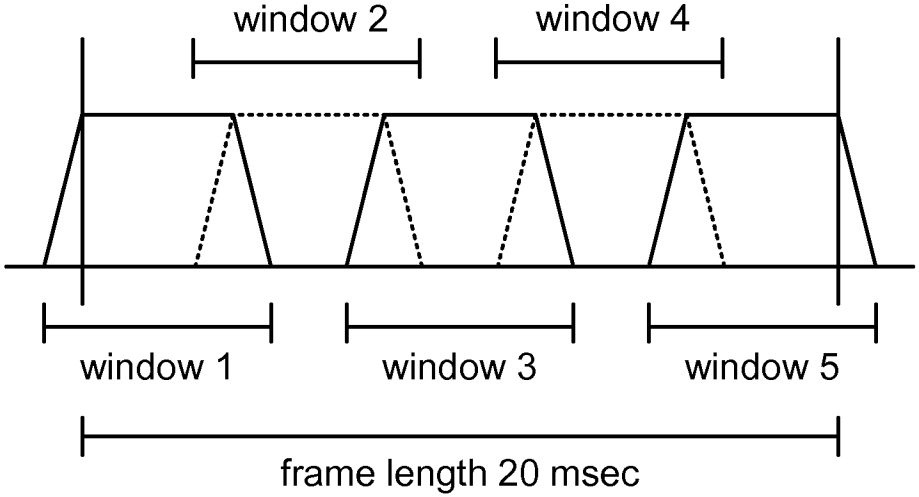
FIG. 4B shows an application of the windowing function of FIG. 4A to each of five subframes of a frame.

In calculating the value of a gain frame (or values of a gain shape), it may be desirable to apply a windowing function that overlaps adjacent frames (or subframes). Gain values produced in this manner are typically applied in an overlap-add manner at the speech decoder, which may help to reduce or avoid discontinuities between frames or subframes. FIG. 4A shows a plot of a trapezoidal windowing function that may be used to calculate each of the gain shape values. In this example, the window overlaps each of the two adjacent subframes by one millisecond. FIG. 4B shows an application of this windowing function to each of the five subframes of a twenty-millisecond frame. Other examples of windowing functions include functions having different overlap periods and/or different window shapes (e.g., rectangular or Hamming) which may be symmetrical or asymmetrical. It is also possible to calculate values of a gain shape by applying different windowing functions to different subframes and/or by calculating different values of the gain shape over subframes of different lengths.

An encoded frame that includes a description of a temporal envelope typically includes such a description in quantized form as one or more indices into corresponding codebooks, although in some cases an algorithm may be used to quantize and/or dequantize the gain frame and/or gain shape without using a codebook. One example of a description of a temporal envelope includes a quantized index of eight to twelve bits that specifies five gain shape values for the frame (e.g., one for each of five consecutive subframes). Such a description may also include another quantized index that specifies a gain frame value for the frame.

As noted above, it may be desirable to transmit and receive a speech signal having a frequency range that exceeds the PSTN frequency range of 300-3400 kHz. One approach to coding such a signal is to encode the entire extended frequency range as a single frequency band. Such an approach may be implemented by scaling a narrowband speech coding technique (e.g., one configured to encode a PSTN-quality frequency range such as 0-4 kHz or 300-3400 Hz) to cover a wideband frequency range such as 0-8 kHz. For example, such an approach may include (A) sampling the speech signal at a higher rate to include components at high frequencies and (B) reconfiguring a narrowband coding technique to represent this wideband signal to a desired degree of accuracy. One such method of reconfiguring a narrowband coding technique is to use a higher-order LPC analysis (i.e., to produce a coefficient vector having more values). A wideband speech coder that encodes a wideband signal as a single frequency band is also called a "full-band" coder.

It may be desirable to implement a wideband speech coder such that at least a narrowband portion of the encoded signal may be sent through a narrowband channel (such as a PSTN channel) without the need to transcode or otherwise significantly modify the encoded signal. Such a feature may facilitate backward compatibility with networks and/or apparatus that only recognize narrowband signals. It may be also desirable to implement a wideband speech coder that uses different coding modes and/or rates for different frequency bands of the speech signal. Such a feature may be used to support increased coding efficiency and/or perceptual quality. A wideband speech coder that is configured to produce encoded frames having portions that represent different frequency bands of the wideband speech signal (e.g., separate sets of speech parameters, each set representing a different frequency band of the wideband speech signal) is also called a "split-band" coder.

Figure 5B:
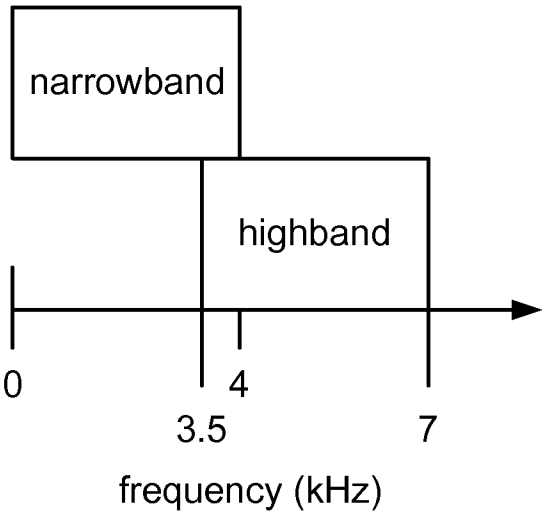
FIG. 5B shows one example of an overlapping frequency band scheme that may be used by a split-band encoder to encode wideband speech content.
Figure 5A:
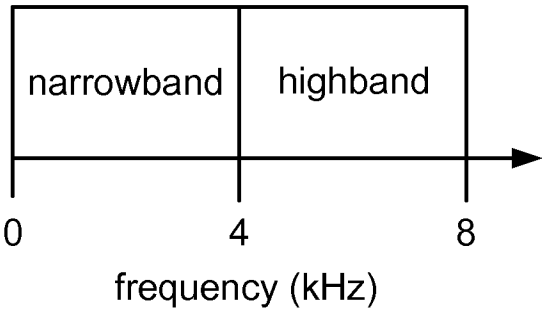
FIG. 5A shows one example of a nonoverlapping frequency band scheme that may be used by a split-band encoder to encode wideband speech content.

FIG. 5A shows one example of a nonoverlapping frequency band scheme that may be used by a split-band encoder to encode wideband speech content across a range of from 0 Hz to 8 kHz. This scheme includes a first frequency band that extends from 0 Hz to 4 kHz (also called a narrowband range) and a second frequency band that extends from 4 to 8 kHz (also called an extended, upper, or highband range). FIG. 5B shows one example of an overlapping frequency band scheme that may be used by a split-band encoder to encode wideband speech content across a range of from 0 Hz to 7 kHz. This scheme includes a first frequency band that extends from 0 Hz to 4 kHz (the narrowband range) and a second frequency band that extends from 3.5 to 7 kHz (the extended, upper, or highband range).

One particular example of a split-band encoder is configured to perform a tenth-order LPC analysis for the narrowband range and a sixth-order LPC analysis for the highband range. Other examples of frequency band schemes include those in which the narrowband range only extends down to about 300 Hz. Such a scheme may also include another frequency band that covers a lowband range from about 0 or 50 Hz up to about 300 or 350 Hz.

It may be desirable to reduce the average bit rate used to encode a wideband speech signal. For example, reducing the average bit rate needed to support a particular service may allow an increase in the number of users that a network can service at one time. However, it is also desirable to accomplish such a reduction without excessively degrading the perceptual quality of the corresponding decoded speech signal.

Figure 6A:
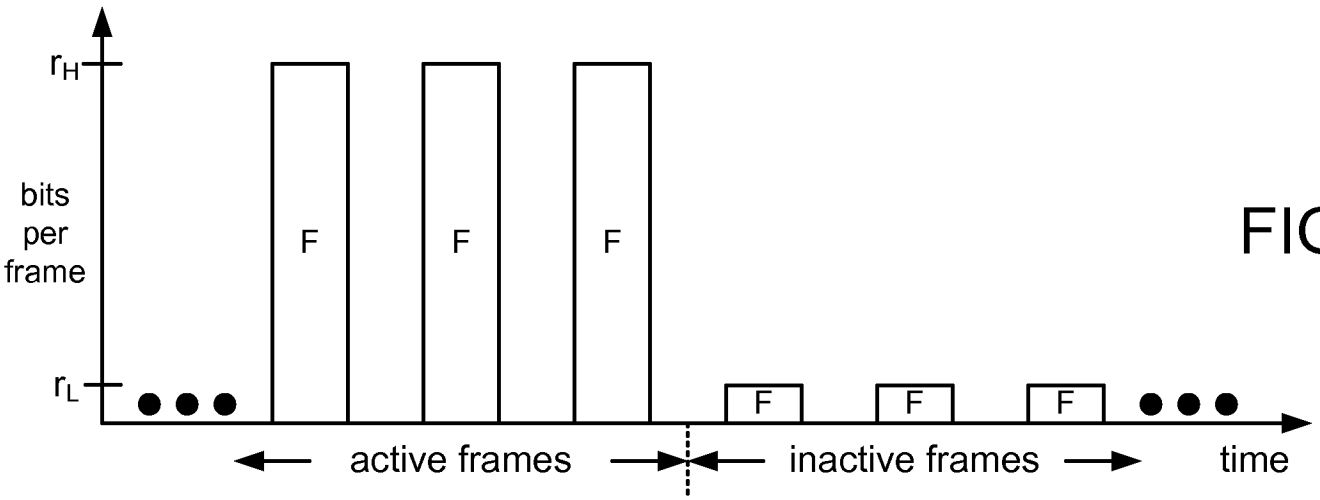
FIGS. 6A, 6B, 7A, 7B, 8A, and 8B illustrate results of encoding a transition from active frames to inactive frames in a speech signal using several different approaches.

One possible approach to reducing the average bit rate of a wideband speech signal is to encode the inactive frames using a full-band wideband coding scheme at a low bit rate. FIG. 6A illustrates a result of encoding a transition from active frames to inactive frames in which the active frames are encoded at a higher bit rate rH and the inactive frames are encoded at a lower bit rate rL. The label F indicates a frame encoded using a full-band wideband coding scheme.

To achieve a sufficient reduction in average bit rate, it may be desirable to encode the inactive frames using a very low bit rate. For example, it may be desirable to use a bit rate that is comparable to a rate used to encode inactive frames in a narrowband coder, such as sixteen bits per frame ("eighth rate"). Unfortunately, such a small number of bits is typically insufficient to encode even an inactive frame of a wideband signal to an acceptable degree of perceptual quality across the wideband range, and a full-band wideband coder that encodes inactive frames at such a rate is likely to produce a decoded signal having poor sound quality during the inactive frames. Such a signal may lack smoothness during the inactive frames, for example, in that the perceived loudness and/or spectral distribution of the decoded signal may change excessively from one frame to the next. Smoothness is typically perceptually important for decoded background noise.

Figure 6B:
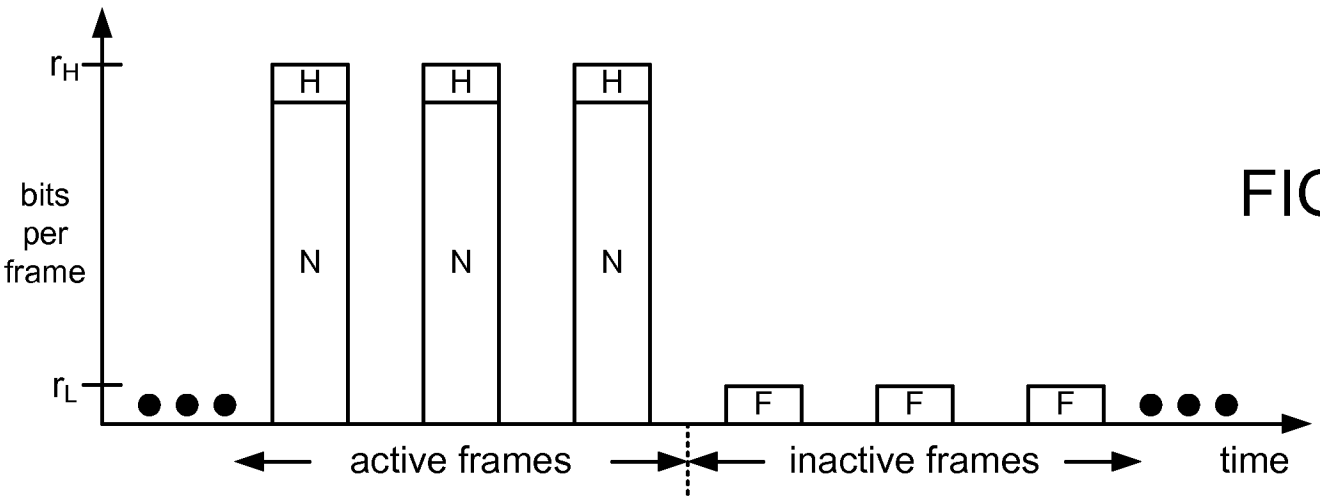

FIG. 6B illustrates another result of encoding a transition from active frames to inactive frames. In this case, a split-band wideband coding scheme is used to encode the active frames at the higher bit rate and a full-band wideband coding scheme is used to encode the inactive frames at the lower bit rate. The labels H and N indicate portions of a split-band-encoded frame that are encoded using a highband coding scheme and a narrowband coding scheme, respectively. As noted above, encoding inactive frames using a full-band wideband coding scheme and a low bit rate is likely to produce a decoded signal having poor sound quality during the inactive frames. Mixing split-band and full-band coding schemes is also likely to increase coder complexity, although such complexity may or may not impact the practicality of the resulting implementation. Additionally, while historical information from past frames is sometimes used to significantly increase coding efficiency (especially for coding voiced frames), it may not be feasible to apply historical information generated by a split-band coding scheme during operation of a full-band coding scheme, and vice versa.

Figure 7A:
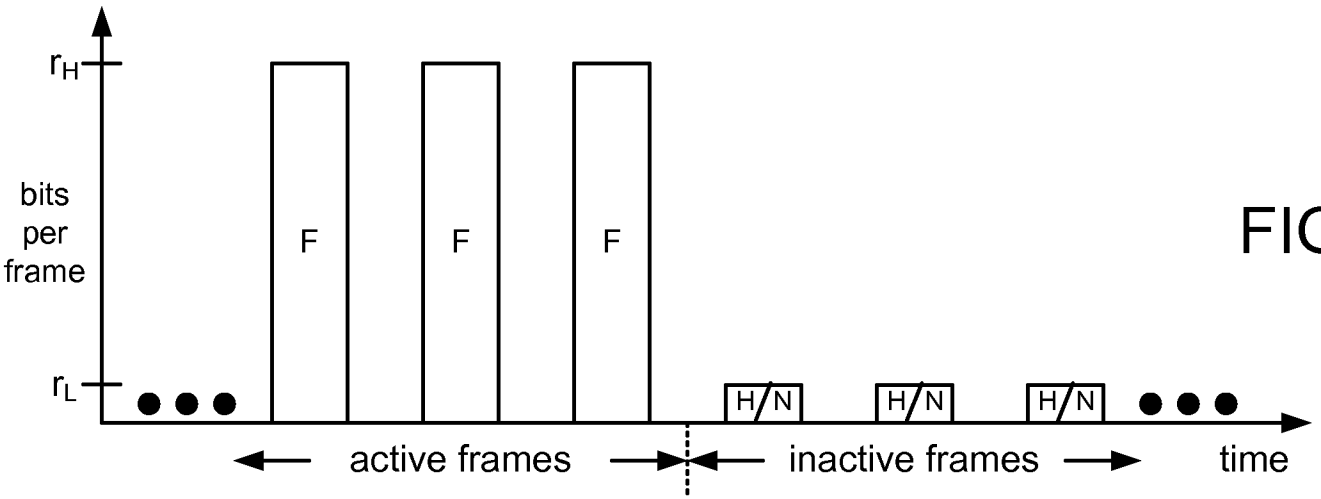
Figure 7B:
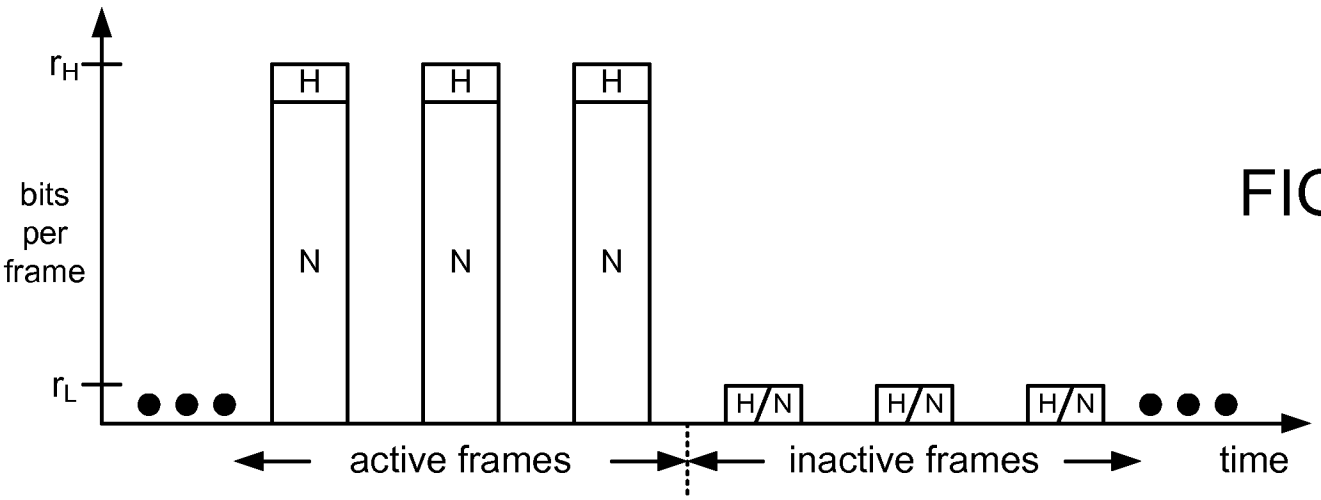

Another possible approach to reducing the average bit rate of a wideband signal is to encode the inactive frames using a split-band wideband coding scheme at a low bit rate. FIG. 7A illustrates a result of encoding a transition from active frames to inactive frames in which a full-band wideband coding scheme is used to encode the active frames at a higher bit rate rH and a split-band wideband coding scheme is used to encode the inactive frames at a lower bit rate rL. FIG. 7B illustrates a related example in which a split-band wideband coding scheme is used to encode the active frames. As mentioned above with reference to FIGS. 6A and 6B, it may be desirable to encode the inactive frames using a bit rate that is comparable to a bit rate used to encode inactive frames in a narrowband coder, such as sixteen bits per frame ("eighth rate"). Unfortunately, such a small number of bits is typically insufficient for a split-band coding scheme to apportion among the different frequency bands such that a decoded wideband signal of acceptable quality may be achieved.

Figure 8A:
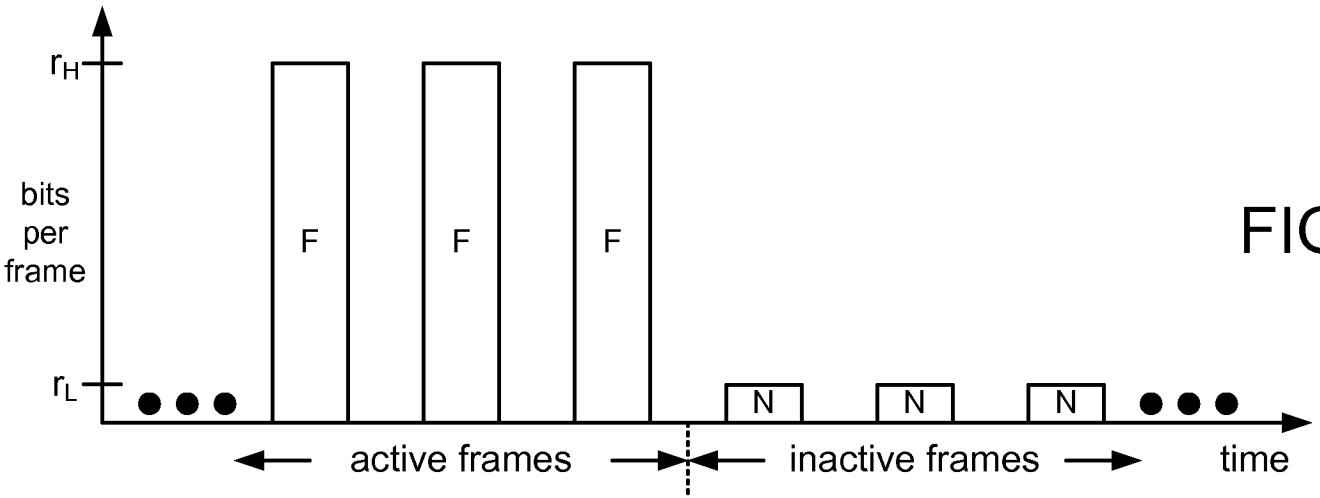
Figure 8B:
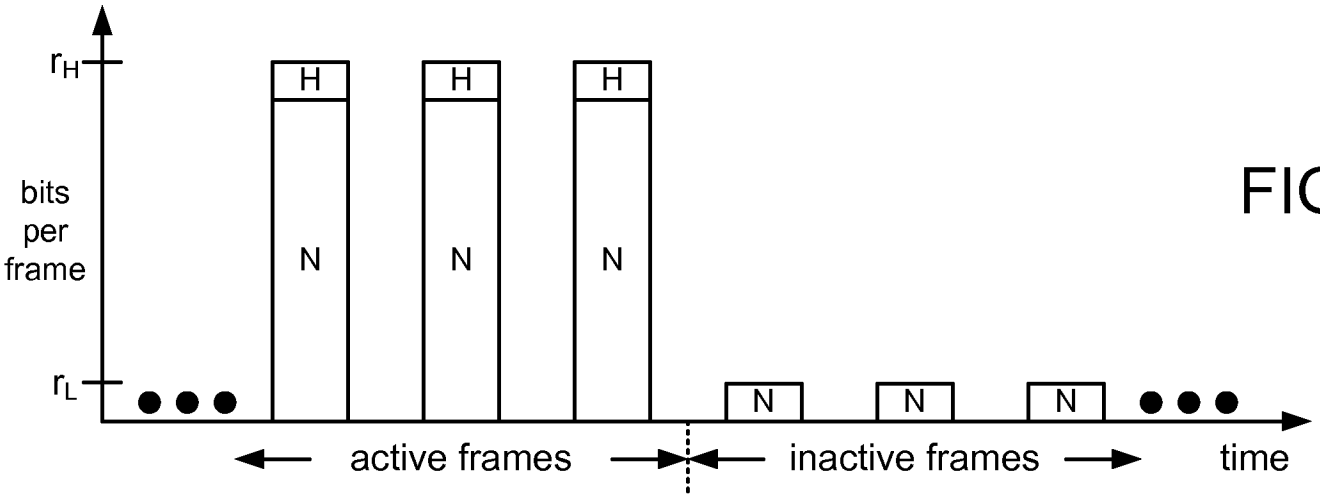

A further possible approach to reducing the average bit rate of a wideband signal is to encode the inactive frames as narrowband at a low bit rate. FIGS. 8A and 8B illustrate results of encoding a transition from active frames to inactive frames in which a wideband coding scheme is used to encode the active frames at a higher bit rate rH and a narrowband coding scheme is used to encode the inactive frames at a lower bit rate rL. In the example of FIG. 8A, a full-band wideband coding scheme is used to encode the active frames, while in the example of FIG. 8B, a split-band wideband coding scheme is used to encode the active frames.

Encoding an active frame using a high-bit-rate wideband coding scheme typically produces an encoded frame that contains well-coded wideband background noise. Encoding an inactive frame using only a narrowband coding scheme, however, as in the examples of FIGS. 8A and 8B, produces an encoded frame that lacks the extended frequencies. Consequently, a transition from a decoded wideband active frame to a decoded narrowband inactive frame is likely to be quite audible and unpleasant, and this third possible approach is also likely to produce a suboptimal result.

Figure 9:
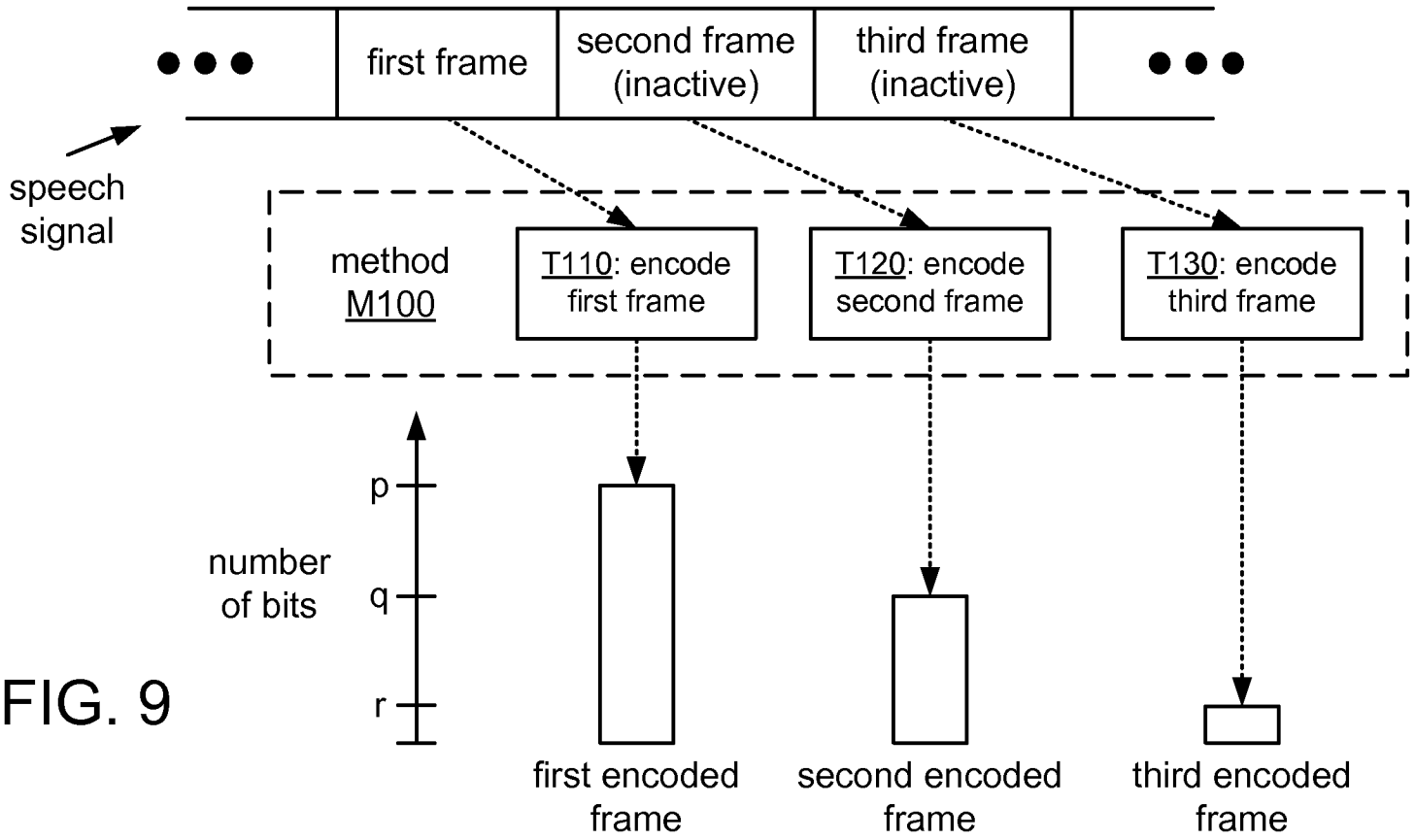
FIG. 9 illustrates an operation of encoding three successive frames of a speech signal using a method M100 according to a general configuration.

FIG. 9 illustrates an operation of encoding three successive frames of a speech signal using a method M100 according to a general configuration. Task T110 encodes the first of the three frames, which may be active or inactive, at a first bit rate r1 (p bits per frame). Task T120 encodes the second frame, which follows the first frame and is an inactive frame, at a second bit rate r2 (q bits per frame) that is different than r1. Task T130 encodes the third frame, which immediately follows the second frame and is also inactive, at a third bit rate r3 (r bits per frame) that is less than r2. Method M100 is typically performed as part of a larger method of speech encoding, and speech encoders and methods of speech encoding that are configured to perform method M100 are expressly contemplated and hereby disclosed.

A corresponding speech decoder may be configured to use information from the second encoded frame to supplement the decoding of an inactive frame from the third encoded frame. Elsewhere in this description, speech decoders and methods of decoding frames of a speech signal are disclosed that use information from the second encoded frame in decoding one or more subsequent inactive frames.

In the particular example shown in FIG. 9, the second frame immediately follows the first frame in the speech signal, and the third frame immediately follows the second frame in the speech signal. In other applications of method M100, the first and second frames may be separated by one or more inactive frames in the speech signal, and the second and third frames may be separated by one or more inactive frames in the speech signal. In the particular example shown in FIG. 9, p is greater than q. Method M100 may also be implemented such that p is less than q. In the particular examples shown in FIGS. 10A to 12B, the bit rates rH, rM, and rL correspond to bit rates r1, r2, and r3, respectively.

Figure 10A:
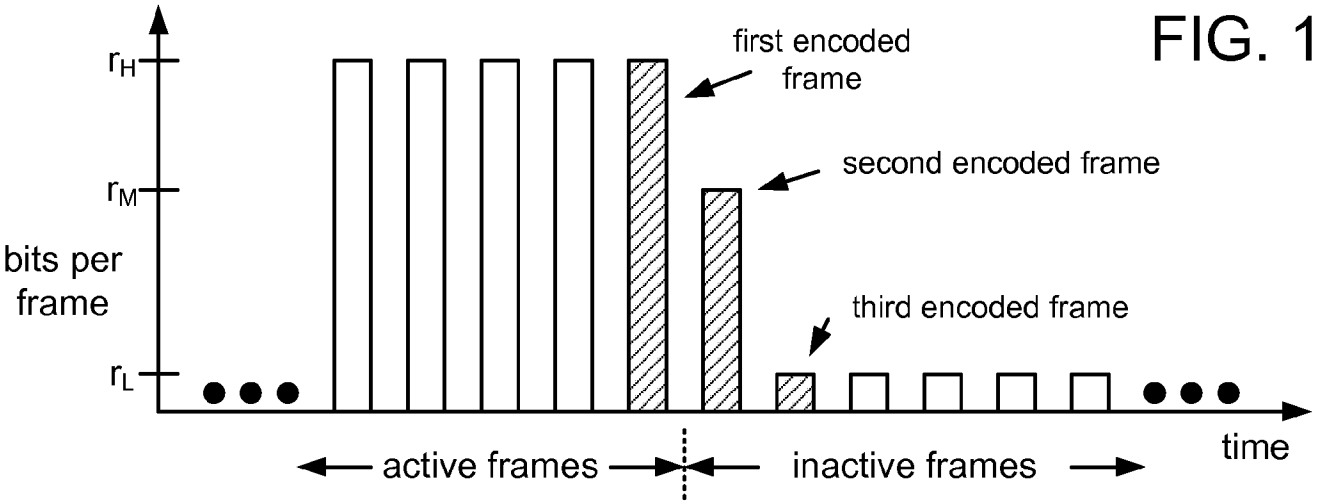
FIGS. 10A, 10B, 11A, 11B, 12A, and 12B illustrate results of encoding transitions from active frames to inactive frames using different implementations of method M100.

FIG. 10A illustrates a result of encoding a transition from active frames to inactive frames using an implementation of method M100 as described above. In this example, the last active frame before the transition is encoded at a higher bit rate rH to produce the first of the three encoded frames, the first inactive frame after the transition is encoded at an intermediate bit rate rM to produce the second of the three encoded frames, and the next inactive frame is encoded at a lower bit rate rL to produce the last of the three encoded frames. In one particular case of this example, the bit rates rH, rM, and rL are full rate, half rate, and eighth rate, respectively.

As noted above, a transition from active speech to inactive speech typically occurs over a period of several frames, and the first several frames after a transition from active frames to inactive frames may include remnants of active speech, such as voicing remnants. If a speech encoder encodes a frame having such remnants using a coding scheme that is intended for inactive frames, the encoded result may not accurately represent the original frame. Thus it may be desirable to implement method M100 to avoid encoding a frame having such remnants as the second encoded frame.

Figure 10B:
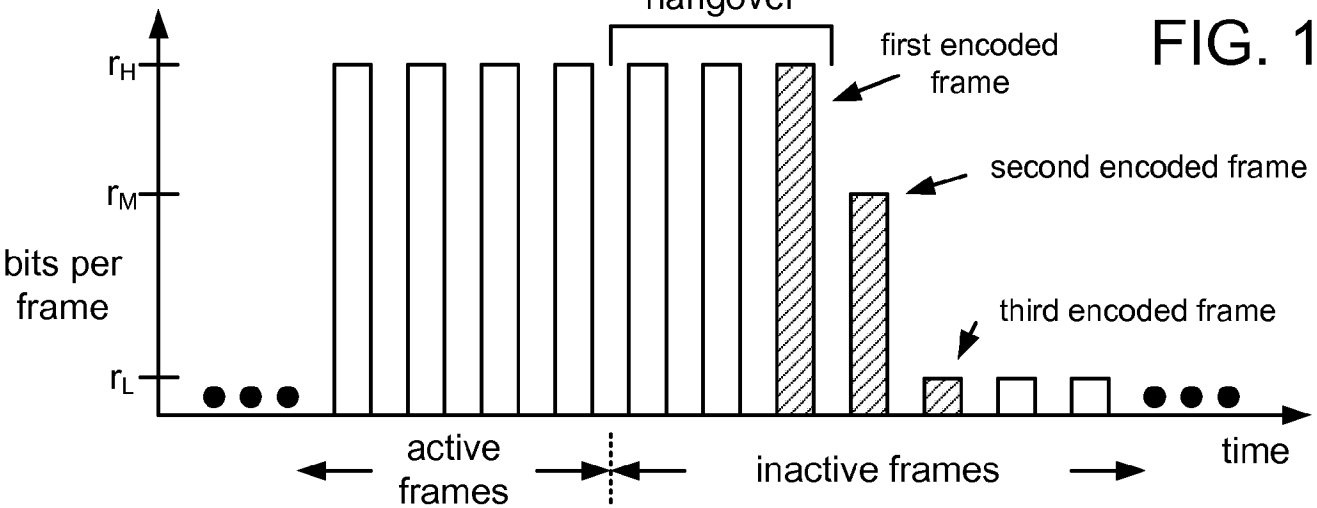

FIG. 10B illustrates a result of encoding a transition from active frames to inactive frames using an implementation of method M100 that includes a hangover. This particular example of method M100 continues the use of bit rate rH for the first three inactive frames after the transition. In general, a hangover of any desired length may be used (e.g., in the range of from one or two to five or ten frames). The length of the hangover may be selected according to an expected length of the transition and may be fixed or variable. For example, the length of the hangover may be based on one or more characteristics of one or more of the active frames preceding the transition and/or one or more of the frames within the hangover, such as signal-to-noise ratio. In general, the label "first encoded frame" may be applied to the last active frame before the transition or to any inactive frame during the hangover.

Figure 11A:
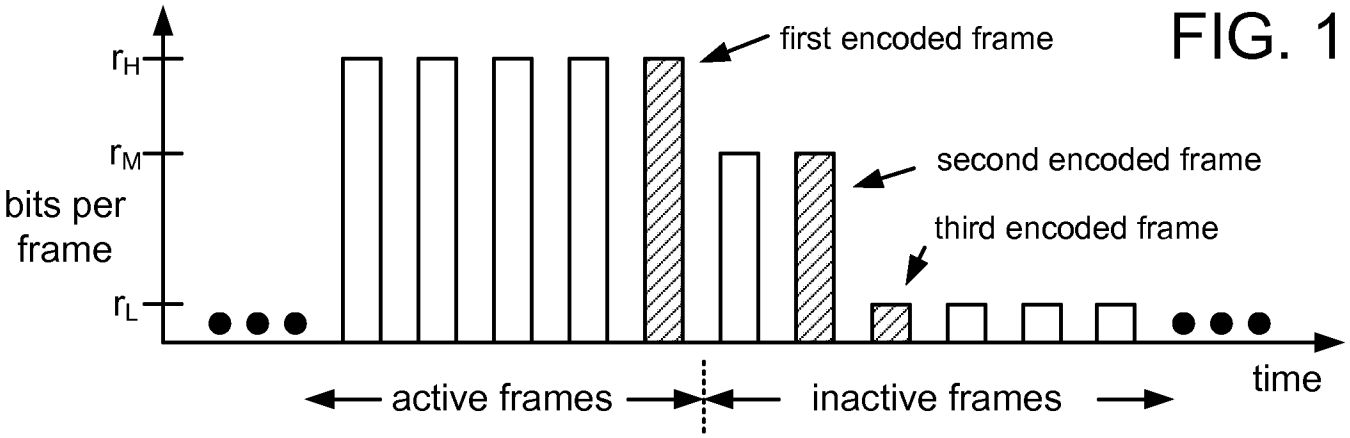

It may be desirable to implement method M100 to use bit rate r2 over a series of two or more consecutive inactive frames. FIG. 11A illustrates a result of encoding a transition from active frames to inactive frames using one such implementation of method M100. In this example, the first and last of the three encoded frames are separated by more than one frame that is encoded using bit rate rM, such that the second encoded frame does not immediately follow the first encoded frame. A corresponding speech decoder may be configured to use information from the second encoded frame to decode the third encoded frame (and possibly to decode one or more subsequent inactive frames).

It may be desirable for a speech decoder to use information from more than one encoded frame to decode a subsequent inactive frame. With reference to a series as shown in FIG. 11A, for example, a corresponding speech decoder may be configured to use information from both of the inactive frames encoded at bit rate rM to decode the third encoded frame (and possibly to decode one or more subsequent inactive frames).

Figure 11B:
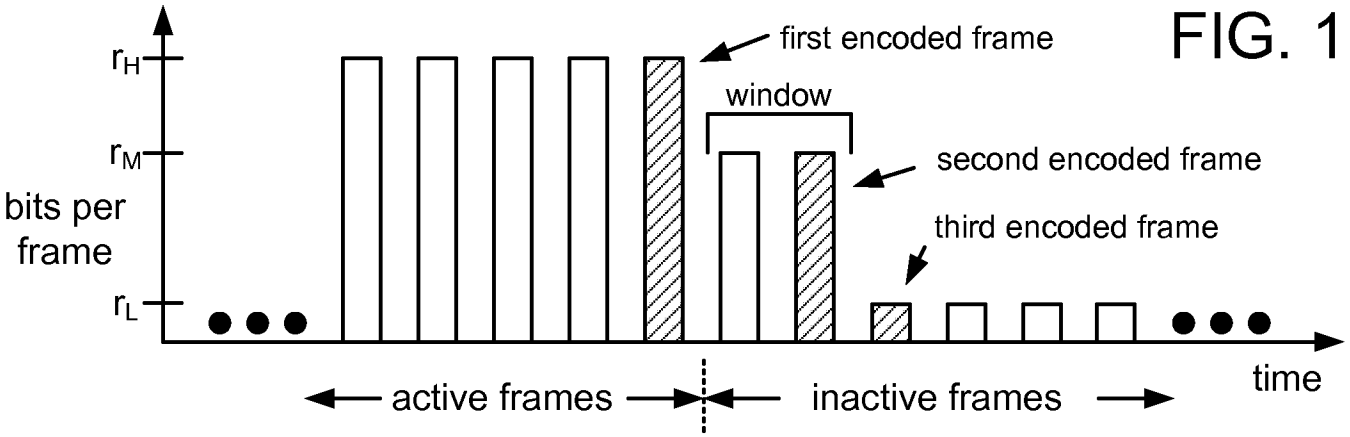

It may be generally desirable for the second encoded frame to be representative of the inactive frames. Accordingly, method M100 may be implemented to produce the second encoded frame based on spectral information from more than one inactive frame of the speech signal. FIG. 11B illustrates a result of encoding a transition from active frames to inactive frames using such an implementation of method M100. In this example, the second encoded frame contains information averaged over a window of two frames of the speech signal. In other cases, the averaging window may have a length in the range of from two to about six or eight frames. The second encoded frame may include a description of a spectral envelope that is an average of descriptions of spectral envelopes of the frames within the window (in this case, the corresponding inactive frame of the speech signal and the inactive frame that precedes it). The second encoded frame may include a description of temporal information that is based primarily or exclusively on the corresponding frame of the speech signal. Alternatively, method M100 may be configured such that the second encoded frame includes a description of temporal information that is an average of descriptions of temporal information of the frames within the window.

Figure 12A:
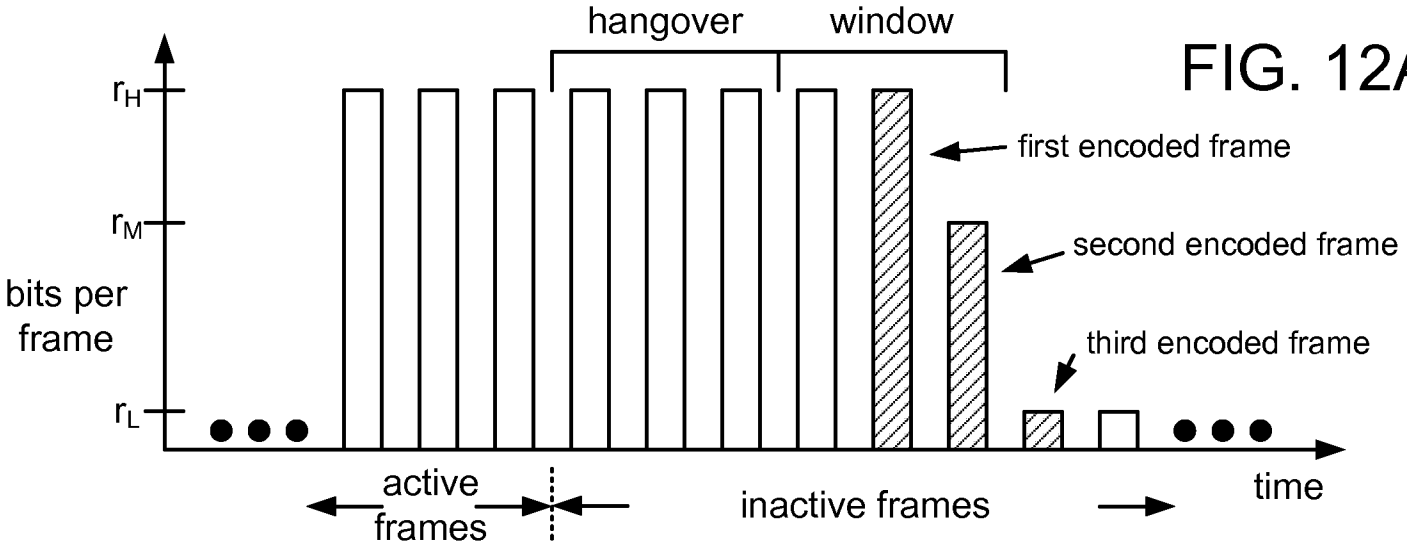

FIG. 12A illustrates a result of encoding a transition from active frames to inactive frames using another implementation of method M100. In this example, the second encoded frame contains information averaged over a window of three frames, with the second encoded frame being encoded at bit rate rM and the preceding two inactive frames being encoded at a different bit rate rH. In this particular example, the averaging window follows a three-frame post-transition hangover. In another example, method M100 may be implemented without such a hangover or, alternatively, with a hangover that overlaps the averaging window. In general, the label "first encoded frame" may be applied to the last active frame before the transition, to any inactive frame during the hangover, or to any frame in the window that is encoded at a different bit rate than the second encoded frame.

Figure 12B:
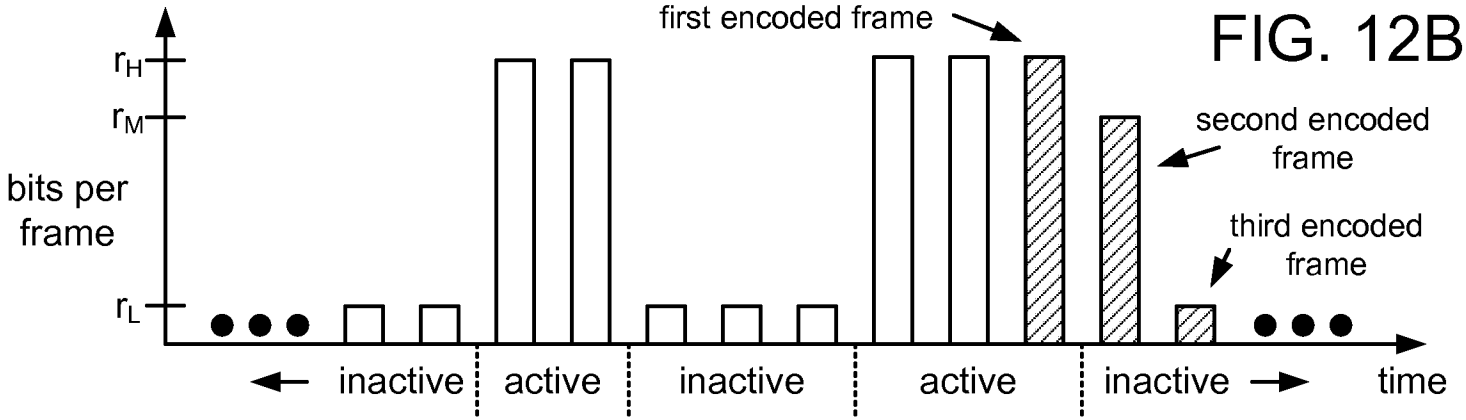

In some cases, it may be desirable for an implementation of method M100 to use bit rate r2 to encode an inactive frame only if the frame follows a sequence of consecutive active frames (also called a "talk spurt") that has at least a minimum length. FIG. 12B illustrates a result of encoding a region of a speech signal using such an implementation of method M100. In this example, method M100 is implemented to use bit rate rM to encode the first inactive frame after a transition from active frames to inactive frames, but only if the preceding talk spurt had a length of at least three frames. In such cases, the minimum talk spurt length may be fixed or variable. For example, it may be based on a characteristic of one or more of the active frames preceding the transition, such as signal-to-noise ratio. Further such implementations of method M100 may also be configured to apply a hangover and/or an averaging window as described above.

Figure 13A:
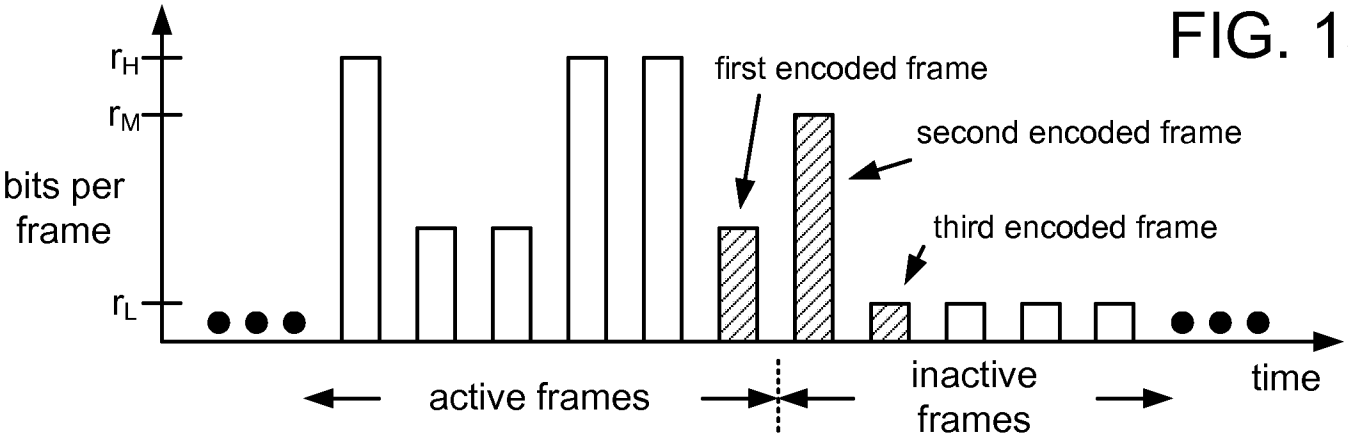
FIG. 13A shows a result of encoding a sequence of frames according to another implementation of method M100.

FIGS. 10A to 12B show applications of implementations of method M100 in which the bit rate r1 that is used to encode the first encoded frame is greater than the bit rate r2 that is used to encode the second encoded frame. However, the range of implementations of method M100 also includes methods in which bit rate r1 is less than bit rate r2. In some cases, for example, an active frame such as a voiced frame may be largely redundant of a previous active frame, and it may be desirable to encode such a frame using a bit rate that is less than r2. FIG. 13A shows a result of encoding a sequence of frames according to such an implementation of method M100, in which an active frame is encoded at a lower bit rate to produce the first of the set of three encoded frames.

Figure 13B:
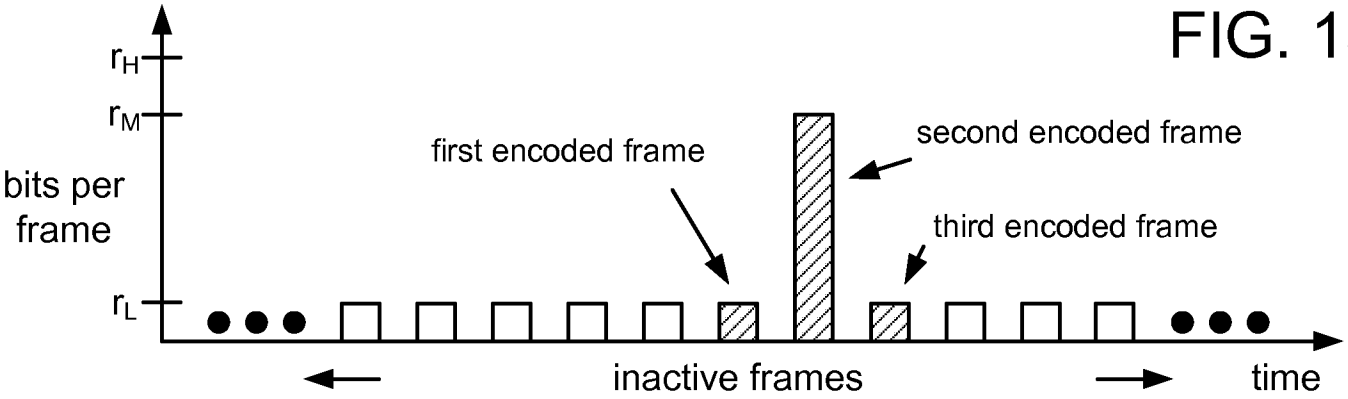
FIG. 13B illustrates a result of encoding a series of inactive frames using a further implementation of method M100.

Potential applications of method M100 are not limited to regions of a speech signal that include a transition from active frames to inactive frames. In some cases, it may be desirable to perform method M100 according to some regular interval. For example, it may be desirable to encode every n-th frame in a series of consecutive inactive frames at a higher bit rate r2, where typical values of n include 8, 16, and 32. In other cases, method M100 may be initiated in response to an event. One example of such an event is a change in quality of the background noise, which may be indicated by a change in a parameter relating to spectral tilt, such as the value of the first reflection coefficient. FIG. 13B illustrates a result of encoding a series of inactive frames using such an implementation of method M100.

As noted above, a wideband frame may be encoded using a full-band coding scheme or a split-band coding scheme. A frame encoded as full-band contains a description of a single spectral envelope that extends over the entire wideband frequency range, while a frame encoded as split-band has two or more separate portions that represent information in different frequency bands (e.g., a narrowband range and a highband range) of the wideband speech signal. For example, typically each of these separate portions of a split-band-encoded frame contains a description of a spectral envelope of the speech signal over the corresponding frequency band. A split-band-encoded frame may contain one description of temporal information for the frame for the entire wideband frequency range, or each of the separate portions of the encoded frame may contain a description of temporal information of the speech signal for the corresponding frequency band.

Figure 14:
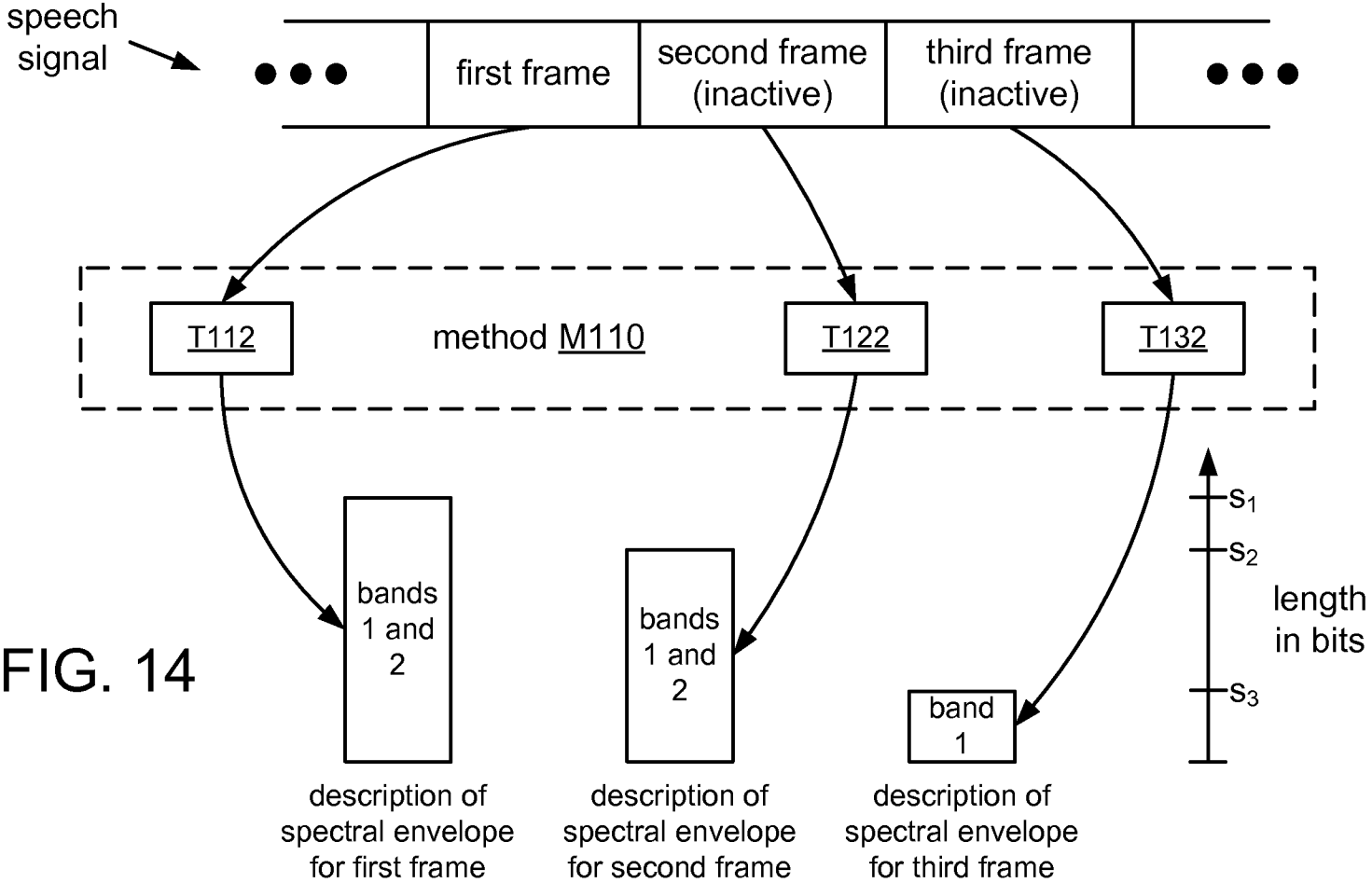
FIG. 14 shows an application of an implementation M110 of method M100.

FIG. 14 shows an application of an implementation M110 of method M100. Method M110 includes an implementation T112 of task T110 that produces a first encoded frame based on the first of three frames of the speech signal. The first frame may be active or inactive, and the first encoded frame has a length of p bits. As shown in FIG. 14, task T112 is configured to produce the first encoded frame to contain a description of a spectral envelope over first and second frequency bands. This description may be a single description that extends over both frequency bands, or it may include separate descriptions that each extend over a respective one of the frequency bands. Task T112 may also be configured to produce the first encoded frame to contain a description of temporal information (e.g., of a temporal envelope) for the first and second frequency bands. This description may be a single description that extends over both frequency bands, or it may include separate descriptions that each extend over a respective one of the frequency bands.

Method M110 also includes an implementation T122 of task T120 that produces a second encoded frame based on the second of the three frames. The second frame is an inactive frame, and the second encoded frame has a length of q bits (where p and q are not equal). As shown in FIG. 14, task T122 is configured to produce the second encoded frame to contain a description of a spectral envelope over the first and second frequency bands. This description may be a single description that extends over both frequency bands, or it may include separate descriptions that each extend over a respective one of the frequency bands. In this particular example, the length in bits of the spectral envelope description contained in the second encoded frame is less than the length in bits of the spectral envelope description contained in the first encoded frame. Task T122 may also be configured to produce the second encoded frame to contain a description of temporal information (e.g., of a temporal envelope) for the first and second frequency bands. This description may be a single description that extends over both frequency bands, or it may include separate descriptions that each extend over a respective one of the frequency bands.

Method M110 also includes an implementation T132 of task T130 that produces a third encoded frame based on the last of the three frames. The third frame is an inactive frame, and the third encoded frame has a length of r bits (where r is less than q). As shown in FIG. 14, task T132 is configured to produce the third encoded frame to contain a description of a spectral envelope over the first frequency band. In this particular example, the length (in bits) of the spectral envelope description contained in the third encoded frame is less than the length (in bits) of the spectral envelope description contained in the second encoded frame. Task T132 may also be configured to produce the third encoded frame to contain a description of temporal information (e.g., of a temporal envelope) for the first frequency band.

The second frequency band is different than the first frequency band, although method M110 may be configured such that the two frequency bands overlap. Examples of a lower bound for the first frequency band include zero, fifty, 100, 300, and 500 Hz, and examples of an upper bound for the first frequency band include three, 3.5, four, 4.5, and 5 kHz. Examples of a lower bound for the second frequency band include 2.5, 3, 3.5, 4, and 4.5 kHz, and examples of an upper bound for the second frequency band include 7, 7.5, 8, and 8.5 kHz. All five hundred possible combinations of the above bounds are expressly contemplated and hereby disclosed, and application of any such combination to any implementation of method M110 is also expressly contemplated and hereby disclosed. In one particular example, the first frequency band includes the range of about fifty Hz to about four kHz and the second frequency band includes the range of about four to about seven kHz. In another particular example, the first frequency band includes the range of about 100 Hz to about four kHz and the second frequency band includes the range of about 3.5 to about seven kHz. In a further particular example, the first frequency band includes the range of about 300 Hz to about four kHz and the second frequency band includes the range of about 3.5 to about seven kHz. In these examples, the term "about" indicates plus or minus five percent, with the bounds of the various frequency bands being indicated by the respective 3-dB points.

Figure 15:
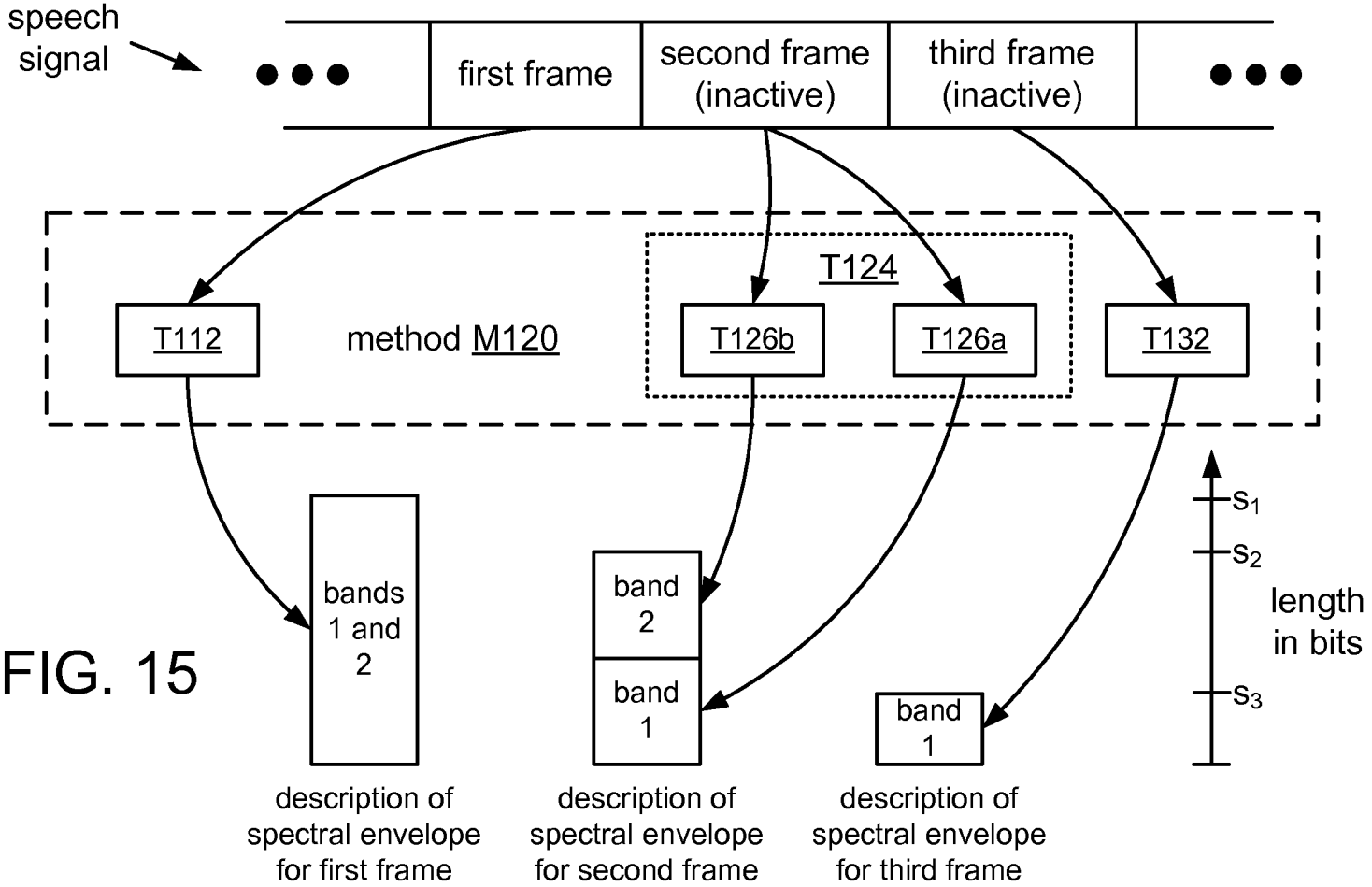
FIG. 15 shows an application of an implementation M120 of method M110.

As noted above, for wideband applications a split-band coding scheme may have advantages over a full-band coding scheme, such as increased coding efficiency and support for backward compatibility. FIG. 15 shows an application of an implementation M120 of method M110 that uses a split-band coding scheme to produce the second encoded frame. Method M120 includes an implementation T124 of task T122 that has two subtasks T126*a* and T126*b*. Task T126*a* is configured to calculate a description of a spectral envelope over the first frequency band, and task T126*b* is configured to calculate a separate description of a spectral envelope over the second frequency band. A corresponding speech decoder (e.g., as described below) may be configured to calculate a decoded wideband frame based on information from the spectral envelope descriptions calculated by tasks T126*b* and T132.

Tasks T126*a* and T132 may be configured to calculate descriptions of spectral envelopes over the first frequency band that have the same length, or one of the tasks T126*a* and T132 may be configured to calculate a description that is longer than the description calculated by the other task. Tasks T126*a* and T126*b* may also be configured to calculate separate descriptions of temporal information over the two frequency bands.

Task T132 may be configured such that the third encoded frame does not contain any description of a spectral envelope over the second frequency band. Alternatively, task T132 may be configured such that the third encoded frame contains an abbreviated description of a spectral envelope over the second frequency band. For example, task T132 may be configured such that the third encoded frame contains a description of a spectral envelope over the second frequency band that has substantially fewer bits than (e.g., is not more than half as long as) the description of a spectral envelope of the third frame over the first frequency band. In another example, task T132 is configured such that the third encoded frame contains a description of a spectral envelope over the second frequency band that has substantially fewer bits than (e.g., is not more than half as long as) the description of a spectral envelope over the second frequency band calculated by task T126*b*. In one such example, task T132 is configured to produce the third encoded frame to contain a description of a spectral envelope over the second frequency band that includes only a spectral tilt value (e.g., the normalized first reflection coefficient).

Figure 16:
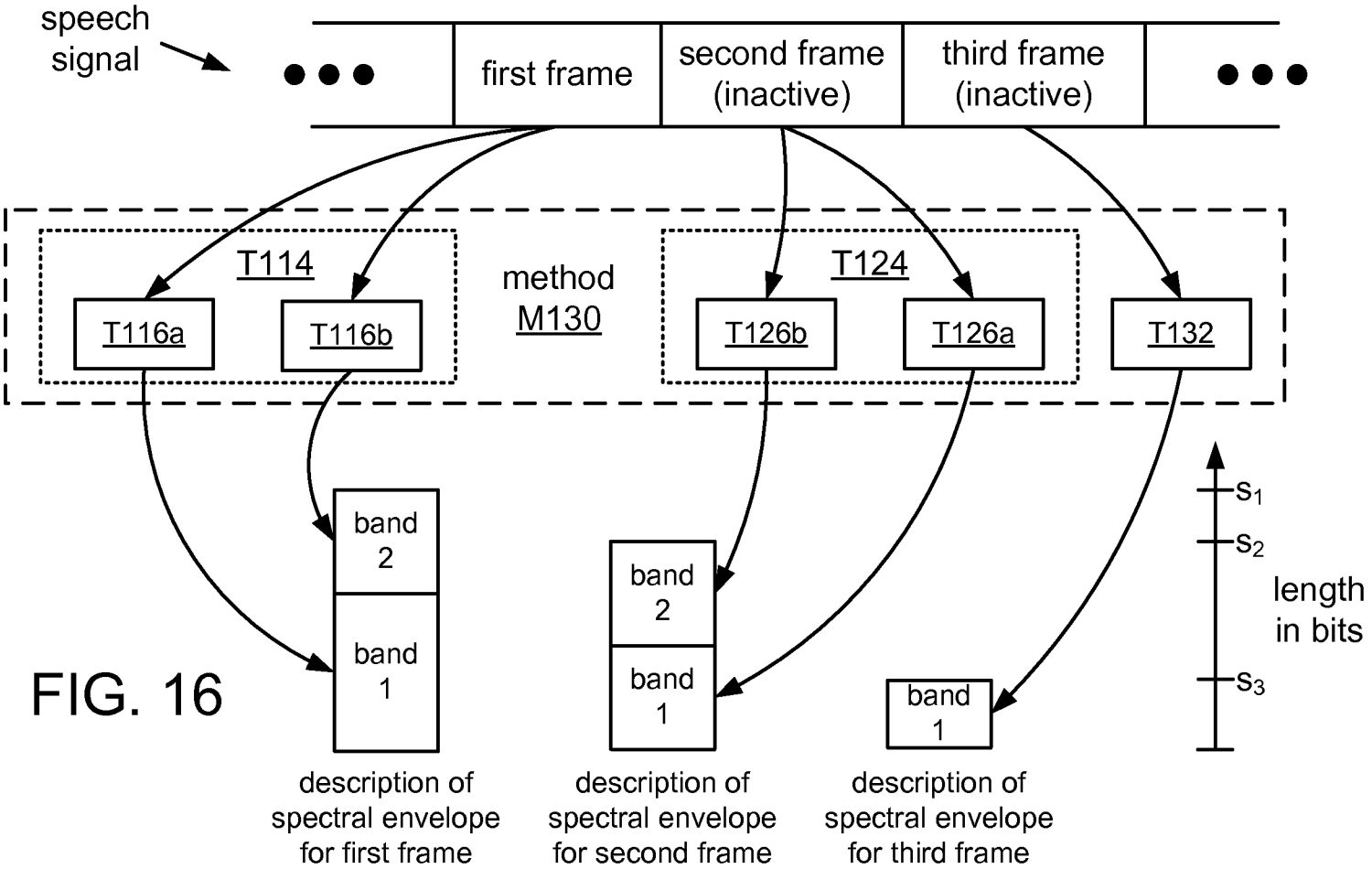
FIG. 16 shows an application of an implementation M130 of method M120

It may be desirable to implement method M110 to produce the first encoded frame using a split-band coding scheme rather than a full-band coding scheme. FIG. 16 shows an application of an implementation M130 of method M120 that uses a split-band coding scheme to produce the first encoded frame. Method M130 includes an implementation T114 of task T110 that includes two subtasks T116*a* and T116*b*. Task T116*a* is configured to calculate a description of a spectral envelope over the first frequency band, and task T116*b* is configured to calculate a separate description of a spectral envelope over the second frequency band.

Tasks T116*a* and T126*a* may be configured to calculate descriptions of spectral envelopes over the first frequency band that have the same length, or one of the tasks T116*a* and T126*a* may be configured to calculate a description that is longer than the description calculated by the other task. Tasks T116*b* and T126*b* may be configured to calculate descriptions of spectral envelopes over the second frequency band that have the same length, or one of the tasks T116*b* and T126*b* may be configured to calculate a description that is longer than the description calculated by the other task. Tasks T116*a* and T116*b* may also be configured to calculate separate descriptions of temporal information over the two frequency bands.

Figure 17A:
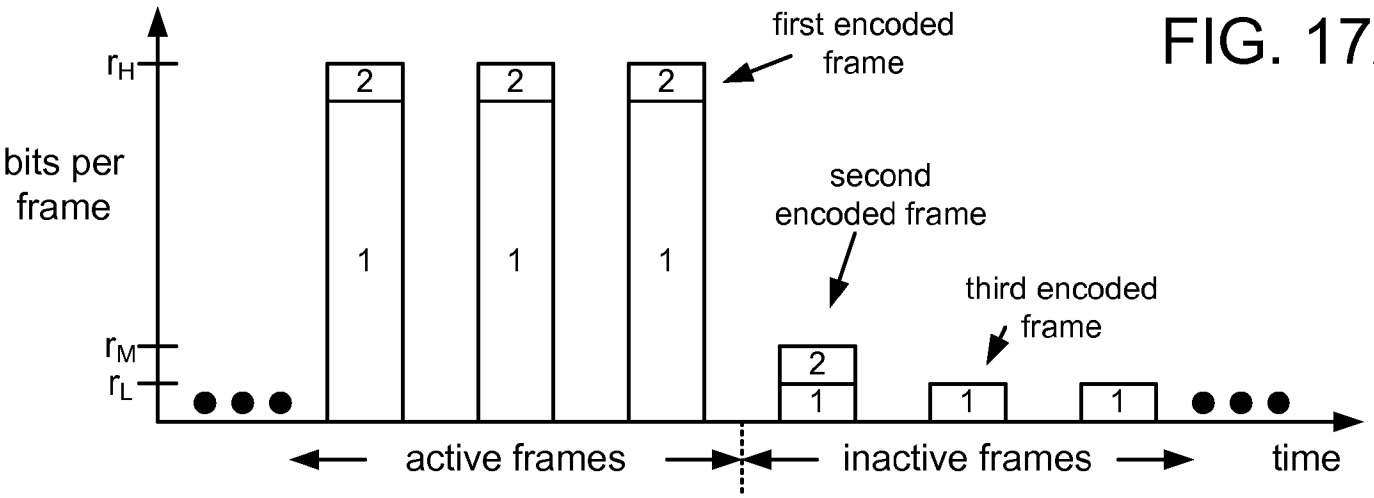
FIG. 17A illustrates a result of encoding a transition from active frames to inactive frames using an implementation of method M130.

FIG. 17A illustrates a result of encoding a transition from active frames to inactive frames using an implementation of method M130. In this particular example, the portions of the first and second encoded frames that represent the second frequency band have the same length, and the portions of the second and third encoded frames that represent the first frequency band have the same length.

It may be desirable for the portion of the second encoded frame which represents the second frequency band to have a greater length than a corresponding portion of the first encoded frame. The low- and high-frequency ranges of an active frame are more likely to be correlated with one another (especially if the frame is voiced) than the low- and high-frequency ranges of an inactive frame that contains background noise. Accordingly, the high-frequency range of the inactive frame may convey relatively more information of the frame as compared to the high-frequency range of the active frame, and it may be desirable to use a greater number of bits to encode the high-frequency range of the inactive frame.

Figure 17B:
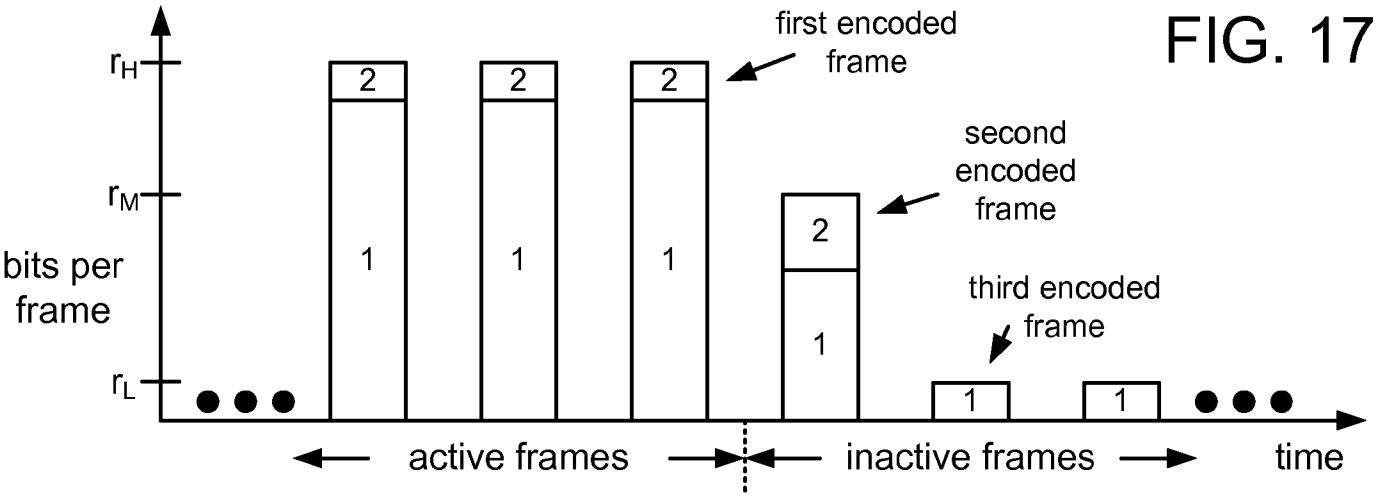
FIG. 17B illustrates a result of encoding a transition from active frames to inactive frames using another implementation of method M130.

FIG. 17B illustrates a result of encoding a transition from active frames to inactive frames using another implementation of method M130. In this case, the portion of the second encoded frame that represents the second frequency band is longer than (i.e., has more bits than) the corresponding portion of the first encoded frame. This particular example also shows a case in which the portion of the second encoded frame that represents the first frequency band is longer than the corresponding portion of the third encoded frame, although a further implementation of method M130 may be configured to encode the frames such that these two portions have the same length (e.g., as shown in FIG. 17A).

A typical example of method M100 is configured to encode the second frame using a wideband NELP mode (which may be full-band as shown in FIG. 14, or split-band as shown in FIGS. 15 and 16) and to encode the third frame using a narrowband NELP mode. The table of FIG. 18 shows one set of three different coding schemes that a speech encoder may use to produce a result as shown in FIG. 17B. In this example, a full-rate wideband CELP coding scheme ("coding scheme 1") is used to encode voiced frames. This coding scheme uses 153 bits to encode the narrowband portion of the frame and 16 bits to encode the highband portion. For the narrowband, coding scheme 1 uses 28 bits to encode a description of the spectral envelope (e.g., as one or more quantized LSP vectors) and 125 bits to encode a description of the excitation signal. For the highband, coding scheme 1 uses 8 bits to encode the spectral envelope (e.g., as one or more quantized LSP vectors) and 8 bits to encode a description of the temporal envelope.

It may be desirable to configure coding scheme 1 to derive the highband excitation signal from the narrowband excitation signal, such that no bits of the encoded frame are needed to carry the highband excitation signal. It may also be desirable to configure coding scheme 1 to calculate the highband temporal envelope relative to the temporal envelope of the highband signal as synthesized from other parameters of the encoded frame (e.g., including the description of a spectral envelope over the second frequency band). Such features are described in more detail in, for example, U.S. Pat. Appl. Pub. 2006/0282262 cited above.

As compared to a voiced speech signal, an unvoiced speech signal typically contains more of the information that is important to speech comprehension in the highband. Thus it may be desirable to use more bits to encode the highband portion of an unvoiced frame than to encode the highband portion of a voiced frame, even for a case in which the voiced frame is encoded using a higher overall bit rate. In an example according to the table of FIG. 18, a half-rate wideband NELP coding scheme ("coding scheme 2") is used to encode unvoiced frames. Instead of 16 bits as is used by coding scheme 1 to encode the highband portion of a voiced frame, this coding scheme uses 27 bits to encode the highband portion of the frame: 12 bits to encode a description of the spectral envelope (e.g., as one or more quantized LSP vectors) and 15 bits to encode a description of the temporal envelope (e.g., as a quantized gain frame and/or gain shape). To encode the narrowband portion, coding scheme 2 uses 47 bits: 28 bits to encode a description of the spectral envelope (e.g., as one or more quantized LSP vectors) and 19 bits to encode a description of the temporal envelope (e.g., as a quantized gain frame and/or gain shape).

The scheme described in FIG. 18 uses an eighth-rate narrowband NELP coding scheme ("coding scheme 3") to encode inactive frames at a rate of 16 bits per frame, with 10 bits to encode a description of the spectral envelope (e.g., as one or more quantized LSP vectors) and 5 bits to encode a description of the temporal envelope (e.g., as a quantized gain frame and/or gain shape). Another example of coding scheme 3 uses 8 bits to encode the description of the spectral envelope and 6 bits to encode the description of the temporal envelope.

A speech encoder or method of speech encoding may be configured to use a set of coding schemes as shown in FIG. 18 to perform an implementation of method M130. For example, such an encoder or method may be configured to use coding scheme 2 rather than coding scheme 3 to produce the second encoded frame. Various implementations of such an encoder or method may be configured to produce results as shown in FIGS. 10A to 13B by using coding scheme 1 where bit rate rH is indicated, coding scheme 2 where bit rate rM is indicated, and coding scheme 3 where bit rate rL is indicated.

For cases in which a set of coding schemes as shown in FIG. 18 is used to perform an implementation of method M130, the encoder or method is configured to use the same coding scheme (scheme 2) to produce the second encoded frame and to produce encoded unvoiced frames. In other cases, an encoder or method configured to perform an implementation of method M100 may be configured to encode the second frame using a dedicated coding scheme (i.e., a coding scheme that the encoder or method does not also use to encode active frames).

An implementation of method M130 that uses a set of coding schemes as shown in FIG. 18 is configured to use the same coding mode (i.e., NELP) to produce the second and third encoded frames, although it is possible to use versions of the coding mode that differ (e.g., in terms of how the gains are computed) to produce the two encoded frames. Other configurations of method M100 in which the second and third encoded frames are produced using different coding modes (e.g., using a CELP mode instead to produce the second encoded frame) are also expressly contemplated and hereby disclosed. Further configurations of method M100 in which the second encoded frame is produced using a split-band wideband mode that uses different coding modes for different frequency bands (e.g., CELP for a lower band and NELP for a higher band, or vice versa) are also expressly contemplated and hereby disclosed. Speech encoders and methods of speech encoding that are configured to perform such implementations of method M100 are also expressly contemplated and hereby disclosed.

In a typical application of an implementation of method M100, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.) that is readable and/or executable by a machine (e.g., a computer) including an array of logic elements (e.g., a processor, microprocessor, microcontroller, or other finite state machine). The tasks of an implementation of method M100 may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to transmit encoded frames.

Figure 18C:
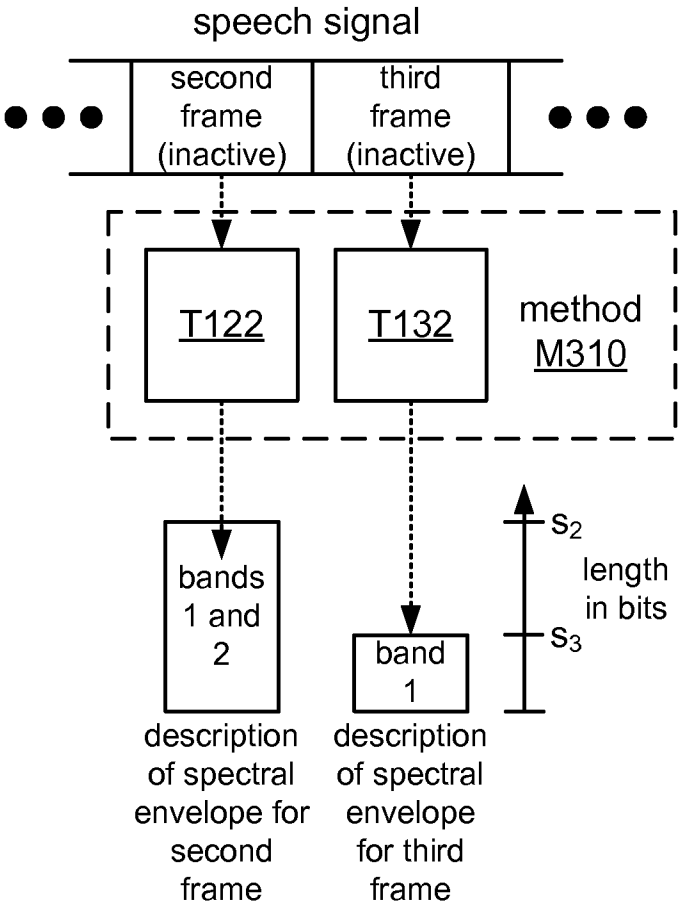
FIG. 18C shows an application of an implementation M310 of method M300.
Figure 18B:
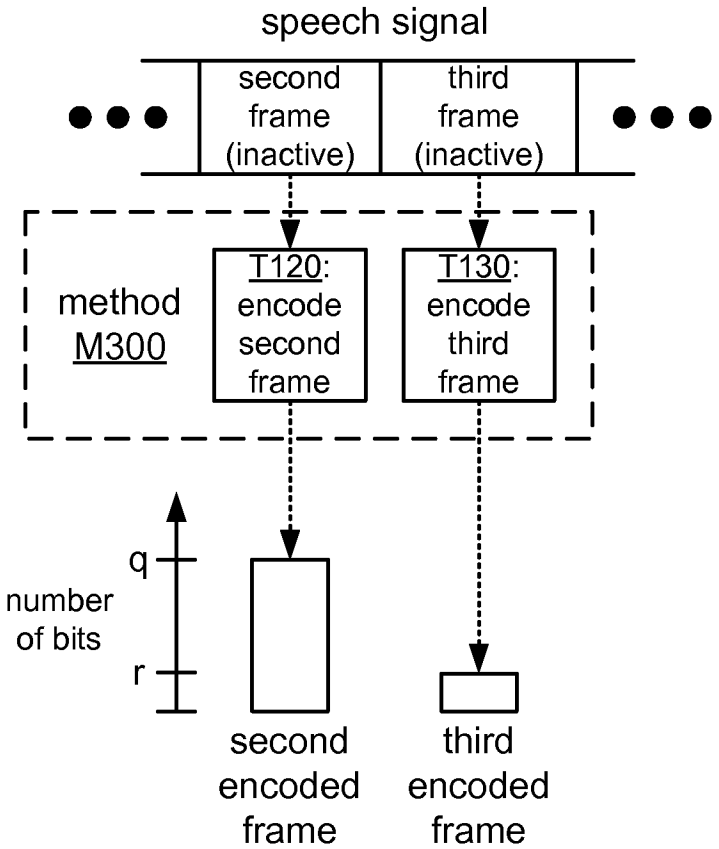
FIG. 18B illustrates an operation of encoding two successive frames of a speech signal using a method M300 according to a general configuration.

FIG. 18B illustrates an operation of encoding two successive frames of a speech signal using a method M300 according to a general configuration that includes tasks T120 and T130 as described herein. (Although this implementation of method M300 processes only two frames, use of the labels "second frame" and "third frame" is continued for convenience.) In the particular example shown in FIG. 18B, the third frame immediately follows the second frame. In other applications of method M300, the second and third frames may be separated in the speech signal by an inactive frame or by a consecutive series of two or more inactive frames. In further applications of method M300, the third frame may be any inactive frame of the speech signal that is not the second frame. In another general application of method M300, the second frame may be either active or inactive. In another general application of method M300, the second frame may be either active or inactive, and the third frame may be either active or inactive. FIG. 18C shows an application of an implementation M310 of method M300 in which tasks T120 and T130 are implemented as tasks T122 and T132, respectively, as described herein. In a further implementation of method M300, task T120 is implemented as task T124 as described herein. It may be desirable to configure task T132 such that the third encoded frame does not contain any description of a spectral envelope over the second frequency band.

Figure 19A:
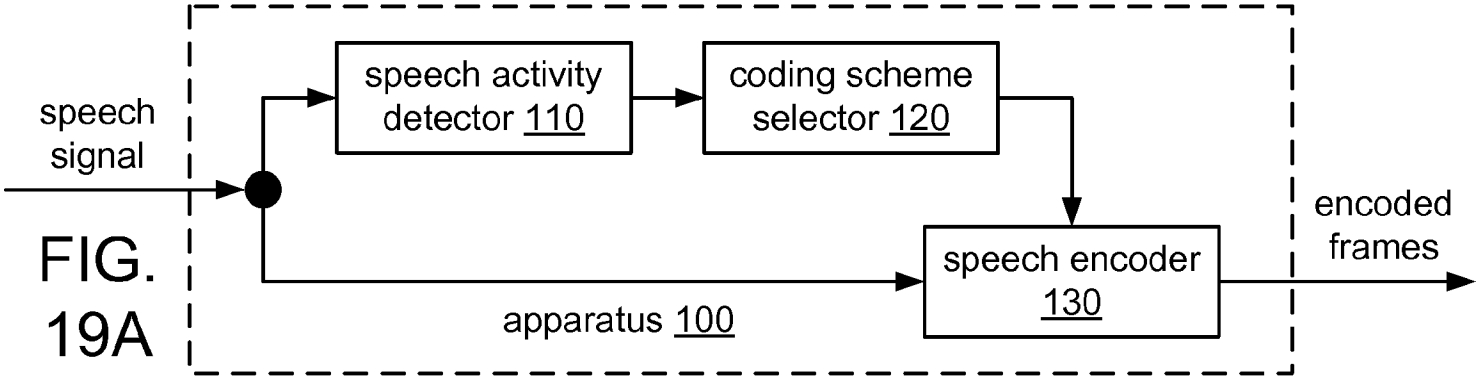
FIG. 19A shows a block diagram of an apparatus 100 according to a general configuration.

FIG. 19A shows a block diagram of an apparatus 100 configured to perform a method of speech encoding that includes an implementation of method M100 as described herein and/or an implementation of method M300 as described herein. Apparatus 100 includes a speech activity detector 110, a coding scheme selector 120, and a speech encoder 130. Speech activity detector 110 is configured to receive frames of a speech signal and to indicate, for each frame to be encoded, whether the frame is active or inactive. Coding scheme selector 120 is configured to select, in response to the indications of speech activity detector 110, a coding scheme for each frame to be encoded. Speech encoder 130 is configured to produce, according to the selected coding schemes, encoded frames that are based on the frames of the speech signal. A communications device that includes apparatus 100, such as a cellular telephone, may be configured to perform further processing operations on the encoded frames, such as error-correction and/or redundancy coding, before transmitting them into a wired, wireless, or optical transmission channel.

Speech activity detector 110 is configured to indicate whether each frame to be encoded is active or inactive. This indication may be a binary signal, such that one state of the signal indicates that the frame is active and the other state indicates that the frame is inactive. Alternatively, the indication may be a signal having more than two states such that it may indicate more than one type of active and/or inactive frame. For example, it may be desirable to configure detector 110 to indicate whether an active frame is voiced or unvoiced; or to classify active frames as transitional, voiced, or unvoiced; and possibly even to classify transitional frames as up-transient or down-transient. A corresponding implementation of coding scheme selector 120 is configured to select, in response to these indications, a coding scheme for each frame to be encoded.

Speech activity detector 110 may be configured to indicate whether a frame is active or inactive based on one or more characteristics of the frame such as energy, signal-to-noise ratio, periodicity, zero-crossing rate, spectral distribution (as evaluated using, for example, one or more LSFs, LSPs, and/or reflection coefficients), etc. To generate the indication, detector 110 may be configured to perform, for each of one or more of such characteristics, an operation such as comparing a value or magnitude of such a characteristic to a threshold value and/or comparing the magnitude of a change in the value or magnitude of such a characteristic to a threshold value, where the threshold value may be fixed or adaptive.

An implementation of speech activity detector 110 may be configured to evaluate the energy of the current frame and to indicate that the frame is inactive if the energy value is less than (alternatively, not greater than) a threshold value. Such a detector may be configured to calculate the frame energy as a sum of the squares of the frame samples. Another implementation of speech activity detector 110 is configured to evaluate the energy of the current frame in each of a low-frequency band and a high-frequency band, and to indicate that the frame is inactive if the energy value for each band is less than (alternatively, not greater than) a respective threshold value. Such a detector may be configured to calculate the frame energy in a band by applying a passband filter to the frame and calculating a sum of the squares of the samples of the filtered frame.

As noted above, an implementation of speech activity detector 110 may be configured to use one or more threshold values. Each of these values may be fixed or adaptive. An adaptive threshold value may be based on one or more factors such as a noise level of a frame or band, a signal-to-noise ratio of a frame or band, a desired encoding rate, etc. In one example, the threshold values used for each of a low-frequency band (e.g., 300 Hz to 2 kHz) and a high-frequency band (e.g., 2 kHz to 4 kHz) are based on an estimate of the background noise level in that band for the previous frame, a signal-to-noise ratio in that band for the previous frame, and a desired average data rate.

Coding scheme selector 120 is configured to select, in response to the indications of speech activity detector 110, a coding scheme for each frame to be encoded. The coding scheme selection may be based on an indication from speech activity detector 110 for the current frame and/or on the indication from speech activity detector 110 for each of one or more previous frames. In some cases, the coding scheme selection is also based on the indication from speech activity detector 110 for each of one or more subsequent frames.

Figures 20A, 20B, 21C:
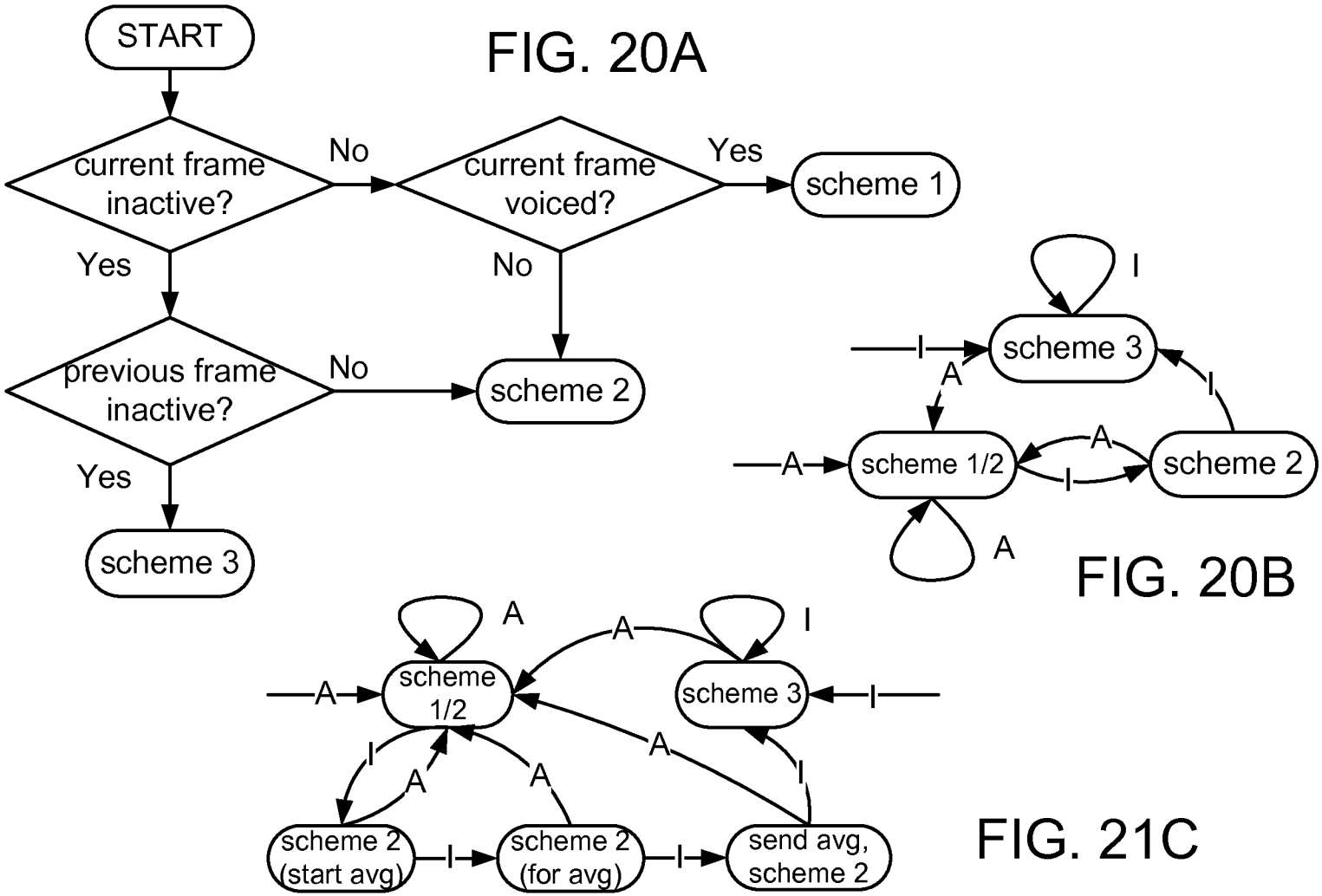
FIG. 20A shows a flowchart of tests that may be performed by an implementation of coding scheme selector 120.
FIG. 20B shows a state diagram according to which another implementation of coding scheme selector 120 may be configured to operate.
FIGS. 21A, 21B, and 21C show state diagrams according to which further implementations of coding scheme selector 120 may be configured to operate.

FIG. 20A shows a flowchart of tests that may be performed by an implementation of coding scheme selector 120 to obtain a result as shown in FIG. 10A. In this example, selector 120 is configured to select a higher-rate coding scheme 1 for voiced frames, a lower-rate coding scheme 3 for inactive frames, and an intermediate-rate coding scheme 2 for unvoiced frames and for the first inactive frame after a transition from active frames to inactive frames. In such an application, coding schemes 1-3 may conform to the three schemes shown in FIG. 18.

An alternative implementation of coding scheme selector 120 may be configured to operate according to the state diagram of FIG. 20B to obtain an equivalent result. In this figure, the label "A" indicates a state transition in response to an active frame, the label "I" indicates a state transition in response to an inactive frame, and the labels of the various states indicate the coding scheme selected for the current frame. In this case, the state label "scheme ½" indicates that either coding scheme 1 or coding scheme 2 is selected for the current active frame, depending on whether the frame is voiced or unvoiced. One of ordinary skill will appreciate that in an alternative implementation, this state may be configured such that the coding scheme selector supports only one coding scheme for active frames (e.g., coding scheme 1). In a further alternative implementation, this state may be configured such that the coding scheme selector selects from among more than two different coding schemes for active frames (e.g., selects different coding schemes for voiced, unvoiced, and transitional frames).

Figure 21A:
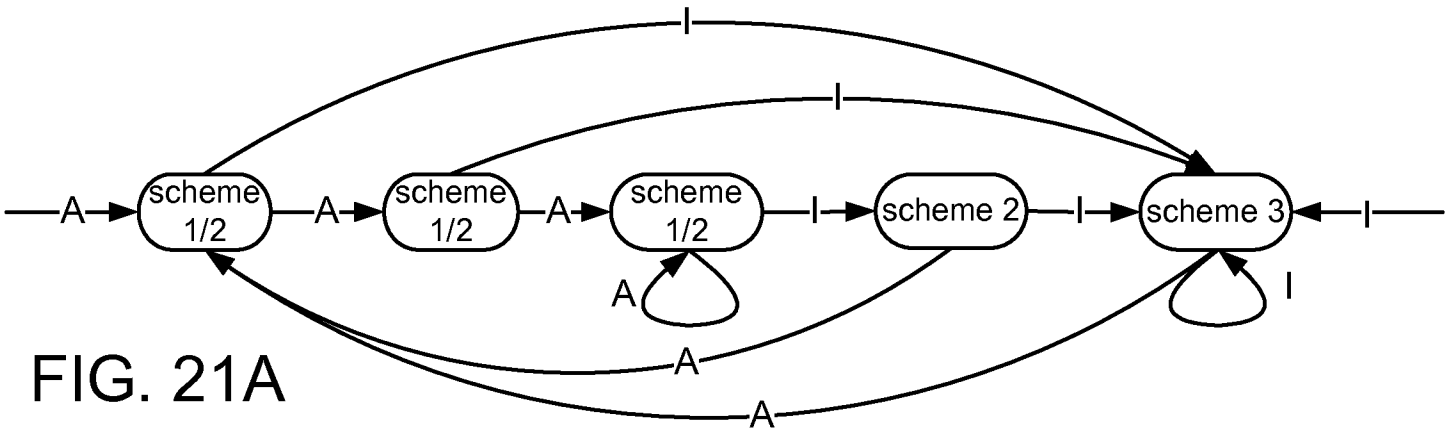

As noted above with reference to FIG. 12B, it may be desirable for a speech encoder to encode an inactive frame at a higher bit rate r2 only if the most recent active frame is part of a talk spurt having at least a minimum length. An implementation of coding scheme selector 120 may be configured to operate according to the state diagram of FIG. 21A to obtain a result as shown in FIG. 12B. In this particular example, the selector is configured to select coding scheme 2 for an inactive frame only if the frame immediately follows a string of consecutive active frames having a length of at least three frames. In this case, the state labels "scheme ½" indicate that either coding scheme 1 or coding scheme 2 is selected for the current active frame, depending on whether the frame is voiced or unvoiced. One of ordinary skill will appreciate that in an alternative implementation, these states may be configured such that the coding scheme selector supports only one coding scheme for active frames (e.g., coding scheme 1). In a further alternative implementation, these states may be configured such that the coding scheme selector selects from among more than two different coding schemes for active frames (e.g., selects different schemes for voiced, unvoiced, and transitional frames).

Figure 21B:
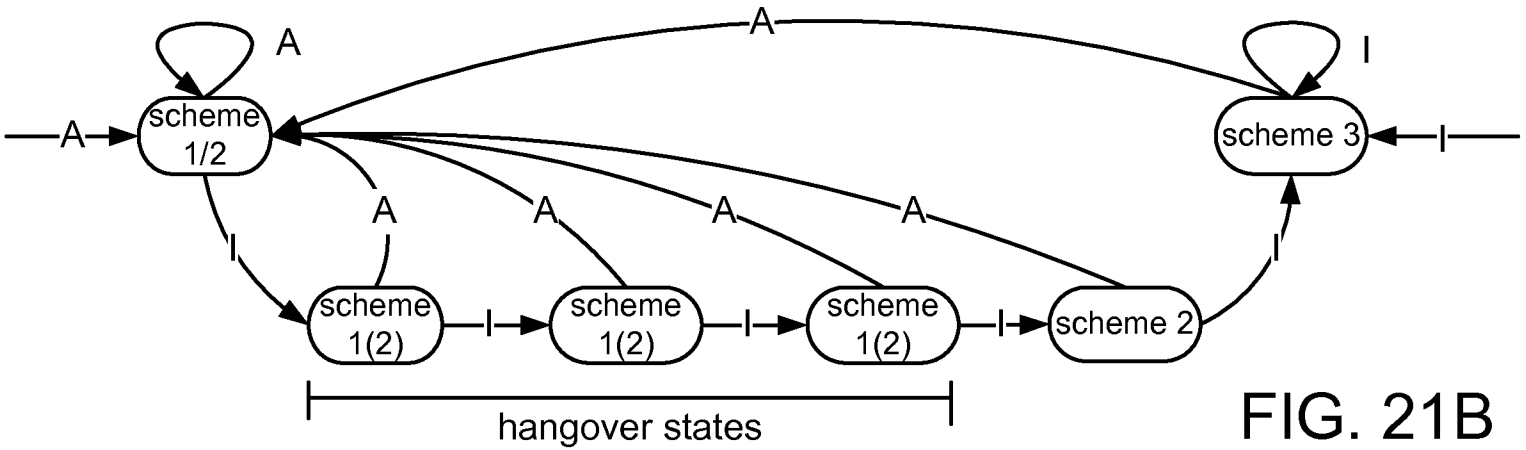

As noted above with reference to FIGS. 10B and 12A, it may be desirable for a speech encoder to apply a hangover (i.e., to continue the use of a higher bit rate for one or more inactive frames after a transition from active frames to inactive frames). An implementation of coding scheme selector 120 may be configured to operate according to the state diagram of FIG. 21B to apply a hangover having a length of three frames. In this figure, the hangover states are labeled "scheme 1(2)" to denote that either coding scheme 1 or coding scheme 2 is indicated for the current inactive frame, depending on the scheme selected for the most recent active frame. One of ordinary skill will appreciate that in an alternative implementation, the coding scheme selector may support only one coding scheme for active frames (e.g., coding scheme 1). In a further alternative implementation, the hangover states may be configured to continue indicating one of more than two different coding schemes (e.g., for a case in which different schemes are supported for voiced, unvoiced, and transitional frames). In a further alternative implementation, one or more of the hangover states may be configured to indicate a fixed scheme (e.g., scheme 1) even if a different scheme (e.g., scheme 2) was selected for the most recent active frame.

As noted above with reference to FIGS. 11B and 12A, it may be desirable for a speech encoder to produce the second encoded frame based on information averaged over more than one inactive frame of the speech signal. An implementation of coding scheme selector 120 may be configured to operate according to the state diagram of FIG. 21C to support such a result. In this particular example, the selector is configured to direct the encoder to produce the second encoded frame based on information averaged over three inactive frames. The state labeled "scheme 2 (start avg)" indicates to the encoder that the current frame is to be encoded with scheme 2 and also used to calculate a new average (e.g., an average of descriptions of spectral envelopes). The state labeled "scheme 2 (for avg)" indicates to the encoder that the current frame is to be encoded with scheme 2 and also used to continue calculation of the average. The state labeled "send avg, scheme 2" indicates to the encoder that the current frame is to be used to complete the average, which is then to be sent using scheme 2. One of ordinary skill will appreciate that alternative implementations of coding scheme selector 120 may be configured to use different scheme assignments and/or to indicate averaging of information over a different number of inactive frames.

Figure 19B:
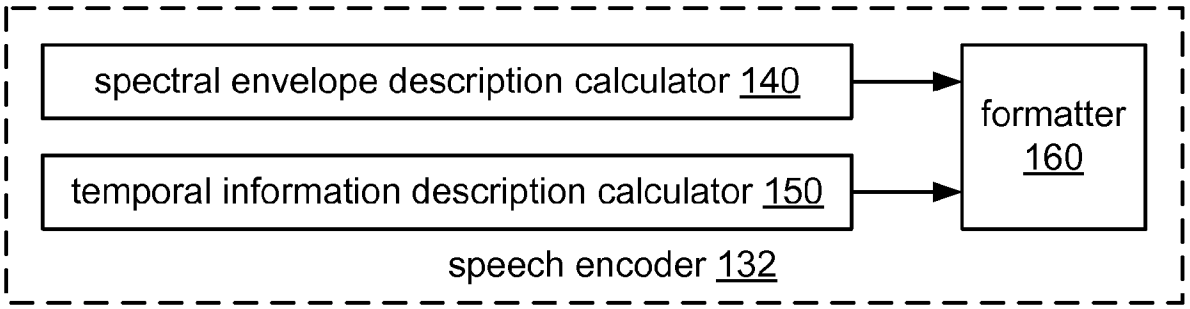
FIG. 19B shows a block diagram of an implementation 132 of speech encoder 130.

FIG. 19B shows a block diagram of an implementation 132 of speech encoder 130 that includes a spectral envelope description calculator 140, a temporal information description calculator 150, and a formatter 160. Spectral envelope description calculator 140 is configured to calculate a description of a spectral envelope for each frame to be encoded. Temporal information description calculator 150 is configured to calculate a description of temporal information for each frame to be encoded. Formatter 160 is configured to produce an encoded frame that includes the calculated description of a spectral envelope and the calculated description of temporal information. Formatter 160 may be configured to produce the encoded frame according to a desired packet format, possibly using different formats for different coding schemes. Formatter 160 may be configured to produce the encoded frame to include additional information, such as a set of one or more bits that identifies the coding scheme, or the coding rate or mode, according to which the frame is encoded (also called a "coding index").

Spectral envelope description calculator 140 is configured to calculate, according to the coding scheme indicated by coding scheme selector 120, a description of a spectral envelope for each frame to be encoded. The description is based on the current frame and may also be based on at least part of one or more other frames. For example, calculator 140 may be configured to apply a window that extends into one or more adjacent frames and/or to calculate an average of descriptions (e.g., an average of LSP vectors) of two or more frames.

Figure 19C:
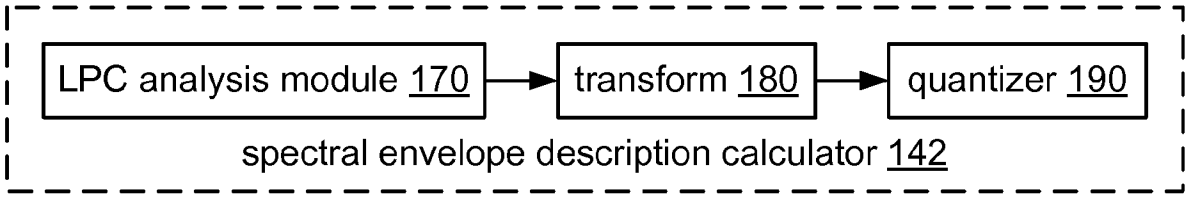
FIG. 19C shows a block diagram of an implementation 142 of spectral envelope description calculator 140.

Calculator 140 may be configured to calculate the description of a spectral envelope for the frame by performing a spectral analysis such as an LPC analysis. FIG. 19C shows a block diagram of an implementation 142 of spectral envelope description calculator 140 that includes an LPC analysis module 170, a transform block 180, and a quantizer 190. Analysis module 170 is configured to perform an LPC analysis of the frame and to produce a corresponding set of model parameters. For example, analysis module 170 may be configured to produce a vector of LPC coefficients such as filter coefficients or reflection coefficients. Analysis module 170 may be configured to perform the analysis over a window that includes portions of one or more neighboring frames. In some cases, analysis module 170 is configured such that the order of the analysis (e.g., the number of elements in the coefficient vector) is selected according to the coding scheme indicated by coding scheme selector 120.

Transform block 180 is configured to convert the set of model parameters into a form that is more efficient for quantization. For example, transform block 180 may be configured to convert an LPC coefficient vector into a set of LSPs. In some cases, transform block 180 is configured to convert the set of LPC coefficients into a particular form according to the coding scheme indicated by coding scheme selector 120.

Quantizer 190 is configured to produce the description of a spectral envelope in quantized form by quantizing the converted set of model parameters. Quantizer 190 may be configured to quantize the converted set by truncating elements of the converted set and/or by selecting one or more quantization table indices to represent the converted set. In some cases, quantizer 190 is configured to quantize the converted set into a particular form and/or length according to the coding scheme indicated by coding scheme selector 120 (for example, as discussed above with reference to FIG. 18).

Temporal information description calculator 150 is configured to calculate a description of temporal information of a frame. The description may be based on temporal information of at least part of one or more other frames as well. For example, calculator 150 may be configured to calculate the description over a window that extends into one or more adjacent frames and/or to calculate an average of descriptions of two or more frames.

Temporal information description calculator 150 may be configured to calculate a description of temporal information that has a particular form and/or length according to the coding scheme indicated by coding scheme selector 120. For example, calculator 150 may be configured to calculate, according to the selected coding scheme, a description of temporal information that includes one or both of (A) a temporal envelope of the frame and (B) an excitation signal of the frame, which may include a description of a pitch component (e.g., pitch lag (also called delay), pitch gain, and/or a description of a prototype).

Calculator 150 may be configured to calculate a description of temporal information that includes a temporal envelope of the frame (e.g., a gain frame value and/or gain shape values). For example, calculator 150 may be configured to output such a description in response to an indication of a NELP coding scheme. As described herein, calculating such a description may include calculating the signal energy over a frame or subframe as a sum of squares of the signal samples, calculating the signal energy over a window that includes parts of other frames and/or subframes, and/or quantizing the calculated temporal envelope.

Calculator 150 may be configured to calculate a description of temporal information of a frame that includes information relating to pitch or periodicity of the frame. For example, calculator 150 may be configured to output a description that includes pitch information of the frame, such as pitch lag and/or pitch gain, in response to an indication of a CELP coding scheme. Alternatively or additionally, calculator 150 may be configured to output a description that includes a periodic waveform (also called a "prototype") in response to an indication of a PPP coding scheme. Calculating pitch and/or prototype information typically includes extracting such information from the LPC residual and may also include combining pitch and/or prototype information from the current frame with such information from one or more past frames. Calculator 150 may also be configured to quantize such a description of temporal information (e.g., as one or more table indices).

Calculator 150 may be configured to calculate a description of temporal information of a frame that includes an excitation signal. For example, calculator 150 may be configured to output a description that includes an excitation signal in response to an indication of a CELP coding scheme. Calculating an excitation signal typically includes deriving such a signal from the LPC residual and may also include combining excitation information from the current frame with such information from one or more past frames. Calculator 150 may also be configured to quantize such a description of temporal information (e.g., as one or more table indices). For cases in which speech encoder 132 supports a relaxed CELP (RCELP) coding scheme, calculator 150 may be configured to regularize the excitation signal.

Figure 22A:
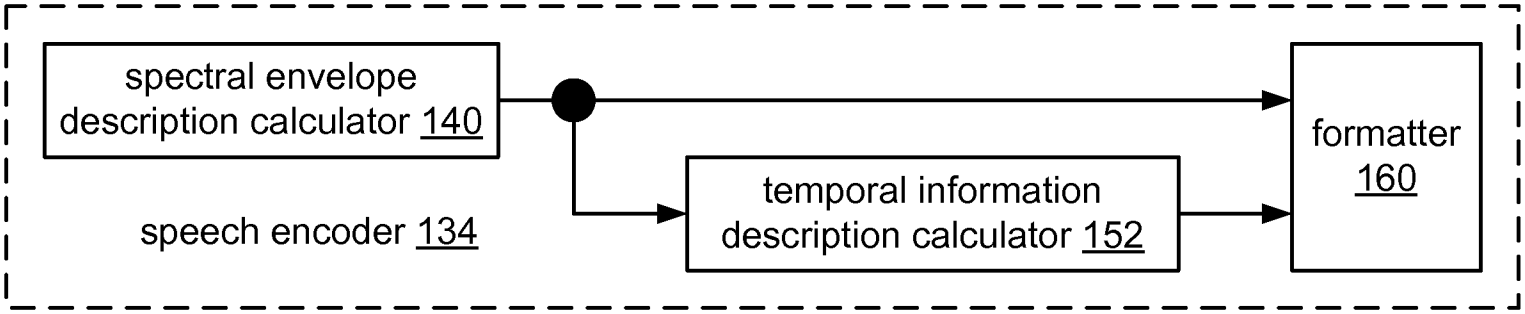
FIG. 22A shows a block diagram of an implementation 134 of speech encoder 132.

FIG. 22A shows a block diagram of an implementation 134 of speech encoder 132 that includes an implementation 152 of temporal information description calculator 150. Calculator 152 is configured to calculate a description of temporal information for a frame (e.g., an excitation signal, pitch and/or prototype information) that is based on a description of a spectral envelope of the frame as calculated by spectral envelope description calculator 140.

Figure 22B:
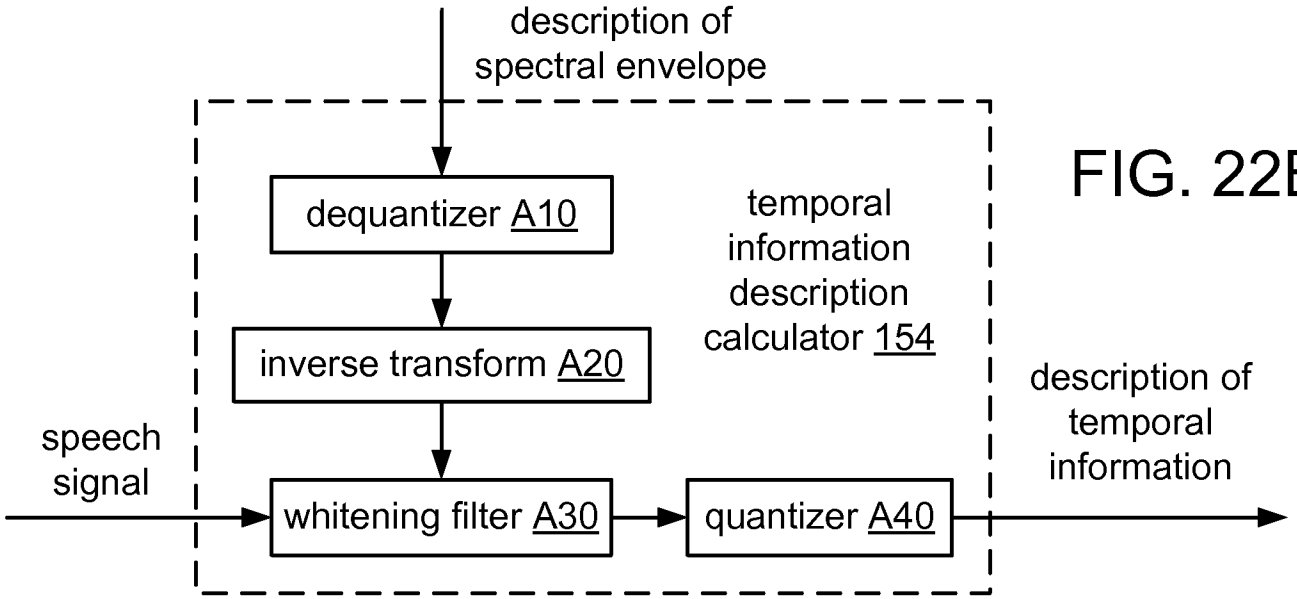
FIG. 22B shows a block diagram of an implementation 154 of temporal information description calculator 152.

FIG. 22B shows a block diagram of an implementation 154 of temporal information description calculator 152 that is configured to calculate a description of temporal information based on an LPC residual for the frame. In this example, calculator 154 is arranged to receive the description of a spectral envelope of the frame as calculated by spectral envelope description calculator 142. Dequantizer A10 is configured to dequantize the description, and inverse transform block A20 is configured to apply an inverse transform to the dequantized description to obtain a set of LPC coefficients. Whitening filter A30 is configured according to the set of LPC coefficients and arranged to filter the speech signal to produce an LPC residual. Quantizer A40 is configured to quantize a description of temporal information for the frame (e.g., as one or more table indices) that is based on the LPC residual and is possibly also based on pitch information for the frame and/or temporal information from one or more past frames.

It may be desirable to use an implementation of speech encoder 132 to encode frames of a wideband speech signal according to a split-band coding scheme. In such case, spectral envelope description calculator 140 may be configured to calculate the various descriptions of spectral envelopes of a frame over the respective frequency bands serially and/or in parallel and possibly according to different coding modes and/or rates. Temporal information description calculator 150 may also be configured to calculate descriptions of temporal information of the frame over the various frequency bands serially and/or in parallel and possibly according to different coding modes and/or rates.

Figure 23A:
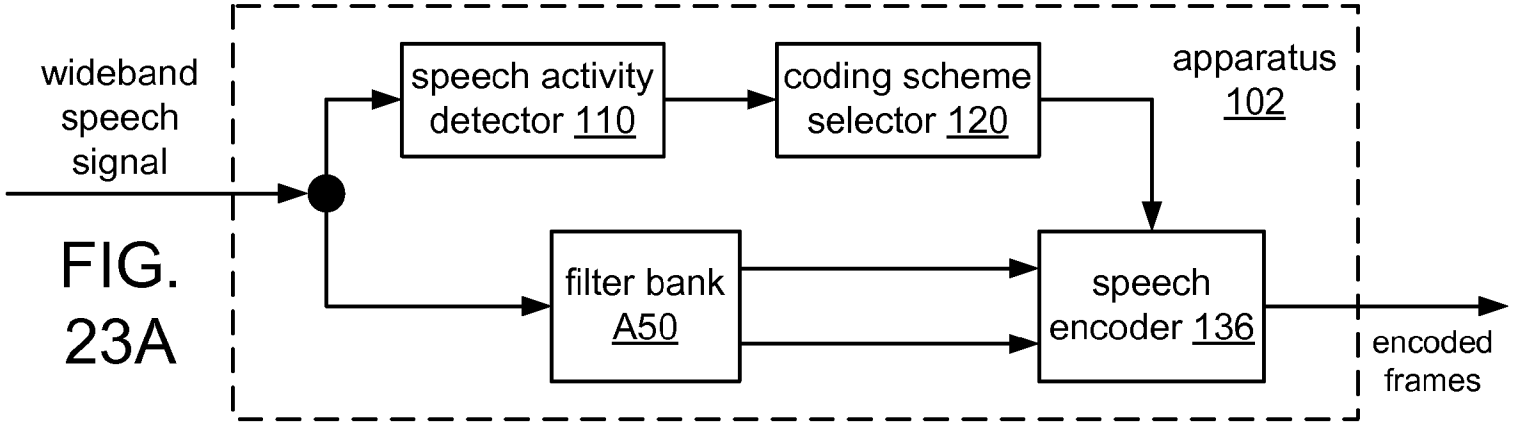
FIG. 23A shows a block diagram of an implementation 102 of apparatus 100 that is configured to encode a wideband speech signal according to a split-band coding scheme.

FIG. 23A shows a block diagram of an implementation 102 of apparatus 100 that is configured to encode a wideband speech signal according to a split-band coding scheme. Apparatus 102 includes a filter bank A50 that is configured to filter the speech signal to produce a subband signal containing content of the speech signal over the first frequency band (e.g., a narrowband signal) and a subband signal containing content of the speech signal over the second frequency band (e.g., a highband signal). Particular examples of such filter banks are described in, e.g., U.S. Pat. Appl. Publ. No. 2007/088558 (Vos et al.), "SYSTEMS, METHODS, AND APPARATUS FOR SPEECH SIGNAL FILTERING," published Apr. 19, 2007. For example, filter bank A50 may include a lowpass filter configured to filter the speech signal to produce a narrowband signal and a highpass filter configured to filter the speech signal to produce a highband signal. Filter bank A50 may also include a downsampler configured to reduce the sampling rate of the narrowband signal and/or of the highband signal according to a desired respective decimation factor, as described in, e.g., U.S. Pat. Appl. Publ. No. 2007/088558 (Vos et al.). Apparatus 102 may also be configured to perform a noise suppression operation on at least the highband signal, such as a highband burst suppression operation as described in U.S. Pat. Appl. Publ. No. 2007/088541 (Vos et al.), "SYSTEMS, METHODS, AND APPARATUS FOR HIGHBAND BURST SUPPRESSION," published Apr. 19, 2007.

Figure 23B:
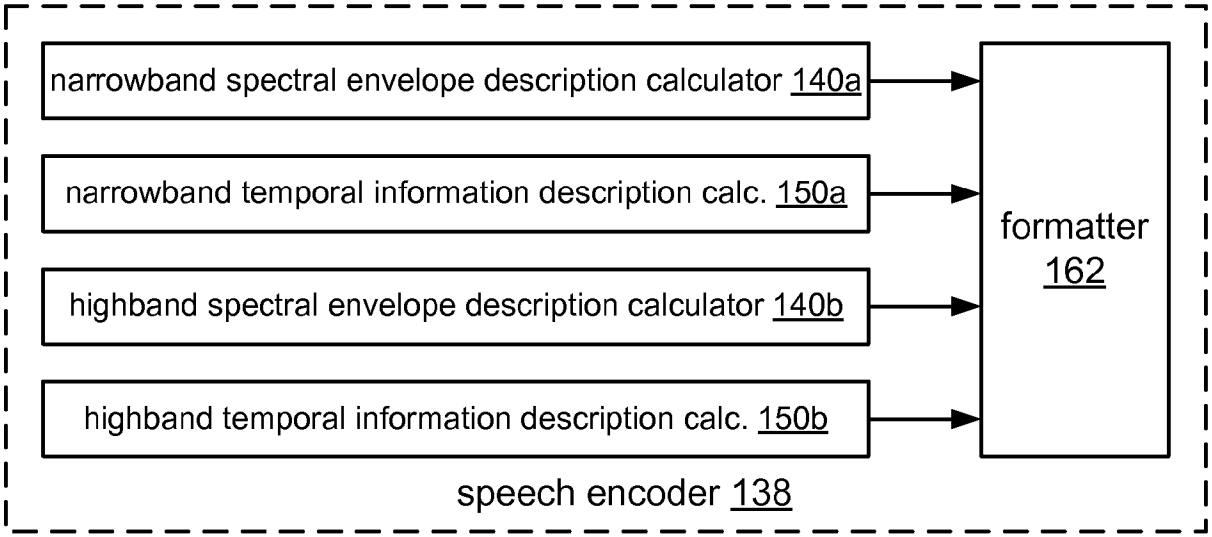
FIG. 23B shows a block diagram of an implementation 138 of speech encoder 136.

Apparatus 102 also includes an implementation 136 of speech encoder 130 that is configured to encode the separate subband signals according to a coding scheme selected by coding scheme selector 120. FIG. 23B shows a block diagram of an implementation 138 of speech encoder 136. Encoder 138 includes a spectral envelope calculator 140*a* (e.g., an instance of calculator 142) and a temporal information calculator 150*a* (e.g., an instance of calculator 152 or 154) that are configured to calculate descriptions of spectral envelopes and temporal information, respectively, based on a narrowband signal produced by filter band A50 and according to the selected coding scheme. Encoder 138 also includes a spectral envelope calculator 140*b* (e.g., an instance of calculator 142) and a temporal information calculator 150*b* (e.g., an instance of calculator 152 or 154) that are configured to produce calculated descriptions of spectral envelopes and temporal information, respectively, based on a highband signal produced by filter band A50 and according to the selected coding scheme. Encoder 138 also includes an implementation 162 of formatter 160 configured to produce an encoded frame that includes the calculated descriptions of spectral envelopes and temporal information.

Figure 24A:
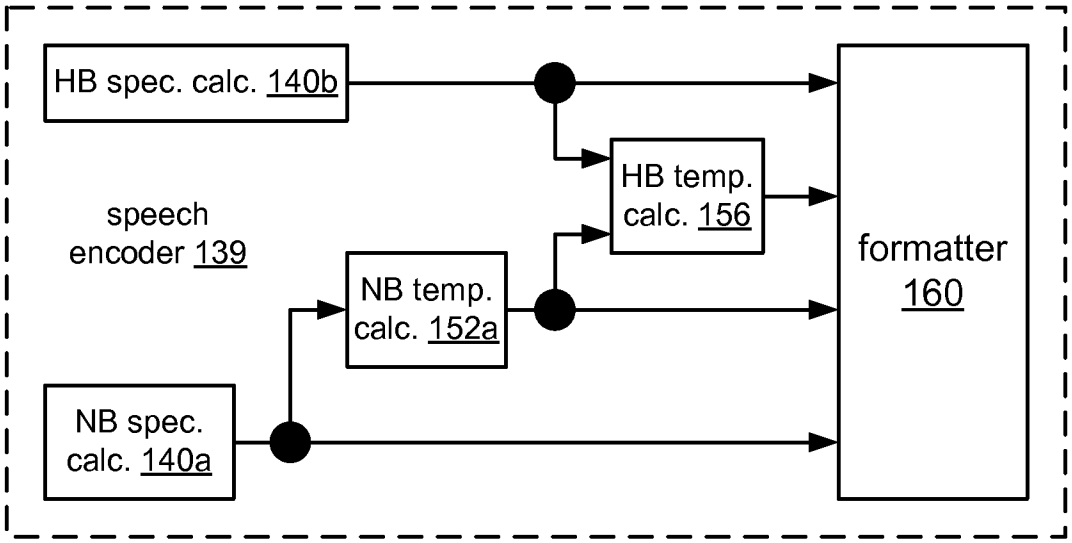
FIG. 24A shows a block diagram of an implementation 139 of wideband speech encoder 136.

As noted above, a description of temporal information for the highband portion of a wideband speech signal may be based on a description of temporal information for the narrowband portion of the signal. FIG. 24A shows a block diagram of a corresponding implementation 139 of wideband speech encoder 136. Like speech encoder 138 described above, encoder 139 includes spectral envelope description calculators 140*a* and 140*b* that are arranged to calculate respective descriptions of spectral envelopes. Speech encoder 139 also includes an instance 152*a* of temporal information description calculator 152 (e.g., calculator 154) that is arranged to calculate a description of temporal information based on the calculated description of a spectral envelope for the narrowband signal. Speech encoder 139 also includes an implementation 156 of temporal information description calculator 150. Calculator 156 is configured to calculate a description of temporal information for the highband signal that is based on a description of temporal information for the narrowband signal.

Figure 24B:
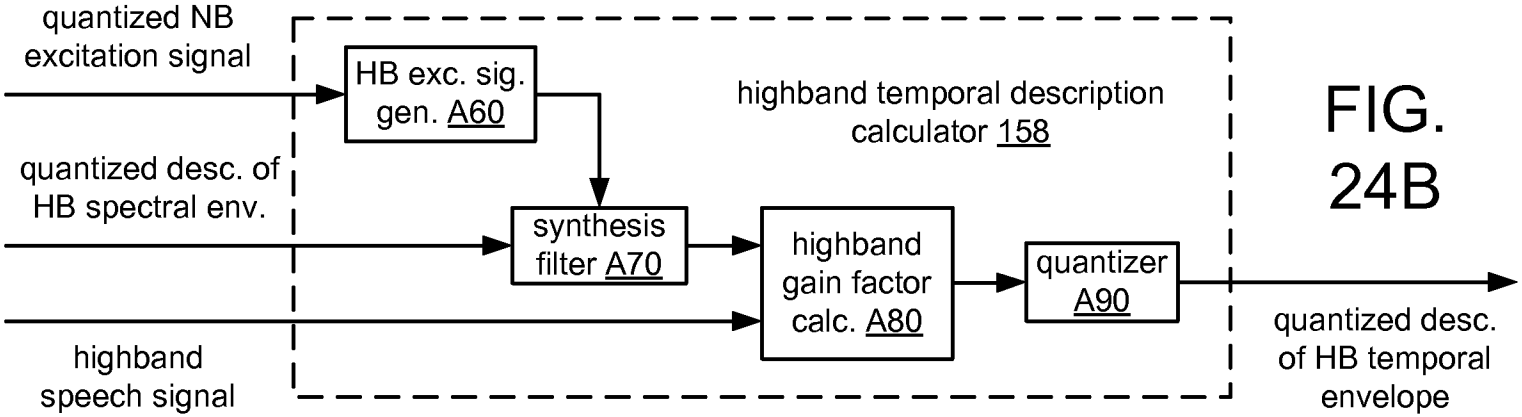
FIG. 24B shows a block diagram of an implementation 158 of temporal description calculator 156.

FIG. 24B shows a block diagram of an implementation 158 of temporal description calculator 156. Calculator 158 includes a highband excitation signal generator A60 that is configured to generate a highband excitation signal based on a narrowband excitation signal as produced by calculator 152*a*. For example, generator A60 may be configured to perform an operation such as spectral extension, harmonic extension, nonlinear extension, spectral folding, and/or spectral translation on the narrowband excitation signal (or one or more components thereof) to generate the highband excitation signal. Additionally or in the alternative, generator A60 may be configured to perform spectral and/or amplitude shaping of random noise (e.g., a pseudorandom Gaussian noise signal) to generate the highband excitation signal. For a case in which generator A60 uses a pseudorandom noise signal, it may be desirable to synchronize generation of this signal by the encoder and the decoder. Such methods of and apparatus for highband excitation signal generation are described in more detail in, for example, U.S. Pat. Appl. Pub. 2007/0088542 (Vos et al.), "SYSTEMS, METHODS, AND APPARATUS FOR WIDEBAND SPEECH CODING," published Apr. 19, 2007. In the example of FIG. 24B, generator A60 is arranged to receive a quantized narrowband excitation signal. In another example, generator A60 is arranged to receive the narrowband excitation signal in another form (e.g., in a pre-quantization or dequantized form).

Calculator 158 also includes a synthesis filter A70 configured to generate a synthesized highband signal that is based on the highband excitation signal and a description of a spectral envelope of the highband signal (e.g., as produced by calculator 140*b*). Filter A70 is typically configured according to a set of values within the description of a spectral envelope of the highband signal (e.g., one or more LSP or LPC coefficient vectors) to produce the synthesized highband signal in response to the highband excitation signal. In the example of FIG. 24B, synthesis filter A70 is arranged to receive a quantized description of a spectral envelope of the highband signal and may be configured accordingly to include a dequantizer and possibly an inverse transform block. In another example, filter A70 is arranged to receive the description of a spectral envelope of the highband signal in another form (e.g., in a pre-quantization or dequantized form).

Calculator 158 also includes a highband gain factor calculator A80 that is configured to calculate a description of a temporal envelope of the highband signal based on a temporal envelope of the synthesized highband signal. Calculator A80 may be configured to calculate this description to include one or more distances between a temporal envelope of the highband signal and the temporal envelope of the synthesized highband signal. For example, calculator A80 may be configured to calculate such a distance as a gain frame value (e.g., as a ratio between measures of energy of corresponding frames of the two signals, or as a square root of such a ratio). Additionally or in the alternative, calculator A80 may be configured to calculate a number of such distances as gain shape values (e.g., as ratios between measures of energy of corresponding subframes of the two signals, or as square roots of such ratios). In the example of FIG. 24B, calculator 158 also includes a quantizer A90 configured to quantize the calculated description of a temporal envelope (e.g., as one or more codebook indices). Various features and implementations of the elements of calculator 158 are described in, for example, U.S. Pat. Appl. Pub. 2007/0088542 (Vos et al.) as cited above.

The various elements of an implementation of apparatus 100 may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of apparatus 100 as described herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of apparatus 100 may also be embodied as one or more computers (e.g., machines including one or more arrays programmed to execute one or more sets or sequences of instructions, also called "processors"), and any two or more, or even all, of these elements may be implemented within the same such computer or computers.

The various elements of an implementation of apparatus 100 may be included within a device for wireless communications such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as interleaving, puncturing, convolution coding, error correction coding, coding of one or more layers of network protocol (e.g., Ethernet, TCP/IP, cdma2000), radio-frequency (RF) modulation, and/or RF transmission.

It is possible for one or more elements of an implementation of apparatus 100 to be used to perform tasks or execute other sets of instructions that are not directly related to an operation of the apparatus, such as a task relating to another operation of a device or system in which the apparatus is embedded. It is also possible for one or more elements of an implementation of apparatus 100 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, speech activity detector 110, coding scheme selector 120, and speech encoder 130 are implemented as sets of instructions arranged to execute on the same processor. In another such example, spectral envelope description calculators 140*a* and 140*b* are implemented as the same set of instructions executing at different times.

Figure 25A:
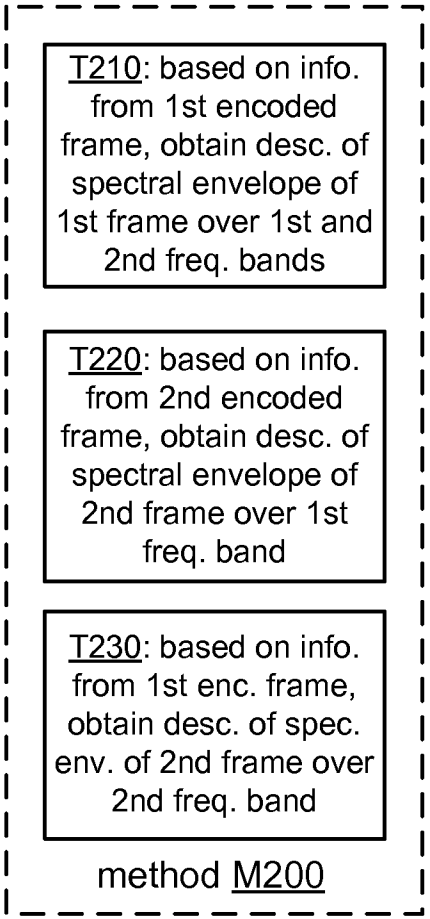
FIG. 25A shows a flowchart of a method M200 of processing an encoded speech signal according to a general configuration.

FIG. 25A shows a flowchart of a method M200 of processing an encoded speech signal according to a general configuration. Method M200 is configured to receive information from two encoded frames and to produce descriptions of spectral envelopes of two corresponding frames of a speech signal. Based on information from a first encoded frame (also called the "reference" encoded frame), task T210 obtains a description of a spectral envelope of a first frame of the speech signal over the first and second frequency bands. Based on information from a second encoded frame, task T220 obtains a description of a spectral envelope of a second frame of the speech signal (also called the "target" frame) over the first frequency band. Based on information from the reference encoded frame, task T230 obtains a description of a spectral envelope of the target frame over the second frequency band.

Figure 26:
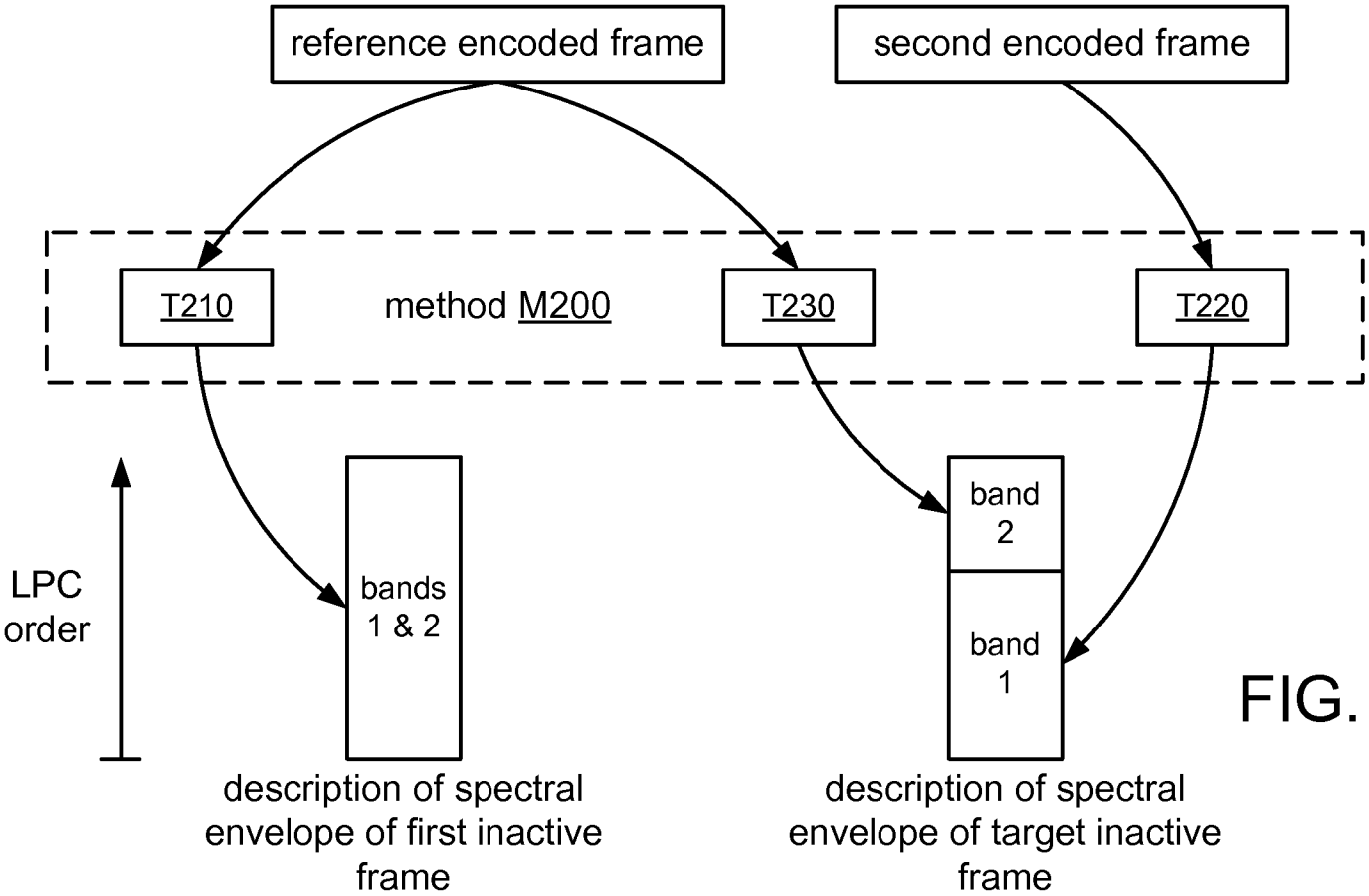
FIG. 26 shows an application of method M200.

FIG. 26 shows an application of method M200 that receives information from two encoded frames and produces descriptions of spectral envelopes of two corresponding inactive frames of a speech signal. Based on information from the reference encoded frame, task T210 obtains a description of a spectral envelope of the first inactive frame over the first and second frequency bands. This description may be a single description that extends over both frequency bands, or it may include separate descriptions that each extend over a respective one of the frequency bands. Based on information from the second encoded frame, task T220 obtains a description of a spectral envelope of the target inactive frame over the first frequency band (e.g., over a narrowband range). Based on information from the reference encoded frame, task T230 obtains a description of a spectral envelope of the target inactive frame over the second frequency band (e.g., over a highband range).

FIG. 26 shows an example in which the descriptions of the spectral envelopes have LPC orders, and in which the LPC order of the description of the spectral envelope of the target frame over the second frequency band is less than the LPC order of the description of the spectral envelope of the target frame over the first frequency band. Other examples include cases in which the LPC order of the description of the spectral envelope of the target frame over the second frequency band is at least fifty percent of, at least sixty percent of, not more than seventy-five percent of, not more than eighty percent of, equal to, and greater than the LPC order of the description of the spectral envelope of the target frame over the first frequency band. In a particular example, the LPC orders of the descriptions of the spectral envelope of the target frame over the first and second frequency bands are, respectively, ten and six. FIG. 26 also shows an example in which the LPC order of the description of the spectral envelope of the first inactive frame over the first and second frequency bands is equal to the sum of the LPC orders of the descriptions of the spectral envelope of the target frame over the first and second frequency bands. In another example, the LPC order of the description of the spectral envelope of the first inactive frame over the first and second frequency bands may be greater or less than the sum of the LPC orders of the descriptions of the spectral envelopes of the target frame over the first and second frequency bands Each of the tasks T210 and T220 may be configured to include one or both of the following two operations: parsing the encoded frame to extract a quantized description of a spectral envelope, and dequantizing a quantized description of a spectral envelope to obtain a set of parameters of a coding model for the frame. Typical implementations of tasks T210 and T220 include both of these operations, such that each task processes a respective encoded frame to produce a description of a spectral envelope in the form of a set of model parameters (e.g., one or more LSF, LSP, ISF, ISP, and/or LPC coefficient vectors). In one particular example, the reference encoded frame has a length of eighty bits and the second encoded frame has a length of sixteen bits. In other examples, the length of the second encoded frame is not more than twenty, twenty-five, thirty, forty, fifty, or sixty percent of the length of the reference encoded frame.

The reference encoded frame may include a quantized description of a spectral envelope over the first and second frequency bands, and the second encoded frame may include a quantized description of a spectral envelope over the first frequency band. In one particular example, the quantized description of a spectral envelope over the first and second frequency bands included in the reference encoded frame has a length of forty bits, and the quantized description of a spectral envelope over the first frequency band included in the second encoded frame has a length of ten bits. In other examples, the length of the quantized description of a spectral envelope over the first frequency band included in the second encoded frame is not greater than twenty-five, thirty, forty, fifty, or sixty percent of the length of the quantized description of a spectral envelope over the first and second frequency bands included in the reference encoded frame.

Tasks T210 and T220 may also be implemented to produce descriptions of temporal information based on information from the respective encoded frames. For example, one or both of these tasks may be configured to obtain, based on information from the respective encoded frame, a description of a temporal envelope, a description of an excitation signal, and/or a description of pitch information. As in obtaining the description of a spectral envelope, such a task may include parsing a quantized description of temporal information from the encoded frame and/or dequantizing a quantized description of temporal information. Implementations of method M200 may also be configured such that task T210 and/or task T220 obtains the description of a spectral envelope and/or the description of temporal information based on information from one or more other encoded frames as well, such as information from one or more previous encoded frames. For example, a description of an excitation signal and/or pitch information of a frame is typically based on information from previous frames.

The reference encoded frame may include a quantized description of temporal information for the first and second frequency bands, and the second encoded frame may include a quantized description of temporal information for the first frequency band. In one particular example, a quantized description of temporal information for the first and second frequency bands included in the reference encoded frame has a length of thirty-four bits, and a quantized description of temporal information for the first frequency band included in the second encoded frame has a length of five bits. In other examples, the length of the quantized description of temporal information for the first frequency band included in the second encoded frame is not greater than fifteen, twenty, twenty-five, thirty, forty, fifty, or sixty percent of the length of the quantized description of temporal information for the first and second frequency bands included in the reference encoded frame.

Figure 27A:
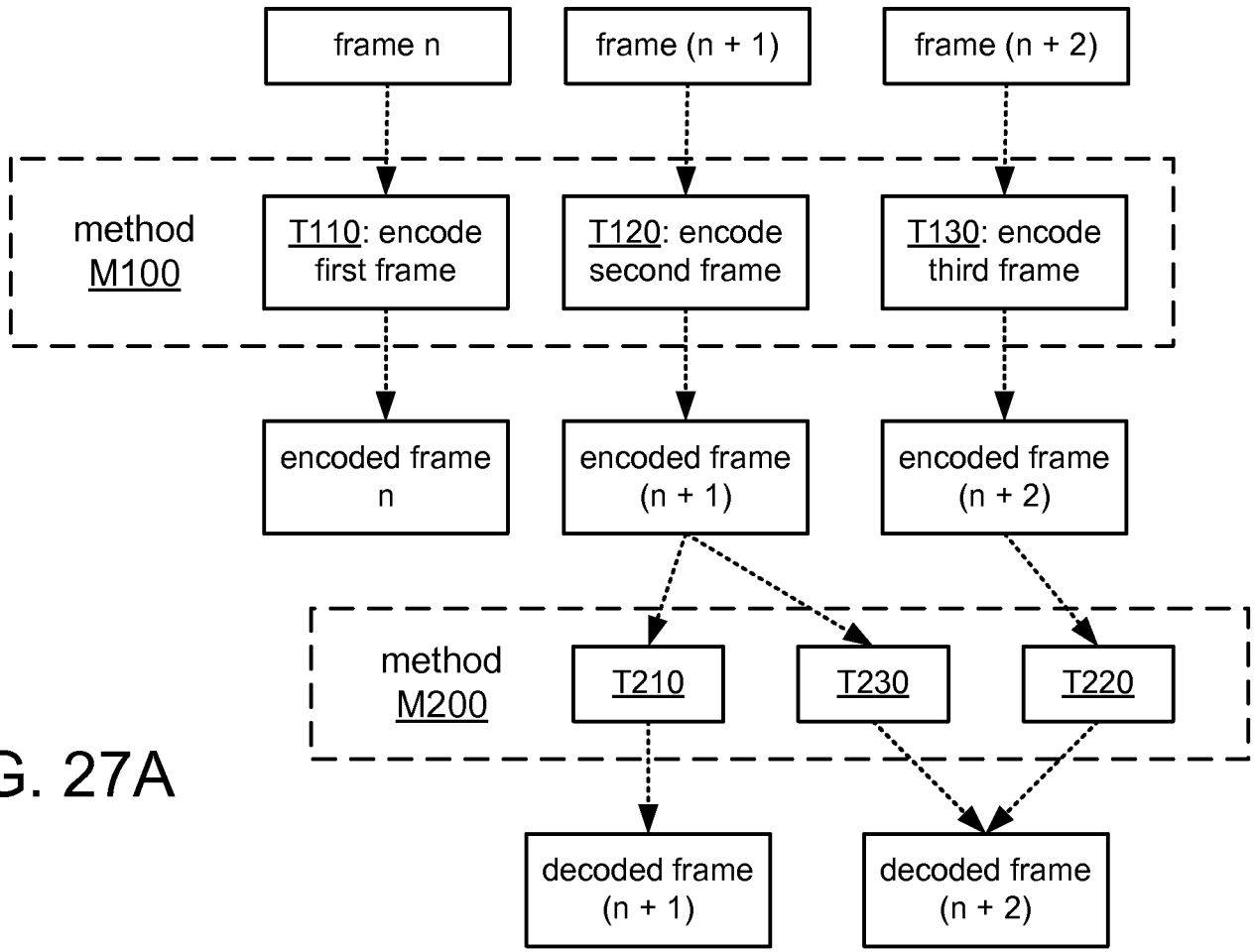
FIG. 27A illustrates a relation between methods M100 and M200.
Figure 27B:
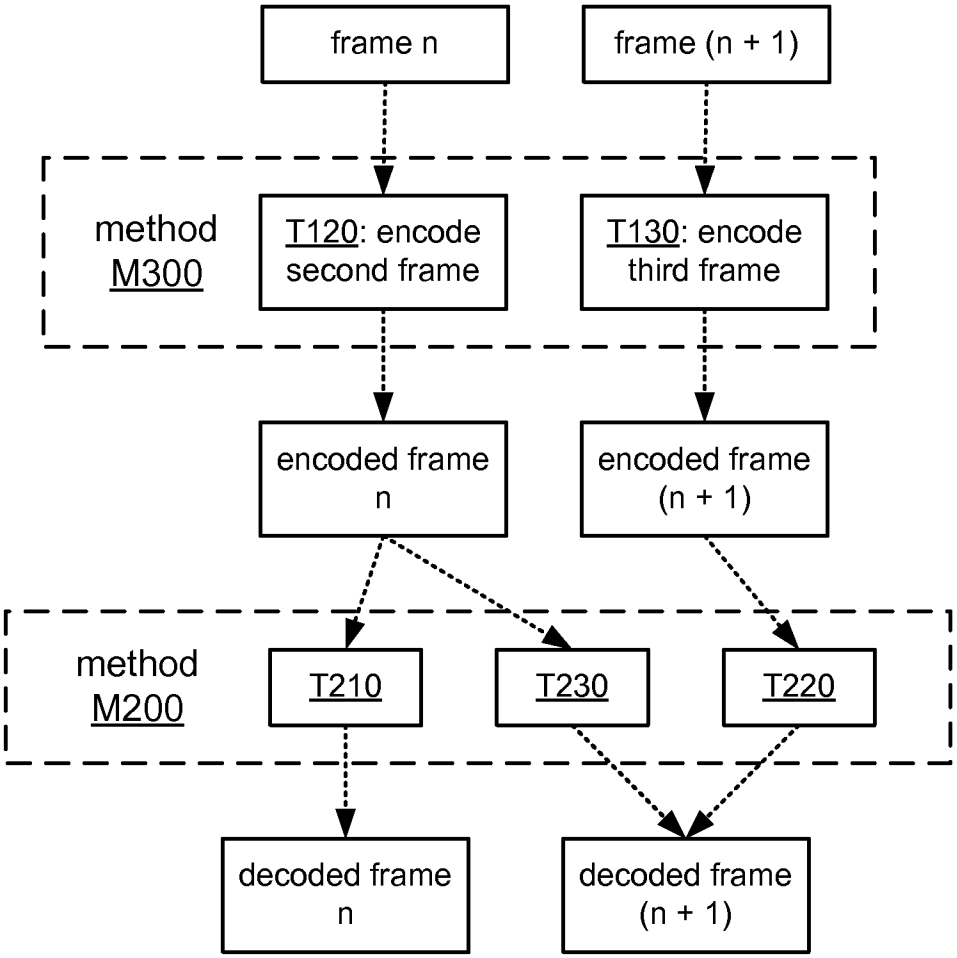
FIG. 27B illustrates a relation between methods M300 and M200.

Method M200 is typically performed as part of a larger method of speech decoding, and speech decoders and methods of speech decoding that are configured to perform method M200 are expressly contemplated and hereby disclosed. A speech coder may be configured to perform an implementation of method M100 at the encoder and to perform an implementation of method M200 at the decoder. In such case, the "second frame" as encoded by task T120 corresponds to the reference encoded frame which supplies the information processed by tasks T210 and T230, and the "third frame" as encoded by task T130 corresponds to the encoded frame which supplies the information processed by task T220. FIG. 27A illustrates this relation between methods M100 and M200 using the example of a series of consecutive frames encoded using method M100 and decoded using method M200. Alternatively, a speech coder may be configured to perform an implementation of method M300 at the encoder and to perform an implementation of method M200 at the decoder. FIG. 27B illustrates this relation between methods M300 and M200 using the example of a pair of consecutive frames encoded using method M300 and decoded using method M200.

It is noted, however, that method M200 may also be applied to process information from encoded frames that are not consecutive. For example, method M200 may be applied such that tasks T220 and T230 process information from respective encoded frames that are not consecutive. Method M200 is typically implemented such that task T230 iterates with respect to a reference encoded frame, and task T220 iterates over a series of successive encoded inactive frames that follow the reference encoded frame, to produce a corresponding series of successive target frames. Such iteration may continue, for example, until a new reference encoded frame is received, until an encoded active frame is received, and/or until a maximum number of target frames has been produced.

Task T220 is configured to obtain the description of a spectral envelope of the target frame over the first frequency band based at least primarily on information from the second encoded frame. For example, task T220 may be configured to obtain the description of a spectral envelope of the target frame over the first frequency band based entirely on information from the second encoded frame. Alternatively, task T220 may be configured to obtain the description of a spectral envelope of the target frame over the first frequency band based on other information as well, such as information from one or more previous encoded frames. In such case, task T220 is configured to weight the information from the second encoded frame more heavily than the other information. For example, such an implementation of task T220 may be configured to calculate the description of a spectral envelope of the target frame over the first frequency band as an average of the information from the second encoded frame and information from a previous encoded frame, in which the information from the second encoded frame is weighted more heavily than the information from the previous encoded frame. Likewise, task T220 may be configured to obtain a description of temporal information of the target frame for the first frequency band based at least primarily on information from the second encoded frame.

Figure 25B:
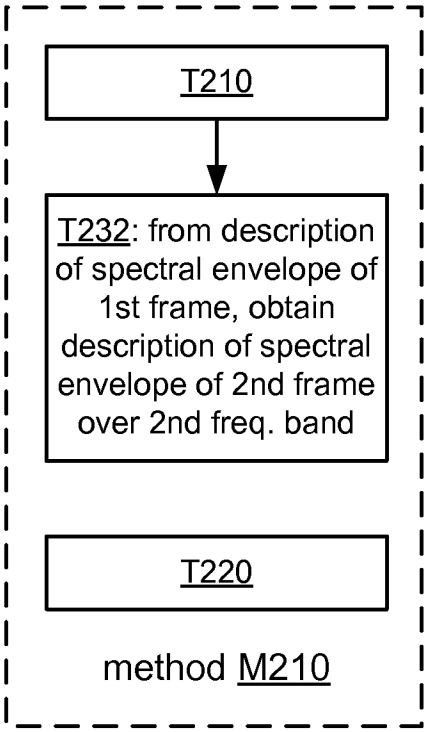
FIG. 25B shows a flowchart of an implementation M210 of method M200.
Figure 28:
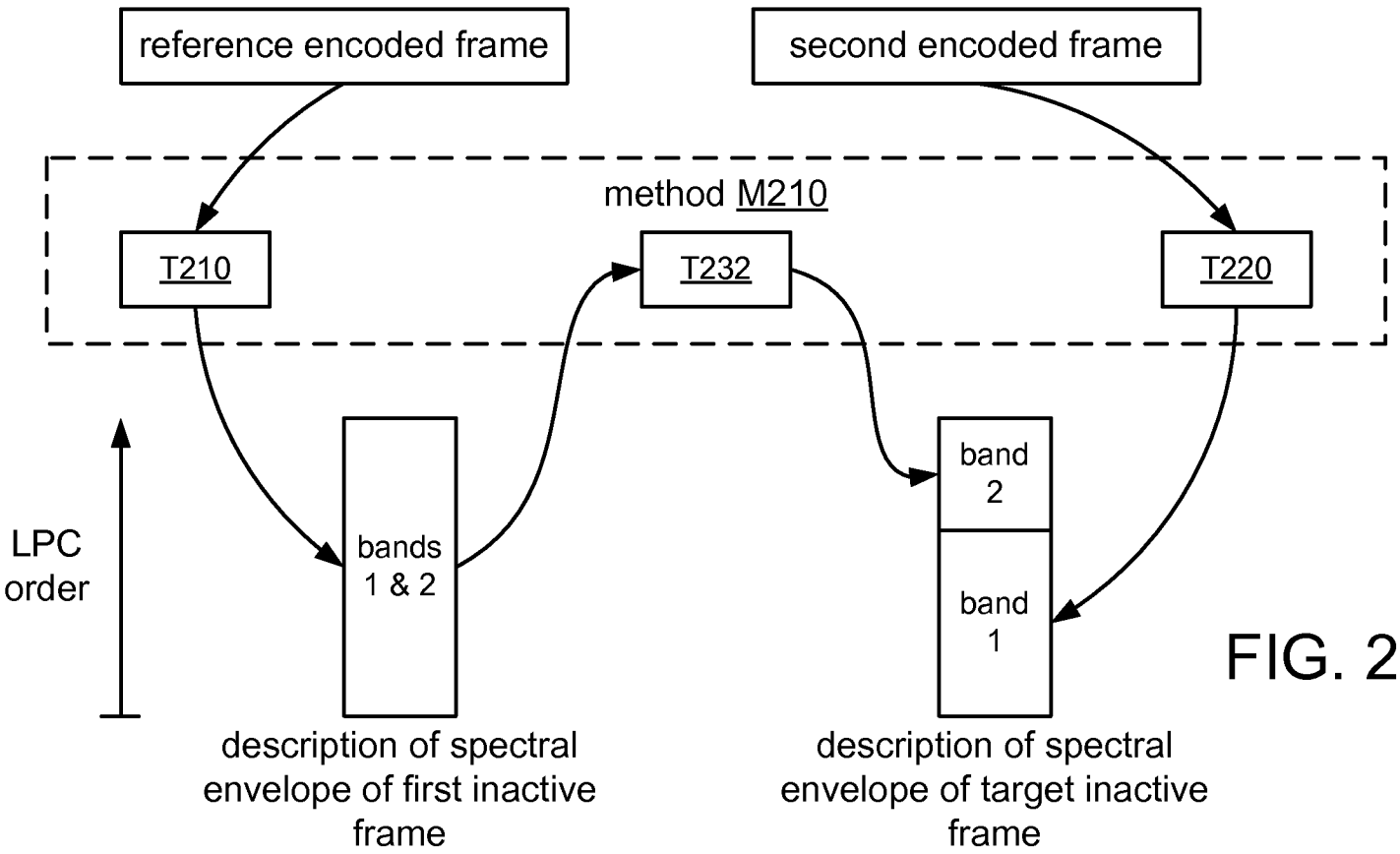
FIG. 28 shows an application of method M210.

Based on information from the reference encoded frame (also called herein "reference spectral information"), task T230 obtains a description of a spectral envelope of the target frame over the second frequency band. FIG. 25B shows a flowchart of an implementation M210 of method M200 that includes an implementation T232 of task T230. As an implementation of task T230, task T232 obtains a description of a spectral envelope of the target frame over the second frequency band, based on the reference spectral information. In this case, the reference spectral information is included within a description of a spectral envelope of a first frame of the speech signal. FIG. 28 shows an application of method M210 that receives information from two encoded frames and produces descriptions of spectral envelopes of two corresponding inactive frames of a speech signal.

Task T230 is configured to obtain the description of a spectral envelope of the target frame over the second frequency band based at least primarily on the reference spectral information. For example, task T230 may be configured to obtain the description of a spectral envelope of the target frame over the second frequency band based entirely on the reference spectral information. Alternatively, task T230 may be configured to obtain the description of a spectral envelope of the target frame over the second frequency band based on (A) a description of a spectral envelope over the second frequency band that is based on the reference spectral information and (B) a description of a spectral envelope over the second frequency band that is based on information from the second encoded frame.

In such case, task T230 may be configured to weight the description based on the reference spectral information more heavily than the description based on information from the second encoded frame. For example, such an implementation of task T230 may be configured to calculate the description of a spectral envelope of the target frame over the second frequency band as an average of descriptions based on the reference spectral information and information from the second encoded frame, in which the description based on the reference spectral information is weighted more heavily than the description based on information from the second encoded frame. In another case, an LPC order of the description based on the reference spectral information may be greater than an LPC order of the description based on information from the second encoded frame. For example, the LPC order of the description based on information from the second encoded frame may be one (e.g., a spectral tilt value). Likewise, task T230 may be configured to obtain a description of temporal information of the target frame for the second frequency band based at least primarily on the reference temporal information (e.g., based entirely on the reference temporal information, or based also and in lesser part on information from the second encoded frame).

Task T210 may be implemented to obtain, from the reference encoded frame, a description of a spectral envelope that is a single full-band representation over both of the first and second frequency bands. It is more typical, however, to implement task T210 to obtain this description as separate descriptions of a spectral envelope over the first frequency band and over the second frequency band. For example, task T210 may be configured to obtain the separate descriptions from a reference encoded frame that has been encoded using a split-band coding scheme as described herein (e.g., coding scheme 2).

Figure 25C:
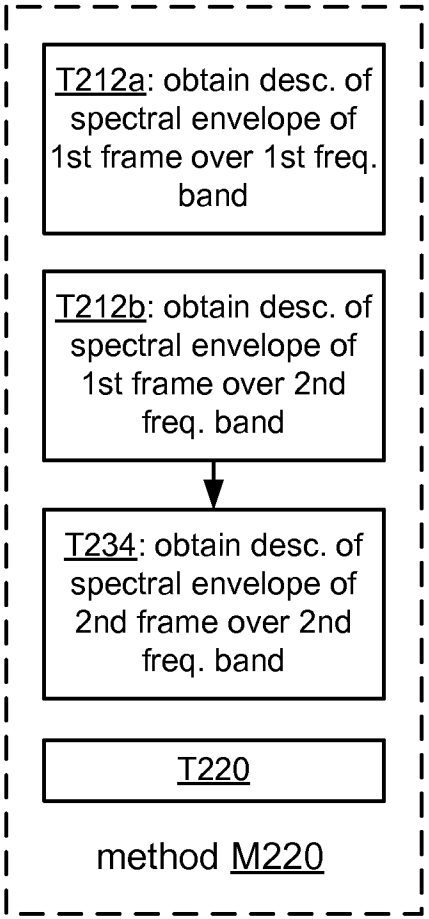
FIG. 25C shows a flowchart of an implementation M220 of method M210.
Figure 29:
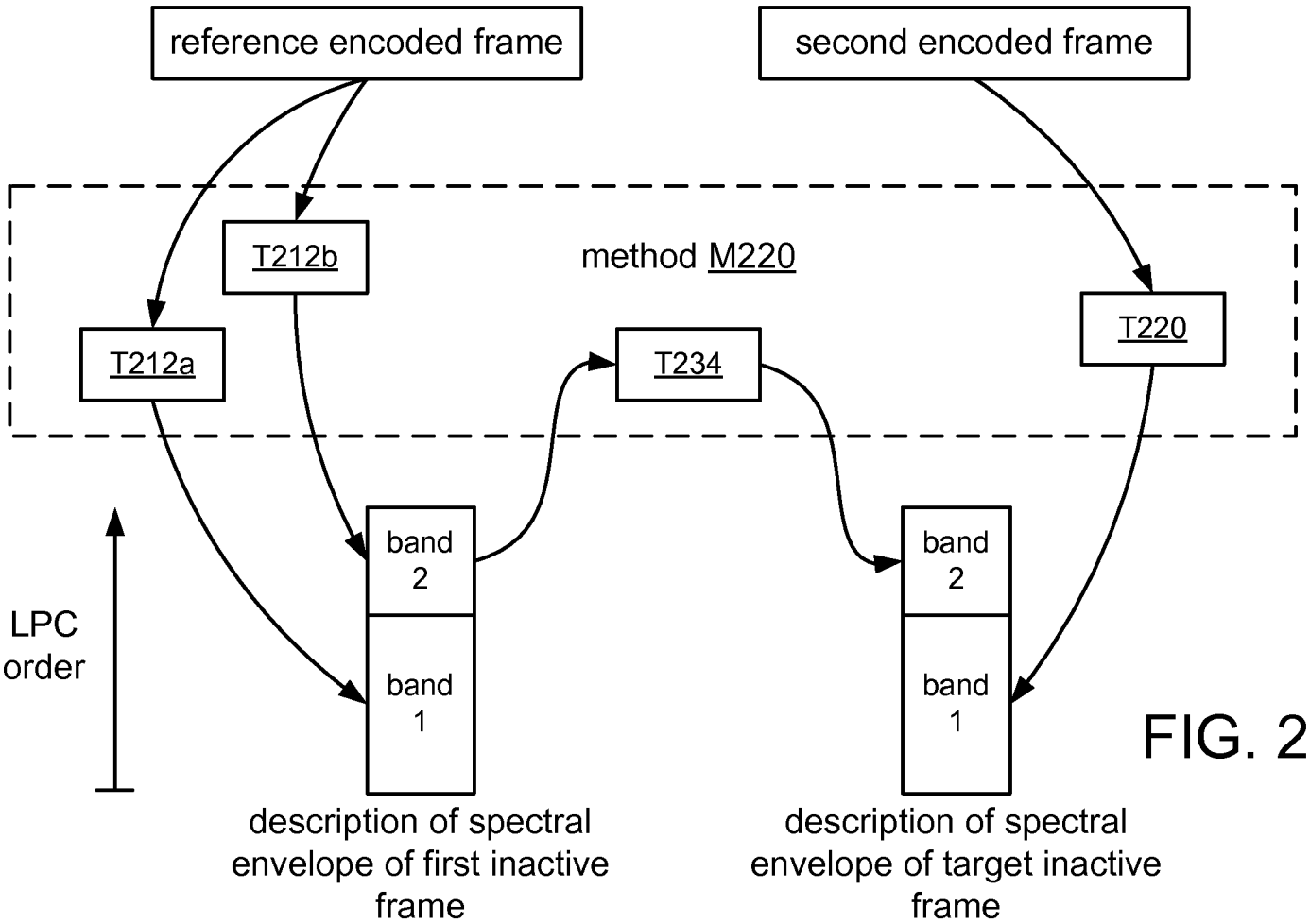
FIG. 29 shows an application of method M220.

FIG. 25C shows a flowchart of an implementation M220 of method M210 in which task T210 is implemented as two tasks T212*a* and T212*b*. Based on information from the reference encoded frame, task T212*a* obtains a description of a spectral envelope of the first frame over the first frequency band. Based on information from the reference encoded frame, task T212*b* obtains a description of a spectral envelope of the first frame over the second frequency band. Each of tasks T212*a* and T212*b* may include parsing a quantized description of a spectral envelope from the respective encoded frame and/or dequantizing a quantized description of a spectral envelope. FIG. 29 shows an application of method M220 that receives information from two encoded frames and produces descriptions of spectral envelopes of two corresponding inactive frames of a speech signal.

Method M220 also includes an implementation T234 of task T232. As an implementation of task T230, task T234 obtains a description of a spectral envelope of the target frame over the second frequency band that is based on the reference spectral information. As in task T232, the reference spectral information is included within a description of a spectral envelope of a first frame of the speech signal. In the particular case of task T234, the reference spectral information is included within (and is possibly the same as) a description of a spectral envelope of the first frame over the second frequency band.

FIG. 29 shows an example in which the descriptions of the spectral envelopes have LPC orders, and in which the LPC orders of the descriptions of spectral envelopes of the first inactive frame over the first and second frequency bands are equal to the LPC orders of the descriptions of spectral envelopes of the target inactive frame over the respective frequency bands. Other examples include cases in which one or both of the descriptions of spectral envelopes of the first inactive frame over the first and second frequency bands are greater than the corresponding description of a spectral envelope of the target inactive frame over the respective frequency band.

The reference encoded frame may include a quantized description of a description of a spectral envelope over the first frequency band and a quantized description of a description of a spectral envelope over the second frequency band. In one particular example, a quantized description of a description of a spectral envelope over the first frequency band included in the reference encoded frame has a length of twenty-eight bits, and a quantized description of a description of a spectral envelope over the second frequency band included in the reference encoded frame has a length of twelve bits. In other examples, the length of the quantized description of a description of a spectral envelope over the second frequency band included in the reference encoded frame is not greater than forty-five, fifty, sixty, or seventy percent of the length of the quantized description of a description of a spectral envelope over the first frequency band included in the reference encoded frame.

The reference encoded frame may include a quantized description of a description of temporal information for the first frequency band and a quantized description of a description of temporal information for the second frequency band. In one particular example, a quantized description of a description of temporal information for the second frequency band included in the reference encoded frame has a length of fifteen bits, and a quantized description of a description of temporal information for the first frequency band included in the reference encoded frame has a length of nineteen bits. In other examples, the length of the quantized description of temporal information for the second frequency band included in the reference encoded frame is not greater than eighty or ninety percent of the length of the quantized description of a description of temporal information for the first frequency band included in the reference encoded frame.

The second encoded frame may include a quantized description of a spectral envelope over the first frequency band and/or a quantized description of temporal information for the first frequency band. In one particular example, a quantized description of a description of a spectral envelope over the first frequency band included in the second encoded frame has a length of ten bits. In other examples, the length of the quantized description of a description of a spectral envelope over the first frequency band included in the second encoded frame is not greater than forty, fifty, sixty, seventy, or seventy-five percent of the length of the quantized description of a description of a spectral envelope over the first frequency band included in the reference encoded frame. In one particular example, a quantized description of a description of temporal information for the first frequency band included in the second encoded frame has a length of five bits. In other examples, the length of the quantized description of a description of temporal information for the first frequency band included in the second encoded frame is not greater than thirty, forty, fifty, sixty, or seventy percent of the length of the quantized description of a description of temporal information for the first frequency band included in the reference encoded frame.

In a typical implementation of method M200, the reference spectral information is a description of a spectral envelope over the second frequency band. This description may include a set of model parameters, such as one or more LSP, LSF, ISP, ISF, or LPC coefficient vectors. Generally this description is a description of a spectral envelope of the first inactive frame over the second frequency band as obtained from the reference encoded frame by task T210. It is also possible for the reference spectral information to include a description of a spectral envelope (e.g., of the first inactive frame) over the first frequency band and/or over another frequency band.

Task T230 typically includes an operation to retrieve the reference spectral information from an array of storage elements such as semiconductor memory (also called herein a "buffer"). For a case in which the reference spectral information includes a description of a spectral envelope over the second frequency band, the act of retrieving the reference spectral information may be sufficient to complete task T230. Even for such a case, however, it may be desirable to configure task T230 to calculate the description of a spectral envelope of the target frame over the second frequency band (also called herein the "target spectral description") rather than simply to retrieve it. For example, task T230 may be configured to calculate the target spectral description by adding random noise to the reference spectral information. Alternatively or additionally, task T230 may be configured to calculate the description based on spectral information from one or more additional encoded frames (e.g., based on information from more than one reference encoded frame). For example, task T230 may be configured to calculate the target spectral description as an average of descriptions of spectral envelopes over the second frequency band from two or more reference encoded frames, and such calculation may include adding random noise to the calculated average.

Task T230 may be configured to calculate the target spectral description by extrapolating in time from the reference spectral information or by interpolating in time between descriptions of spectral envelopes over the second frequency band from two or more reference encoded frames. Alternatively or additionally, task T230 may be configured to calculate the target spectral description by extrapolating in frequency from a description of a spectral envelope of the target frame over another frequency band (e.g., over the first frequency band) and/or by interpolating in frequency between descriptions of spectral envelopes over other frequency bands.

Typically the reference spectral information and the target spectral description are vectors of spectral parameter values (or "spectral vectors"). In one such example, both of the target and reference spectral vectors are LSP vectors. In another example, both of the target and reference spectral vectors are LPC coefficient vectors. In a further example, both of the target and reference spectral vectors are reflection coefficient vectors. Task T230 may be configured to copy the target spectral description from the reference spectral information according to an expression such as $s_{ti}=s_{ri}$ $\forall i \in \{1, 2, \ldots, n\}$, where $s_t$ is the target spectral vector, $s_r$ is the reference spectral vector (whose values are typically in the range of from −1 to +1), i is a vector element index, and n is the length of vector $s_t$. In a variation of this operation, task T230 is configured to apply a weighting factor (or a vector of weighting factors) to the reference spectral vector. In another variation of this operation, task T230 is configured to calculate the target spectral vector by adding random noise to the reference spectral vector according to an expression such as $s_{ti}=s_{ri}+z_i$ $\forall i \in \{1, 2, \ldots, n\}$, where z is a vector of random values. In such case, each element of z may be a random variable whose values are distributed (e.g., uniformly) over a desired range.

It may be desirable to ensure that the values of the target spectral description are bounded (e.g., within the range of from −1 to +1). In such case, task T230 may be configured to calculate the target spectral description according to an expression such as $s_{ti}=ws_{ri}+z_i$ $\forall i \in \{1, 2, \ldots, n\}$, where w has a value between zero and one (e.g., in the range of from 0.3 to 0.9) and the values of each element of z are distributed (e.g., uniformly) over the range of from −(1−w) to +(1−w).

In another example, task T230 is configured to calculate the target spectral description based on a description of a spectral envelope over the second frequency band from each of more than one reference encoded frame (e.g., from each of the two most recent reference encoded frames). In one such example, task T230 is configured to calculate the target spectral description as an average of the information from the reference encoded frames according to an expression such as $$s_{ti} = \left(\frac{s_{r1i} + s_{r2i}}{2}\right)$$

$\forall i \in \{1, 2, \ldots, n\}$, where $s_{r1}$ denotes the spectral vector from the most recent reference encoded frame, and $s_{r2}$ denotes the spectral vector from the next most recent reference encoded frame. In a related example, the reference vectors are weighted differently from each other (e.g., a vector from a more recent reference encoded frame may be more heavily weighted).

Figure 30A:
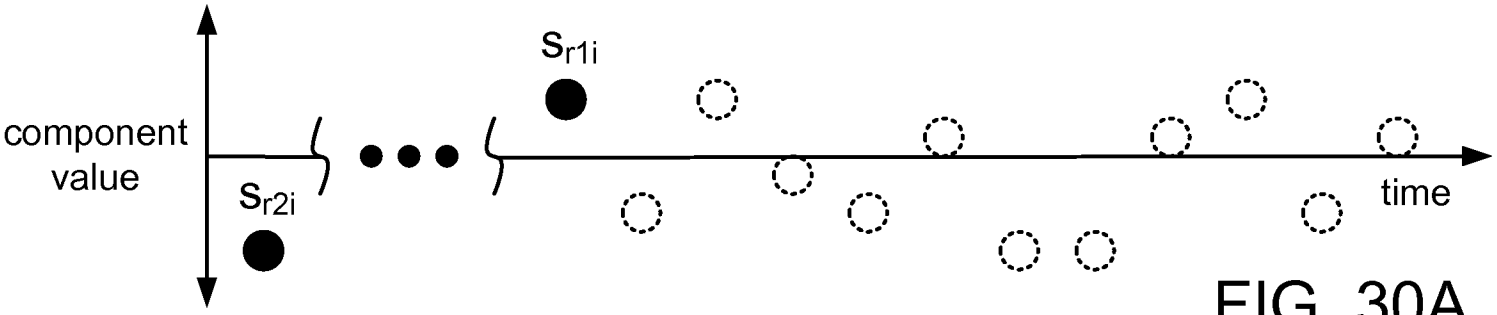
FIG. 30A illustrates a result of iterating an implementation of task T230.

In a further example, task T230 is configured to generate the target spectral description as a set of random values over a range based on information from two or more reference encoded frames. For example, task T230 may be configured to calculate the target spectral vector $s_t$ as a randomized average of spectral vectors from each of the two most recent reference encoded frames according to an expression such as $$s_{ti} = \left(\frac{s_{r1i} + s_{r2i}}{2}\right) + z_i\left(\frac{s_{r1i} - s_{r2i}}{2}\right) \forall\, i \in \{1, 2, \ldots, n\},$$

where the values of each element of z are distributed (e.g., uniformly) over the range of from −1 to +1. FIG. 30A illustrates a result (for one of the n values of i) of iterating such an implementation of task T230 for each of a series of consecutive target frames, with random vector z being reevaluated for each iteration, where the open circles indicate the values $s_{ti}$.

Task T230 may be configured to calculate the target spectral description by interpolating between descriptions of spectral envelopes over the second frequency band from the two most recent reference frames. For example, task T230 may be configured to perform a linear interpolation over a series of p target frames, where p is a tunable parameter. In such case, task T230 may be configured to calculate the target spectral vector for the j-th target frame in the series according to an expression such as $$s_{ti}=\alpha s_{r1i}+(1-\alpha)s_{r2i} \forall i \in \{1,2, \ldots ,n\}, \text{ where}$$

$$\alpha = \frac{j-1}{p-1}$$

and $1 \le j \le p$

Figure 30B:
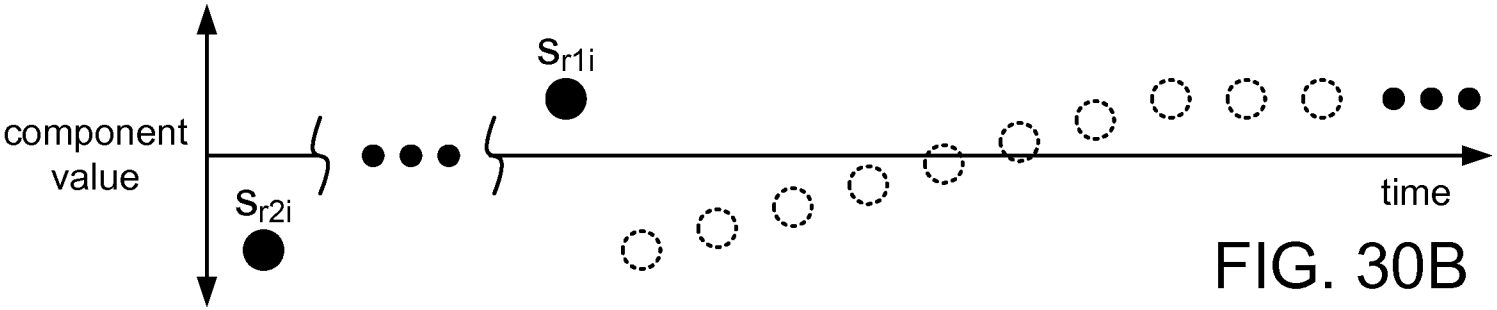
FIG. 30B illustrates a result of iterating another implementation of task T230.

FIG. 30B illustrates (for one of the n values of i) a result of iterating such an implementation of task T230 over a series of consecutive target frames, where p is equal to eight and each open circle indicates the value $s_{ti}$ for a corresponding target frame Other examples of values of p include 4, 16, and 32. It may be desirable to configure such an implementation of task T230 to add random noise to the interpolated description.

FIG. 30B also shows an example in which task T230 is configured to copy the reference vector $s_{r1}$ to the target vector $s_t$ for each subsequent target frame in a series longer than p (e.g., until a new reference encoded frame or the next active frame is received). In a related example, the series of target frames has a length mp, where m is an integer greater than one (e.g., two or three), and each of the p calculated vectors is used as the target spectral description for each of m corresponding consecutive target frames in the series.

Figure 30C:
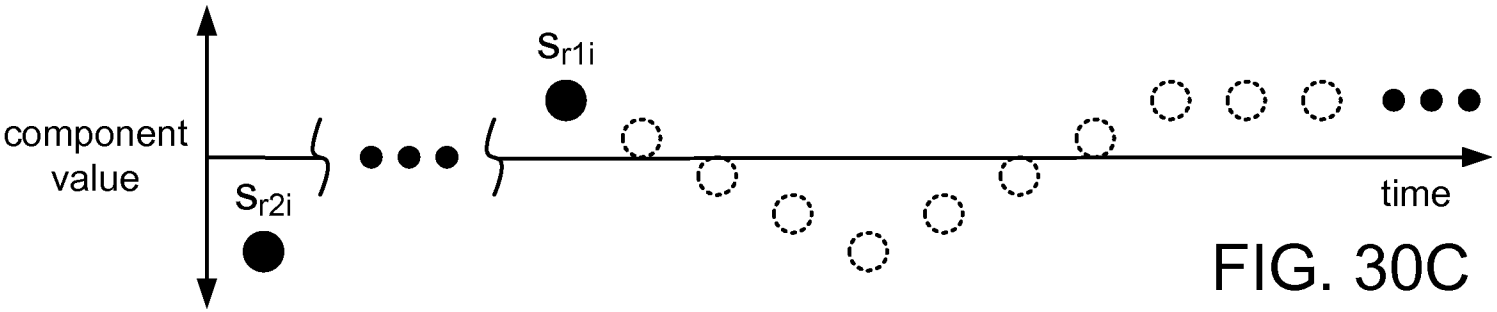
FIG. 30C illustrates a result of iterating a further implementation of task T230.

Task T230 may be implemented in many different ways to perform interpolation between descriptions of spectral envelopes over the second frequency band from the two most recent reference frames. In another example, task T230 is configured to perform a linear interpolation over a series of p target frames by calculating the target vector for the j-th target frame in the series according to a pair of expressions such as $$s_{ti}=\alpha_1 s_{r1i}+(1-\alpha)s_{r2i}, \text{ where}$$

$$\alpha_1 = \frac{q-j}{q},$$

for all integer j such that $0<j \le q$, and $$s_{ti}=(1-\alpha_2)s_{r1i}+\alpha_2 s_{r2i}, \text{ where}$$

$$\alpha_2 = \frac{p-j}{p-q}.$$

for all integer j such that $q<j \le p$. FIG. 30C illustrates a result (for one of the n values of i) of iterating such an implementation of task T230 for each of a series of consecutive target frames, where q has the value four and p has the value eight. Such a configuration may provide for a smoother transition into the first target frame than the result shown in FIG. 30B.

Task T230 may be implemented in a similar manner for any positive integer values of q and p; particular examples of values of (q, p) that may be used include (4, 8), (4, 12), (4, 16), (8, 16), (8, 24), (8, 32), and (16, 32). In a related example as described above, each of the p calculated vectors is used as the target spectral description for each of m corresponding consecutive target frames in a series of mp target frames. It may be desirable to configure such an implementation of task T230 to add random noise to the interpolated description. FIG. 30C also shows an example in which task T230 is configured to copy the reference vector $s_{r1}$ to the target vector $s_t$ for each subsequent target frame in a series longer than p (e.g., until a new reference encoded frame or the next active frame is received).

Task T230 may also be implemented to calculate the target spectral description based on, in addition to the reference spectral information, the spectral envelope of one or more frames over another frequency band. For example, such an implementation of task T230 may be configured to calculate the target spectral description by extrapolating in frequency from the spectral envelope of the current frame, and/or of one or more previous frames, over another frequency band (e.g., the first frequency band).

Task T230 may also be configured to obtain a description of temporal information of the target inactive frame over the second frequency band, based on information from the reference encoded frame (also called herein "reference temporal information"). The reference temporal information is typically a description of temporal information over the second frequency band. This description may include one or more gain frame values, gain profile values, pitch parameter values, and/or codebook indices. Generally this description is a description of temporal information of the first inactive frame over the second frequency band as obtained from the reference encoded frame by task T210. It is also possible for the reference temporal information to include a description of temporal information (e.g., of the first inactive frame) over the first frequency band and/or over another frequency band.

Task T230 may be configured to obtain a description of temporal information of the target frame over the second frequency band (also called herein the "target temporal description") by copying the reference temporal information. Alternatively, it may be desirable to configure task T230 to obtain the target temporal description by calculating it based on the reference temporal information. For example, task T230 may be configured to calculate the target temporal description by adding random noise to the reference temporal information. Task T230 may also be configured to calculate the target temporal description based on information from more than one reference encoded frame. For example, task T230 may be configured to calculate the target temporal description as an average of descriptions of temporal information over the second frequency band from two or more reference encoded frames, and such calculation may include adding random noise to the calculated average.

The target temporal description and reference temporal information may each include a description of a temporal envelope. As noted above, a description of a temporal envelope may include a gain frame value and/or a set of gain shape values. Alternatively or additionally, the target temporal description and reference temporal information may each include a description of an excitation signal. A description of an excitation signal may include a description of a pitch component (e.g., pitch lag, pitch gain, and/or a description of a prototype).

Task T230 is typically configured to set a gain shape of the target temporal description to be flat. For example, task T230 may be configured to set the gain shape values of the target temporal description to be equal to each other. One such implementation of task T230 is configured to set all of the gain shape values to a factor of one (e.g., zero dB). Another such implementation of task T230 is configured to set all of the gain shape values to a factor of 1/n, where n is the number of gain shape values in the target temporal description.

Task T230 may be iterated to calculate a target temporal description for each of a series of target frames. For example, task T230 may be configured to calculate gain frame values for each of a series of successive target frames based on a gain frame value from the most recent reference encoded frame. In such cases it may be desirable to configure task T230 to add random noise to the gain frame value for each target frame (alternatively, to add random noise to the gain frame value for each target frame after the first in the series), as the series of temporal envelopes may otherwise be perceived as unnaturally smooth. Such an implementation of task T230 may be configured to calculate a gain frame value $g_t$ for each target frame in the series according to an expression such as $g_t=zg_r$ or $g_t=wg_r+(1-w)z$, where $g_r$ is the gain frame value from the reference encoded frame, z is a random value that is reevaluated for each of the series of target frames, and w is a weighting factor. Typical ranges for values of z include from 0 to 1 and from −1 to +1. Typical ranges of values for w include 0.5 (or 0.6) to 0.9 (or 1.0).

Task T230 may be configured to calculate a gain frame value for a target frame based on gain frame values from the two or three most recent reference encoded frames. In one such example, task T230 is configured to calculate the gain frame value for the target frame as an average according to an expression such as $$g_t = \frac{g_{r1} + g_{r2}}{2},$$

where $g_{r1}$ is the gain frame value from the most recent reference encoded frame and $g_{r2}$ is the gain frame value from the next most recent reference encoded frame. In a related example, the reference gain frame values are weighted differently from each other (e.g., a more recent value may be more heavily weighted). It may be desirable to implement task T230 to calculate a gain frame value for each in a series of target frames based on such an average. For example, such an implementation of task T230 may be configured to calculate the gain frame value for each target frame in the series (alternatively, for each target frame after the first in the series) by adding a different random noise value to the calculated average gain frame value.

In another example, task T230 is configured to calculate a gain frame value for the target frame as a running average of gain frame values from successive reference encoded frames. Such an implementation of task T230 may be configured to calculate the target gain frame value as the current value of a running average gain frame value according to an autoregressive (AR) expression such as $g_{cur}=\alpha g_{prev}+(1-\alpha)g_r$, where $g_{cur}$ and $g_{prev}$ are the current and previous values of the running average, respectively. For the smoothing factor $\alpha$, it may be desirable to use a value between 0.5 or 0.75 and 1, such as zero point eight (0.8) or zero point nine (0.9). It may be desirable to implement task T230 to calculate a value $g_t$ for each in a series of target frames based on such a running average. For example, such an implementation of task T230 may be configured to calculate the value $g_t$ for each target frame in the series (alternatively, for each target frame after the first in the series) by adding a different random noise value to the running average gain frame value $g_{cur}$.

In a further example, task T230 is configured to apply an attenuation factor to the contribution from the reference temporal information. For example, task T230 may be configured to calculate the running average gain frame value according to an expression such as $g_{cur}=\alpha g_{prev}+(1-\alpha)/\beta g_r$, where attenuation factor $\beta$ is a tunable parameter having a value of less than one, such as a value in the range of from 0.5 to 0.9 (e.g., zero point six (0.6)). It may be desirable to implement task T230 to calculate a value $g_t$ for each in a series of target frames based on such a running average. For example, such an implementation of task T230 may be configured to calculate the value $g_t$ for each target frame in the series (alternatively, for each target frame after the first in the series) by adding a different random noise value to the running average gain frame value $g_{cur}$.

It may be desirable to iterate task T230 to calculate target spectral and temporal descriptions for each of a series of target frames. In such case, task T230 may be configured to update the target spectral and temporal descriptions at different rates. For example, such an implementation of task T230 may be configured to calculate different target spectral descriptions for each target frame but to use the same target temporal description for more than one consecutive target frame.

Implementations of method M200 (including methods M210 and M220) are typically configured to include an operation that stores the reference spectral information to a buffer. Such an implementation of method M200 may also include an operation that stores the reference temporal information to a buffer. Alternatively, such an implementation of method M200 may include an operation that stores both of the reference spectral information and the reference temporal information to a buffer.

Different implementations of method M200 may use different criteria in deciding whether to store information based on an encoded frame as reference spectral information. The decision to store reference spectral information is typically based on the coding scheme of the encoded frame and may also be based on the coding schemes of one or more previous and/or subsequent encoded frames. Such an implementation of method M200 may be configured to use the same or different criteria in deciding whether to store reference temporal information.

It may be desirable to implement method M200 such that stored reference spectral information is available for more than one reference encoded frame at a time. For example, task T230 may be configured to calculate a target spectral description that is based on information from more than one reference frame. In such cases, method M200 may be configured to maintain in storage, at any one time, reference spectral information from the most recent reference encoded frame, information from the second most recent reference encoded frame, and possibly information from one or more less recent reference encoded frames as well. Such a method may also be configured to maintain the same history, or a different history, for reference temporal information. For example, method M200 may be configured to retain a description of a spectral envelope from each of the two most recent reference encoded frames and a description of temporal information from only the most recent reference encoded frame.

As noted above, each of the encoded frames may include a coding index that identifies the coding scheme, or the coding rate or mode, according to which the frame is encoded. Alternatively, a speech decoder may be configured to determine at least part of the coding index from the encoded frame. For example, a speech decoder may be configured to determine a bit rate of an encoded frame from one or more parameters such as frame energy. Similarly, for a coder that supports more than one coding mode for a particular coding rate, a speech decoder may be configured to determine the appropriate coding mode from a format of the encoded frame.

Not all of the encoded frames in the encoded speech signal will qualify to be reference encoded frames. For example, an encoded frame that does not include a description of a spectral envelope over the second frequency band would generally be unsuitable for use as a reference encoded frame. In some applications, it may be desirable to regard any encoded frame that contains a description of a spectral envelope over the second frequency band to be a reference encoded frame.

A corresponding implementation of method M200 may be configured to store information based on the current encoded frame as reference spectral information if the frame contains a description of a spectral envelope over the second frequency band. In the context of a set of coding schemes as shown in FIG. 18, for example, such an implementation of method M200 may be configured to store reference spectral information if the coding index of the frame indicates either of coding schemes 1 and 2 (i.e., rather than coding scheme 3). More generally, such an implementation of method M200 may be configured to store reference spectral information if the coding index of the frame indicates a wideband coding scheme rather than a narrowband coding scheme.

It may be desirable to implement method M200 to obtain target spectral descriptions (i.e., to perform task T230) only for target frames that are inactive. In such cases, it may be desirable for the reference spectral information to be based only on encoded inactive frames and not on encoded active frames. Although active frames include the background noise, reference spectral information based on an encoded active frame would also be likely to include information relating to speech components that could corrupt the target spectral description.

Such an implementation of method M200 may be configured to store information based on the current encoded frame as reference spectral information if the coding index of the frame indicates a particular coding mode (e.g., NELP). Other implementations of method M200 are configured to store information based on the current encoded frame as reference spectral information if the coding index of the frame indicates a particular coding rate (e.g., half-rate). Other implementations of method M200 are configured to store information based on the current encoded frame as reference spectral information according to a combination of such criteria: for example, if the coding index of the frame indicates that the frame contains a description of a spectral envelope over the second frequency band and also indicates a particular coding mode and/or rate. Further implementations of method M200 are configured to store information based on the current encoded frame as reference spectral information if the coding index of the frame indicates a particular coding scheme (e.g., coding scheme 2 in an example according to FIG. 18, or a wideband coding scheme that is reserved for use with inactive frames in another example).

It may not be possible to determine from its coding index alone whether a frame is active or inactive. In the set of coding schemes shown in FIG. 18, for example, coding scheme 2 is used for both active and inactive frames. In such a case, the coding indices of one or more subsequent frames may help to indicate whether an encoded frame is inactive. The description above, for example, discloses methods of speech encoding in which a frame encoded using coding scheme 2 is inactive if the following frame is encoded using coding scheme 3. A corresponding implementation of method M200 may be configured to store information based on the current encoded frame as reference spectral information if the coding index of the frame indicates coding scheme 2 and the coding index of the next encoded frame indicates coding scheme 3. In a related example, an implementation of method M200 is configured to store information based on an encoded frame as reference spectral information if the frame is encoded at half-rate and the next frame is encoded at eighth-rate.

For a case in which a decision to store information based on an encoded frame as reference spectral information depends on information from a subsequent encoded frame, method M200 may be configured to perform the operation of storing reference spectral information in two parts. The first part of the storage operation provisionally stores information based on an encoded frame. Such an implementation of method M200 may be configured to provisionally store information for all frames, or for all frames that satisfy some predetermined criterion (e.g., all frames having a particular coding rate, mode, or scheme). Three different examples of such a criterion are (1) frames whose coding index indicates a NELP coding mode, (2) frames whose coding index indicates half-rate, and (3) frames whose coding index indicates coding scheme 2 (e.g., in an application of a set of coding schemes according to FIG. 18).

The second part of the storage operation stores provisionally stored information as reference spectral information if a predetermined condition is satisfied. Such an implementation of method M200 may be configured to defer this part of the operation until one or more subsequent frames are received (e.g., until the coding mode, rate or scheme of the next encoded frame is known). Three different examples of such a condition are (1) the coding index of the next encoded frame indicates eighth-rate, (2) the coding index of the next encoded frame indicates a coding mode used only for inactive frames, and (3) the coding index of the next encoded frame indicates coding scheme 3 (e.g., in an application of a set of coding schemes according to FIG. 18). If the condition for the second part of the storage operation is not satisfied, the provisionally stored information may be discarded or overwritten.

The second part of a two-part operation to store reference spectral information may be implemented according to any of several different configurations. In one example, the second part of the storage operation is configured to change the state of a flag associated with the storage location that holds the provisionally stored information (e.g., from a state indicating "provisional" to a state indicating "reference"). In another example, the second part of the storage operation is configured to transfer the provisionally stored information to a buffer that is reserved for storage of reference spectral information. In a further example, the second part of the storage operation is configured to update one or more pointers into a buffer (e.g., a circular buffer) that holds the provisionally stored reference spectral information. In this case, the pointers may include a read pointer indicating the location of reference spectral information from the most recent reference encoded frame and/or a write pointer indicating a location at which to store provisionally stored information.

Figure 31:
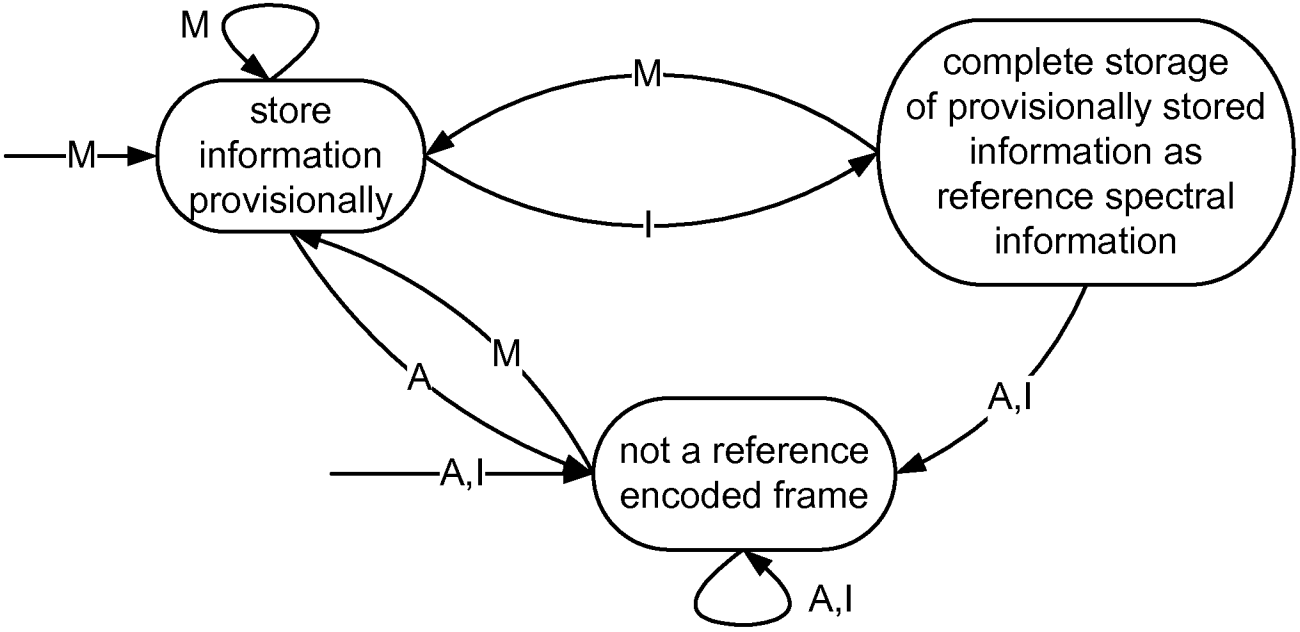
FIG. 31 shows a portion of a state diagram for a speech decoder configured to perform an implementation of method M200.

FIG. 31 shows a corresponding portion of a state diagram for a speech decoder configured to perform an implementation of method M200 in which the coding scheme of the following encoded frame is used to determine whether to store information based on an encoded frame as reference spectral information. In this diagram, the path labels indicate the frame type associated with the coding scheme of the current frame, where A indicates a coding scheme used only for active frames, I indicates a coding scheme used only for inactive frames, and M (for "mixed") indicates a coding scheme that is used for active frames and for inactive frames. For example, such a decoder may be included in a coding system that uses a set of coding schemes as shown in FIG. 18, where the schemes 1, 2, and 3 correspond to the path labels A, M, and I, respectively. As shown in FIG. 31, information is provisionally stored for all encoded frames having a coding index that indicates a "mixed" coding scheme. If the coding index of the next frame indicates that the frame is inactive, then storage of the provisionally stored information as reference spectral information is completed. Otherwise, the provisionally stored information may be discarded or overwritten.

It is expressly noted that the preceding discussion relating to selective storage and provisional storage of reference spectral information, and the accompanying state diagram of FIG. 31, are also applicable to the storage of reference temporal information in implementations of method M200 that are configured to store such information.

In a typical application of an implementation of method M200, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of method M200 may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive encoded frames.

Figure 32A:
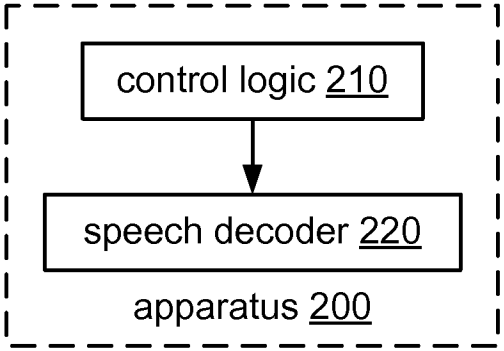
FIG. 32A shows a block diagram of an apparatus 200 for processing an encoded speech signal according to a general configuration.

FIG. 32A shows a block diagram of an apparatus 200 for processing an encoded speech signal according to a general configuration. For example, apparatus 200 may be configured to perform a method of speech decoding that includes an implementation of method M200 as described herein. Apparatus 200 includes control logic 210 that is configured to generate a control signal having a sequence of values. Apparatus 200 also includes a speech decoder 220 that is configured to calculate decoded frames of a speech signal based on values of the control signal and on corresponding encoded frames of the encoded speech signal.

A communications device that includes apparatus 200, such as a cellular telephone, may be configured to receive the encoded speech signal from a wired, wireless, or optical transmission channel. Such a device may be configured to perform preprocessing operations on the encoded speech signal, such as decoding of error-correction and/or redundancy codes. Such a device may also include implementations of both of apparatus 100 and apparatus 200 (e.g., in a transceiver).

Control logic 210 is configured to generate a control signal including a sequence of values that is based on coding indices of encoded frames of the encoded speech signal. Each value of the sequence corresponds to an encoded frame of the encoded speech signal (except in the case of an erased frame as discussed below) and has one of a plurality of states. In some implementations of apparatus 200 as described below, the sequence is binary-valued (i.e., a sequence of high and low values). In other implementations of apparatus 200 as described below, the values of the sequence may have more than two states.

Control logic 210 may be configured to determine the coding index for each encoded frame. For example, control logic 210 may be configured to read at least part of the coding index from the encoded frame, to determine a bit rate of the encoded frame from one or more parameters such as frame energy, and/or to determine the appropriate coding mode from a format of the encoded frame. Alternatively, apparatus 200 may be implemented to include another element that is configured to determine the coding index for each encoded frame and provide it to control logic 210, or apparatus 200 may be configured to receive the coding index from another module of a device that includes apparatus 200.

An encoded frame that is not received as expected, or is received having too many errors to be recovered, is called a frame erasure. Apparatus 200 may be configured such that one or more states of the coding index are used to indicate a frame erasure or a partial frame erasure, such as the absence of a portion of the encoded frame that carries spectral and temporal information for the second frequency band. For example, apparatus 200 may be configured such that the coding index for an encoded frame that has been encoded using coding scheme 2 indicates an erasure of the highband portion of the frame.

Speech decoder 220 is configured to calculate decoded frames based on values of the control signal and corresponding encoded frames of the encoded speech signal. When the value of the control signal has a first state, decoder 220 calculates a decoded frame based on a description of a spectral envelope over the first and second frequency bands, where the description is based on information from the corresponding encoded frame. When the value of the control signal has a second state, decoder 220 retrieves a description of a spectral envelope over the second frequency band and calculates a decoded frame based on the retrieved description and on a description of a spectral envelope over the first frequency band, where the description over the first frequency band is based on information from the corresponding encoded frame.

Figure 32B:
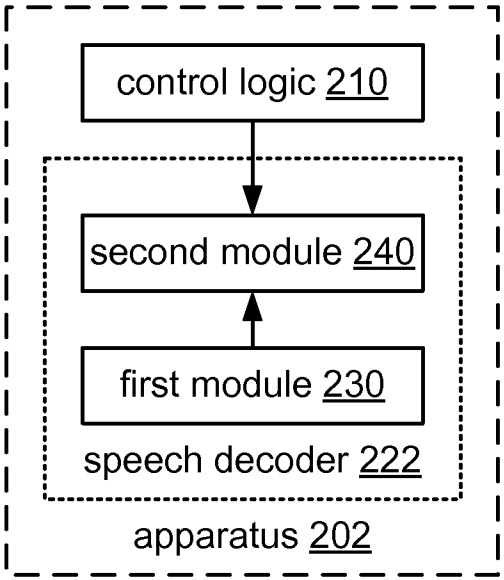
FIG. 32B shows a block diagram of an implementation 202 of apparatus 200.

FIG. 32B shows a block diagram of an implementation 202 of apparatus 200. Apparatus 202 includes an implementation 222 of speech decoder 220 that includes a first module 230 and a second module 240. Modules 230 and 240 are configured to calculate respective subband portions of decoded frames. Specifically, first module 230 is configured to calculate a decoded portion of a frame over the first frequency band (e.g., a narrowband signal), and second module 240 is configured to calculate, based on a value of the control signal, a decoded portion of the frame over the second frequency band (e.g., a highband signal).

Figure 32C:
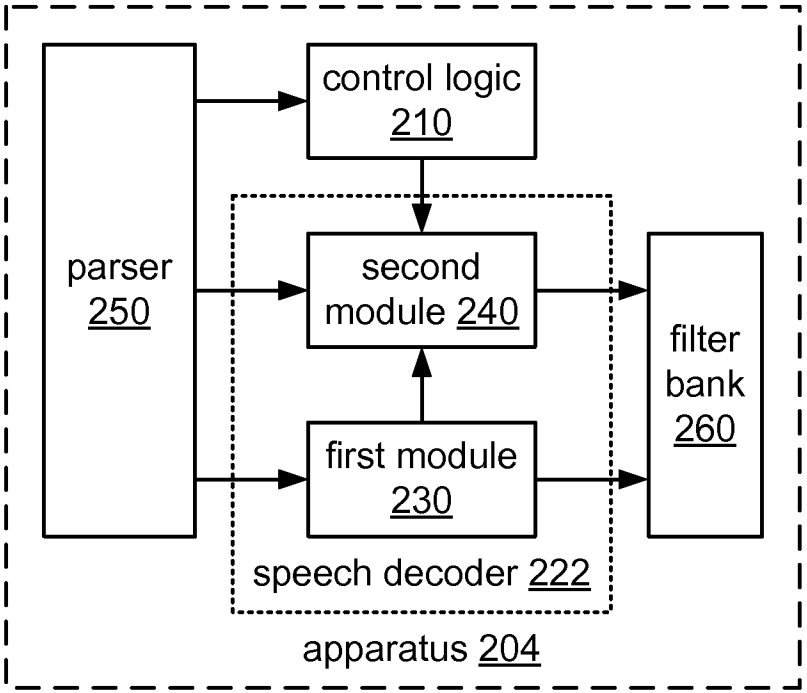
FIG. 32C shows a block diagram of an implementation 204 of apparatus 200.

FIG. 32C shows a block diagram of an implementation 204 of apparatus 200. Parser 250 is configured to parse the bits of an encoded frame to provide a coding index to control logic 210 and at least one description of a spectral envelope to speech decoder 220. In this example, apparatus 204 is also an implementation of apparatus 202, such that parser 250 is configured to provide descriptions of spectral envelopes over respective frequency bands (when available) to modules 230 and 240. Parser 250 may also be configured to provide at least one description of temporal information to speech decoder 220. For example, parser 250 may be implemented to provide descriptions of temporal information for respective frequency bands (when available) to modules 230 and 240.

Apparatus 204 also includes a filter bank 260 that is configured to combine the decoded portions of the frames over the first and second frequency bands to produce a wideband speech signal. Particular examples of such filter banks are described in, e.g., U.S. Pat. Appl. Publ. No. 2007/088558 (Vos et al.), "SYSTEMS, METHODS, AND APPARATUS FOR SPEECH SIGNAL FILTERING," published Apr. 19, 2007. For example, filter bank 260 may include a lowpass filter configured to filter the narrowband signal to produce a first passband signal and a highpass filter configured to filter the highband signal to produce a second passband signal. Filter bank 260 may also include an upsampler configured to increase the sampling rate of the narrowband signal and/or of the highband signal according to a desired corresponding interpolation factor, as described in, e.g., U.S. Pat. Appl. Publ. No. 2007/088558 (Vos et al.).

Figure 33A:
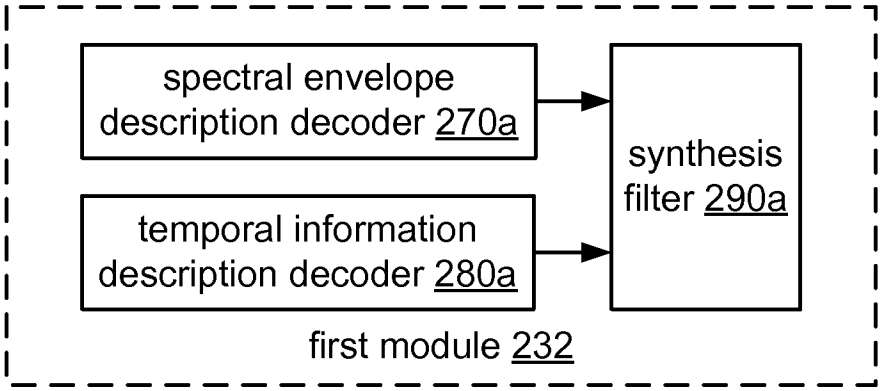
FIG. 33A shows a block diagram of an implementation 232 of first module 230.

FIG. 33A shows a block diagram of an implementation 232 of first module 230 that includes an instance 270*a* of a spectral envelope description decoder 270 and an instance 280*a* of a temporal information description decoder 280. Spectral envelope description decoder 270*a* is configured to decode a description of a spectral envelope over the first frequency band (e.g., as received from parser 250). Temporal information description decoder 280*a* is configured to decode a description of temporal information for the first frequency band (e.g., as received from parser 250). For example, temporal information description decoder 280*a* may be configured to decode an excitation signal for the first frequency band. An instance 290*a* of synthesis filter 290 is configured to generate a decoded portion of the frame over the first frequency band (e.g., a narrowband signal) that is based on the decoded descriptions of a spectral envelope and temporal information. For example, synthesis filter 290*a* may be configured according to a set of values within the description of a spectral envelope over the first frequency band (e.g., one or more LSP or LPC coefficient vectors) to produce the decoded portion in response to an excitation signal for the first frequency band.

Figure 33B:
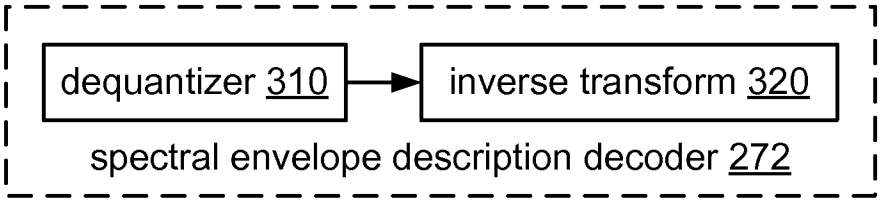
FIG. 33B shows a block diagram of an implementation 272 of spectral envelope description decoder 270.

FIG. 33B shows a block diagram of an implementation 272 of spectral envelope description decoder 270. Dequantizer 310 is configured to dequantize the description, and inverse transform block 320 is configured to apply an inverse transform to the dequantized description to obtain a set of LPC coefficients. Temporal information description decoder 280 is also typically configured to include a dequantizer.

Figure 34A:
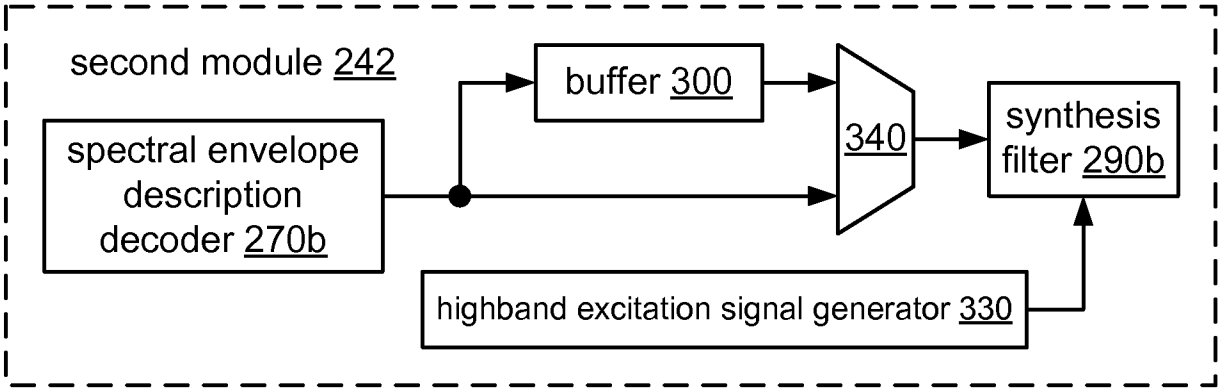
FIG. 34A shows a block diagram of an implementation 242 of second module 240.

FIG. 34A shows a block diagram of an implementation 242 of second module 240. Second module 242 includes an instance 270*b* of spectral envelope description decoder 270, a buffer 300, and a selector 340. Spectral envelope description decoder 270*b* is configured to decode a description of a spectral envelope over the second frequency band (e.g., as received from parser 250). Buffer 300 is configured to store one or more descriptions of a spectral envelope over the second frequency band as reference spectral information, and selector 340 is configured to select, according to the state of a corresponding value of the control signal generated by control logic 210, a decoded description of a spectral envelope from either (A) buffer 300 or (B) decoder 270*b*.

Second module 242 also includes a highband excitation signal generator 330 and an instance 290*b* of synthesis filter 290 that is configured to generate a decoded portion of the frame over the second frequency band (e.g., a highband signal) based on the decoded description of a spectral envelope received via selector 340. Highband excitation signal generator 330 is configured to generate an excitation signal for the second frequency band, based on an excitation signal for the first frequency band (e.g., as produced by temporal information description decoder 280*a*). Additionally or in the alternative, generator 330 may be configured to perform spectral and/or amplitude shaping of random noise to generate the highband excitation signal. Generator 330 may be implemented as an instance of highband excitation signal generator A60 as described above. Synthesis filter 290*b* is configured according to a set of values within the description of a spectral envelope over the second frequency band (e.g., one or more LSP or LPC coefficient vectors) to produce the decoded portion of the frame over the second frequency band in response to the highband excitation signal.

In one example of an implementation of apparatus 202 that includes an implementation 242 of second module 240, control logic 210 is configured to output a binary signal to selector 340, such that each value of the sequence has a state A or a state B. In this case, if the coding index of the current frame indicates that it is inactive, control logic 210 generates a value having a state A, which causes selector 340 to select the output of buffer 300 (i.e., selection A). Otherwise, control logic 210 generates a value having a state B, which causes selector 340 to select the output of decoder 270*b* (i.e., selection B).

Apparatus 202 may be arranged such that control logic 210 controls an operation of buffer 300. For example, buffer 300 may be arranged such that a value of the control signal that has state B causes buffer 300 to store the corresponding output of decoder 270*b*. Such control may be implemented by applying the control signal to a write enable input of buffer 300, where the input is configured such that state B corresponds to its active state. Alternatively, control logic 210 may be implemented to generate a second control signal, also including a sequence of values that is based on coding indices of encoded frames of the encoded speech signal, to control an operation of buffer 300.

Figure 34B:
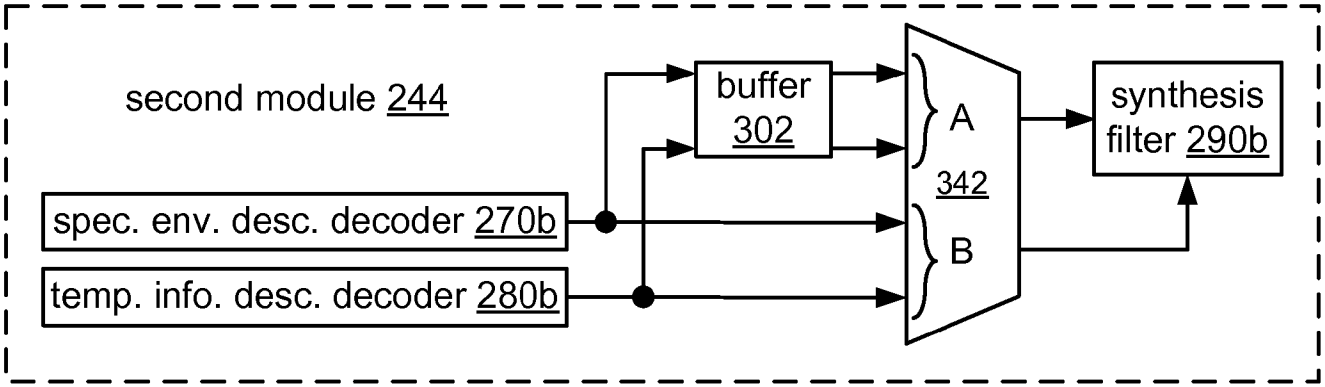
FIG. 34B shows a block diagram of an implementation 244 of second module 240.

FIG. 34B shows a block diagram of an implementation 244 of second module 240. Second module 244 includes spectral envelope description decoder 270*b* and an instance 280*b* of temporal information description decoder 280 that is configured to decode a description of temporal information for the second frequency band (e.g., as received from parser 250). Second module 244 also includes an implementation 302 of a buffer 300 that is also configured to store one or more descriptions of temporal information over the second frequency band as reference temporal information.

Second module 244 includes an implementation 342 of selector 340 that is configured to select, according to the state of a corresponding value of the control signal generated by control logic 210, a decoded description of a spectral envelope and a decoded description of temporal information from either (A) buffer 302 or (B) decoders 270*b*, 280*b*. An instance 290*b* of synthesis filter 290 is configured to generate a decoded portion of the frame over the second frequency band (e.g., a highband signal) that is based on the decoded descriptions of a spectral envelope and temporal information received via selector 342. In a typical implementation of apparatus 202 that includes second module 244, temporal information description decoder 280*b* is configured to produce a decoded description of temporal information that includes an excitation signal for the second frequency band, and synthesis filter 290*b* is configured according to a set of values within the description of a spectral envelope over the second frequency band (e.g., one or more LSP or LPC coefficient vectors) to produce the decoded portion of the frame over the second frequency band in response to the excitation signal.

Figure 34C:
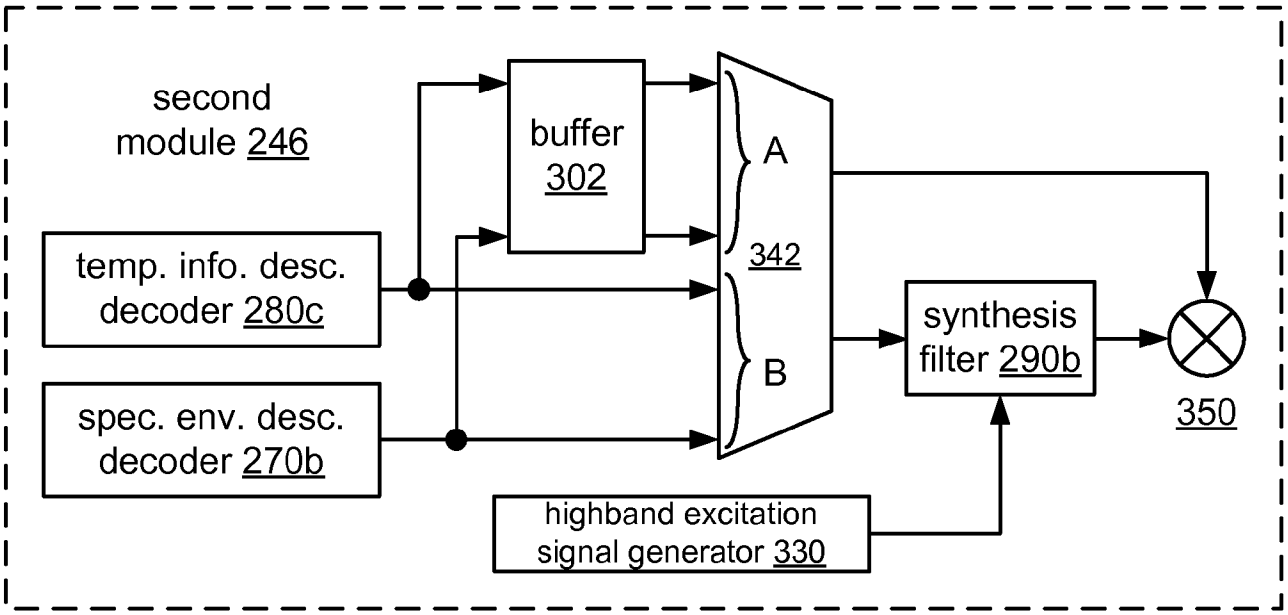
FIG. 34C shows a block diagram of an implementation 246 of second module 242.

FIG. 34C shows a block diagram of an implementation 246 of second module 242 that includes buffer 302 and selector 342. Second module 246 also includes an instance 280*c* of temporal information description decoder 280, which is configured to decode a description of a temporal envelope for the second frequency band, and a gain control element 350 (e.g., a multiplier or amplifier) that is configured to apply a description of a temporal envelope received via selector 342 to the decoded portion of the frame over the second frequency band. For a case in which the decoded description of a temporal envelope includes gain shape values, gain control element 350 may include logic configured to apply the gain shape values to respective subframes of the decoded portion.

FIGS. 34A-34C show implementations of second module 240 in which buffer 300 receives fully decoded descriptions of spectral envelopes (and, in some cases, of temporal information). Similar implementations may be arranged such that buffer 300 receives descriptions that are not fully decoded. For example, it may be desirable to reduce storage requirements by storing the description in quantized form (e.g., as received from parser 250). In such cases, the signal path from buffer 300 to selector 340 may be configured to include decoding logic, such as a dequantizer and/or an inverse transform block.

Figure 35A:
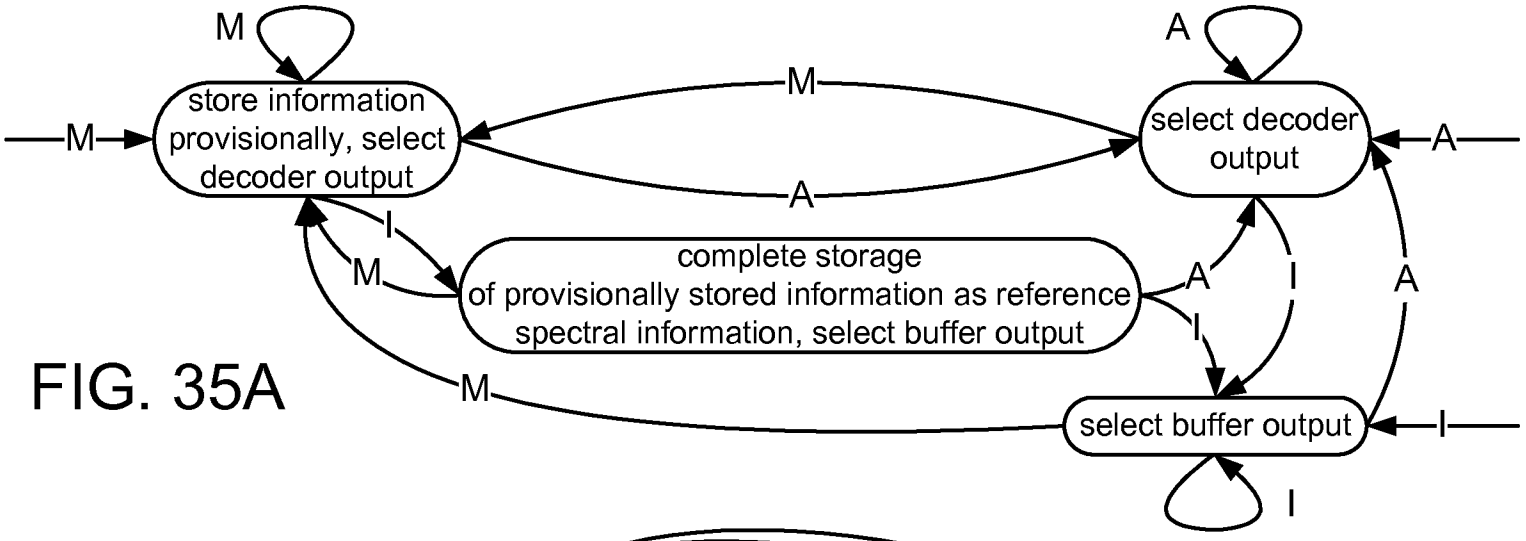
FIG. 35A shows a state diagram according to which an implementation of control logic 210 may be configured to operate.

FIG. 35A shows a state diagram according to which an implementation of control logic 210 may be configured to operate. In this diagram, the path labels indicate the frame type associated with the coding scheme of the current frame, where A indicates a coding scheme used only for active frames, I indicates a coding scheme used only for inactive frames, and M (for "mixed") indicates a coding scheme that is used for active frames and for inactive frames. For example, such a decoder may be included in a coding system that uses a set of coding schemes as shown in FIG. 18, where the schemes 1, 2, and 3 correspond to the path labels A, M, and I, respectively. The state labels in FIG. 35A indicate the state of the corresponding value(s) of the control signal(s).

As noted above, apparatus 202 may be arranged such that control logic 210 controls an operation of buffer 300. For a case in which apparatus 202 is configured to perform an operation of storing reference spectral information in two parts, control logic 210 may be configured to control buffer 300 to perform a selected one of three different tasks: (1) to provisionally store information based on an encoded frame, (2) to complete storage of provisionally stored information as reference spectral and/or temporal information, and (3) to output stored reference spectral and/or temporal information.

In one such example, control logic 210 is implemented to produce a control signal whose values have at least four possible states, each corresponding to a respective state of the diagram shown in FIG. 35A, that controls the operation of selector 340 and buffer 300. In another such example, control logic 210 is implemented to produce (1) a control signal, whose values have at least two possible states, to control an operation of selector 340 and (2) a second control signal, including a sequence of values that is based on coding indices of encoded frames of the encoded speech signal and whose values have at least three possible states, to control an operation of buffer 300.

It may be desirable to configure buffer 300 such that, during processing of a frame for which an operation to complete storage of the provisionally stored information is selected, the provisionally stored information is also available for selector 340 to select it. In such a case, control logic 210 may be configured to output the current values of signals to control selector 340 and buffer 300 at slightly different times. For example, control logic 210 may be configured to control buffer 300 to move a read pointer early enough in the frame period that buffer 300 outputs the provisionally stored information in time for selector 340 to select it.

As noted above with reference to FIG. 13B, it may be desirable at times for a speech encoder performing an implementation of method M100 to use a higher bit rate to encode an inactive frame that is surrounded by other inactive frames. In such case, it may be desirable for a corresponding speech decoder to store information based on that encoded frame as reference spectral and/or temporal information, so that the information may be used in decoding future inactive frames in the series.

The various elements of an implementation of apparatus 200 may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of apparatus 200 as described herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of apparatus 200 may also be embodied as one or more computers (e.g., machines including one or more arrays programmed to execute one or more sets or sequences of instructions, also called "processors"), and any two or more, or even all, of these elements may be implemented within the same such computer or computers.

The various elements of an implementation of apparatus 200 may be included within a device for wireless communications such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as de-interleaving, de-puncturing, decoding of one or more convolution codes, decoding of one or more error correction codes, decoding of one or more layers of network protocol (e.g., Ethernet, TCP/IP, cdma2000), radio-frequency (RF) demodulation, and/or RF reception.

It is possible for one or more elements of an implementation of apparatus 200 to be used to perform tasks or execute other sets of instructions that are not directly related to an operation of the apparatus, such as a task relating to another operation of a device or system in which the apparatus is embedded. It is also possible for one or more elements of an implementation of apparatus 200 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, control logic 210, first module 230, and second module 240 are implemented as sets of instructions arranged to execute on the same processor. In another such example, spectral envelope description decoders 270*a* and 270*b* are implemented as the same set of instructions executing at different times.

A device for wireless communications, such as a cellular telephone or other device having such communications capability, may be configured to include implementations of both of apparatus 100 and apparatus 200. In such case, it is possible for apparatus 100 and apparatus 200 to have structure in common. In one such example, apparatus 100 and apparatus 200 are implemented to include sets of instructions that are arranged to execute on the same processor.

At any time during a full duplex telephonic communication, it may be expected that the input to at least one of the speech encoders will be an inactive frame. It may be desirable to configure a speech encoder to transmit encoded frames for fewer than all of the frames in a series of inactive frames. Such operation is also called discontinuous transmission (DTX). In one example, a speech encoder performs DTX by transmitting one encoded frame (also called a "silence descriptor" or SID) for each string of n consecutive inactive frames, where n is 32. The corresponding decoder applies information in the SID to update a noise generation model that is used by a comfort noise generation algorithm to synthesize inactive frames. Other typical values of n include 8 and 16. Other names used in the art to indicate an SID include "update to the silence description," "silence insertion description," "silence insertion descriptor," "comfort noise descriptor frame," and "comfort noise parameters."

It may be appreciated that in an implementation of method M200, the reference encoded frames are similar to SIDs in that they provide occasional updates to the silence description for the highband portion of the speech signal. Although the potential advantages of DTX are typically greater in packet-switched networks than in circuit-switched networks, it is expressly noted that methods M100 and M200 are applicable to both circuit-switched and packet-switched networks.

Figure 35B:
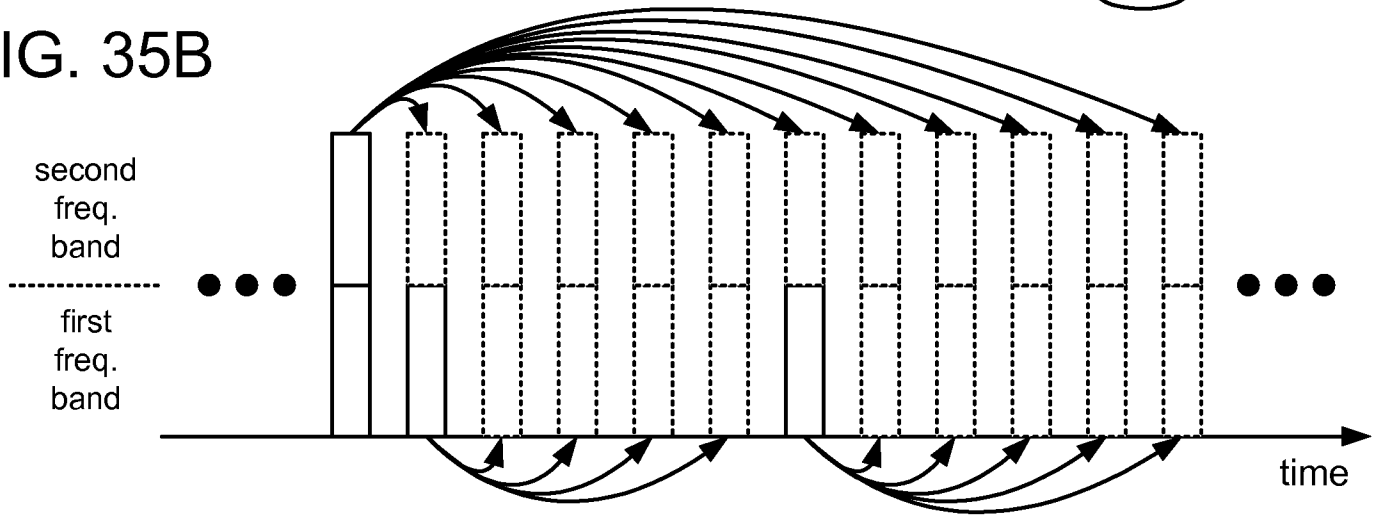
FIG. 35B shows a result of one example of combining method M100 with DTX.

An implementation of method M100 may be combined with DTX (e.g., in a packet-switched network), such that encoded frames are transmitted for fewer than all of the inactive frames. A speech encoder performing such a method may be configured to transmit an SID occasionally, at some regular interval (e.g., every eighth, sixteenth, or 32nd frame in a series of inactive frames) or upon some event. FIG. 35B shows an example in which an SID is transmitted every sixth frame. In this case, the SID includes a description of a spectral envelope over the first frequency band.

A corresponding implementation of method M200 may be configured to generate, in response to a failure to receive an encoded frame during a frame period following an inactive frame, a frame that is based on the reference spectral information. As shown in FIG. 35B, such an implementation of method M200 may be configured to obtain a description of a spectral envelope over the first frequency band for each intervening inactive frame, based on information from one or more received SIDs. For example, such an operation may include an interpolation between descriptions of spectral envelopes from the two most recent SIDs, as in the examples shown in FIGS. 30A-30C. For the second frequency band, the method may be configured to obtain a description of a spectral envelope (and possibly a description of a temporal envelope) for each intervening inactive frame based on information from one or more recent reference encoded frames (e.g., according to any of the examples described herein). Such a method may also be configured to generate an excitation signal for the second frequency band that is based on an excitation signal for the first frequency band from one or more recent SIDs.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. For example, the various elements and tasks described herein for processing a highband portion of a speech signal that includes frequencies above the range of a narrowband portion of the speech signal may be applied alternatively or additionally, and in an analogous manner, for processing a lowband portion of a speech signal that includes frequencies below the range of a narrowband portion of the speech signal. In such a case, the disclosed techniques and structures for deriving a highband excitation signal from the narrowband excitation signal may be used to derive a lowband excitation signal from the narrowband excitation signal. Thus, the present disclosure is not intended to be limited to the configurations shown above but rather is to be accorded the widest scope consistent with the principles and novel features disclosed in any fashion herein, including in the attached claims as filed, which form a part of the original disclosure.

Examples of codecs that may be used with, or adapted for use with, speech encoders, methods of speech encoding, speech decoders, and/or methods of speech decoding as described herein include an Enhanced Variable Rate Codec (EVRC) as described in the document 3GPP2 C.S0014-C version 1.0, "Enhanced Variable Rate Codec, Speech Service Options 3, 68, and 70 for Wideband Spread Spectrum Digital Systems" (Third Generation Partnership Project 2, Arlington, Va., January 2007); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004).

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof. Although the signal from which the encoded frames are derived is called a "speech signal," it is also contemplated and hereby disclosed that this signal may carry music or other non-speech information content during active frames.

Those of skill would further appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor (DSP), an ASIC, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The tasks of the methods and algorithms described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Each of the configurations described herein may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

What is claimed is:

1. A method of processing an encoded speech signal in a decoder comprising a filter bank, said method comprising:

receiving the encoded speech signal by the decoder;

based on information from a first encoded frame of the encoded speech signal, obtaining a description of a spectral envelope of the first encoded frame of the encoded speech signal over (A) a first frequency band and (B) a second frequency band different than the first frequency band by the decoder;

based on information from a second encoded frame of the encoded speech signal, obtaining a description of a spectral envelope of the second encoded frame of the encoded speech signal over the first frequency band by the decoder, wherein the first encoded frame and the second encoded frame are inactive frames;

based on information from the first encoded frame, obtaining a description of a spectral envelope of the second encoded frame over the second frequency band by the decoder; and combining the obtained description of the spectral envelope of the second encoded frame over the first frequency band with the obtained description of the second encoded frame over the second frequency band to produce a decoded signal by the filter bank, wherein the first encoded frame is encoded according to a wideband coding scheme, wherein the second encoded frame is encoded according to a narrowband coding scheme, wherein the second encoded frame occurs after the first encoded frame, wherein the first encoded frame and the second encoded frame are not consecutive frames of the encoded speech signal, and wherein all frames of the encoded speech signal between the first encoded frame and the second encoded frame are inactive frames.

2. The method of claim 1, wherein a length of a most recent sequence of consecutive active frames relative to the first encoded frame is at least equal to a predetermined threshold value.

3. The method of claim 2, wherein the predetermined threshold value is three.

4. A computer program product comprising a non-transitory computer-readable medium, said medium comprising code for causing at least one computer to perform a method according to claim 1.

5. The method according to claim 1, wherein the first encoded frame is based on information from at least two inactive frames of the encoded speech signal.

6. The method of claim 1, wherein the first encoded frame has a length of q bits, q being a nonzero positive integer.

7. The method of claim 6, wherein the second encoded frame has a length of r bits, r being a nonzero positive integer less than q.

8. The method according to claim 1, wherein the first and second frequency bands overlap by at least two hundred Hertz.

9. An apparatus for processing an encoded speech signal, said apparatus comprising:

means for receiving the encoded speech signal;

means for obtaining, based on information from a first encoded frame of the encoded speech signal, a description of a spectral envelope of the first encoded frame of the encoded speech signal over (A) a first frequency band and (B) a second frequency band different than the first frequency band;

means for obtaining, based on information from a second encoded frame of the encoded speech signal, a description of a spectral envelope of the second encoded frame of the encoded speech signal over the first frequency band, wherein the first encoded frame and the second encoded frame are inactive frames;

means for obtaining, based on information from the first encoded frame, a description of a spectral envelope of the second encoded frame over the second frequency band; and means for combining the obtained description of the spectral envelope of the second encoded frame over the first frequency band with the obtained description of the second encoded frame over the second frequency band to produce a decoded signal, wherein the first encoded frame is encoded according to a wideband coding scheme, wherein the second encoded frame is encoded according to a narrowband coding scheme, wherein the second encoded frame occurs after the first encoded frame, wherein the first encoded frame and the second encoded frame are not consecutive frames of the encoded speech signal, and wherein all frames of the encoded speech signal between the first encoded frame and the second encoded frame are inactive frames.

10. The apparatus of claim 9, wherein a length of a most recent sequence of consecutive active frames relative to the first encoded frame is at least equal to a predetermined threshold value.

11. The apparatus of claim 9, wherein the first encoded frame is based on information from at least two inactive frames of the encoded speech signal.

12. The apparatus of claim 9, wherein the first encoded frame has a length of q bits, q being a nonzero positive integer.

13. The apparatus of claim 12, wherein the second encoded frame has a length of r bits, r being a nonzero positive integer less than q.

14. The apparatus of claim 9, wherein the first and second frequency bands overlap by at least two hundred Hertz.

15. An apparatus for processing an encoded speech signal, said apparatus comprising:

a speech decoder configured to:

receive the encoded speech signal;

obtain, based on information from a first encoded frame of the encoded speech signal, a description of a spectral envelope of first encoded frame of the encoded speech signal over (A) a first frequency band and (B) a second frequency band different than the first frequency band;

obtain, based on information from a second encoded frame of the encoded speech signal, a description of a spectral envelope of the second encoded frame of the encoded speech signal over the first frequency band, wherein the first encoded frame and the second encoded frame are inactive frames; and obtain, based on information from the first encoded frame, a description of a spectral envelope of the second encoded frame over the second frequency band; and a filter bank configured to combine the obtained description of the spectral envelope of the second encoded frame over the first frequency band with the obtained description of the second encoded frame over the second frequency band to produce a decoded signal, wherein the first encoded frame is encoded according to a wideband coding scheme, wherein the second encoded frame is encoded according to a narrowband coding scheme, wherein the second encoded frame occurs after the first encoded frame, wherein the first encoded frame and the second encoded frame are not consecutive frames of the encoded speech signal, and wherein all frames of the encoded speech signal between the first encoded frame and the second encoded frame are inactive frames.

16. The apparatus of claim 15, wherein a length of a most recent sequence of consecutive active frames relative to the first encoded frame is at least equal to a predetermined threshold value.

17. The apparatus of claim 15, wherein the first encoded frame has a length of q bits, q being a nonzero positive integer.

18. The apparatus of claim 17, wherein the second encoded frame has a length of r bits, r being a nonzero positive integer less than q.

19. The apparatus of claim 15, wherein the first and second frequency bands overlap by at least two hundred Hertz.

20. The apparatus of claim 15, wherein the first encoded frame is based on information from at least two inactive frames of the encoded speech signal.

* * * * *